US010758836B2

(12) United States Patent
Akishbekov et al.

(10) Patent No.: US 10,758,836 B2
(45) Date of Patent: Sep. 1, 2020

(54) CONNECTING STRUCTURES IN A MODULAR CONSTRUCTION KIT

(71) Applicants: Rustem Akishbekov, Vienna (AT); Anna Iarotska, Vienna (AT)

(72) Inventors: Rustem Akishbekov, Vienna (AT); Anna Iarotska, Vienna (AT)

(73) Assignee: ROBO TECHNOLOGIES GMBH, Vienna (AT)

( * ) Notice: Subject to any disclaimer, the term of this patent is extended or adjusted under 35 U.S.C. 154(b) by 60 days.

(21) Appl. No.: 15/160,928

(22) Filed: May 20, 2016

(65) Prior Publication Data

US 2016/0339351 A1 Nov. 24, 2016

Related U.S. Application Data

(60) Provisional application No. 62/164,494, filed on May 20, 2015.

(51) Int. Cl.

| | |
|---|---|
| ***A63H 33/04*** | (2006.01) |
| ***A63H 33/10*** | (2006.01) |
| ***A63H 33/08*** | (2006.01) |

(52) U.S. Cl.

CPC ..... *A63H 33/042* (2013.01); *A63H 33/086* (2013.01); *A63H 33/088* (2013.01); *A63H 33/103* (2013.01); *A63H 33/108* (2013.01)

(58) Field of Classification Search

CPC .... A63H 33/04; A63H 33/042; A63H 33/046; A63H 33/086; A63H 33/108; F21S 2/005; F21V 23/06

USPC ..... 446/85, 91, 111, 124, 126, 128

See application file for complete search history.

(56) References Cited

U.S. PATENT DOCUMENTS

| | | | | |
|---|---|---|---|---|
| 2,885,822 A | | 5/1959 | Onanian | |
| 3,346,775 A | * | 10/1967 | Godtfred | H05K 1/0286 361/738 |
| 3,611,609 A | | 10/1971 | Reijnhard | |
| 3,696,548 A | * | 10/1972 | Teller | A63H 33/042 446/91 |
| 4,823,532 A | | 4/1989 | Westerburgen | |
| 5,742,486 A | * | 4/1998 | Yangkuai | A63H 33/042 361/807 |

(Continued)

FOREIGN PATENT DOCUMENTS

| | | |
|---|---|---|
| EP | 1099460 A2 | 5/2001 |
| WO | WO PCT/US2016/033483 | 10/2016 |

OTHER PUBLICATIONS

"4211807: Connector Peg," retrieved on Aug. 11, 2016, from http://brickset.com/parts/4211807, pp. 1-2.

*Primary Examiner* — Alexander R Niconovich

(74) *Attorney, Agent, or Firm* — One LLP; Joseph K. Liu

(57) ABSTRACT

A modular construction kit includes modular construction blocks, each includes at least one interface face. The interface face includes a recess, a plurality of connection apertures disposed proximate to the edge of the recess, and a circular interface receptacle disposed in the center of the recess. The kit also includes modular construction connectors, each includes two opposite sides, wherein each side including a body, a plurality of connection studs extending outwardly from the body, and a protrusion extending outwardly from the body. Some modular construction blocks include predetermined functions. A modular system block includes at least a processor, storage, and wireless communication.

4 Claims, 64 Drawing Sheets

(56) References Cited

U.S. PATENT DOCUMENTS 6,062,937 A * 5/2000 Kikuchi ..... A63H 33/042 446/484
6,443,796 B1 * 9/2002 Shackelford ..... A63H 33/042 273/237
6,736,691 B1 * 5/2004 Bach ..... A63H 33/101 446/128
7,144,255 B2 * 12/2006 Seymour ..... H01R 13/627 439/49
7,273,377 B2 * 9/2007 Seymour ..... H01R 13/6273 434/118
D580,995 S * 11/2008 Chun ..... D21/499
7,481,692 B2 * 1/2009 Bruder ..... A63H 33/101 446/111
D612,434 S 3/2010 Christensen
7,731,558 B2 * 6/2010 Capriola ..... A63H 33/042 273/120 A
7,846,002 B1 * 12/2010 Mikesell ..... A63H 33/042 446/91
8,371,894 B1 * 2/2013 Rosen ..... A63H 33/086 446/102
8,517,789 B2 * 8/2013 Barber ..... A63H 33/042 446/128
8,651,913 B1 * 2/2014 Lin ..... A63H 33/042 446/91
8,753,164 B2 * 6/2014 Hansen ..... A63H 33/042 446/91
8,764,507 B2 * 7/2014 Lin ..... A63H 33/08 446/91
8,851,953 B2 * 10/2014 Oschuetz ..... A63H 33/042 446/124
8,864,546 B1 * 10/2014 Capriola ..... A63H 33/042 331/3
D725,199 S 3/2015 Jensen
9,320,980 B2 * 4/2016 Schweikardt ..... A63H 33/046
9,419,378 B2 * 8/2016 Bdeir ..... H01R 13/6205
9,597,607 B2 * 3/2017 Bdeir ..... H01R 13/6205
9,682,479 B2 * 6/2017 Lin ..... B25J 9/08
9,748,689 B1 * 8/2017 Kim ..... H01R 11/30
9,755,357 B1 * 9/2017 Kim ..... H01R 13/6205
10,047,940 B2 * 8/2018 Grunzweig ..... F21S 2/00
10,252,176 B1 * 4/2019 Cecchin ..... A63H 33/042
10,376,804 B2 * 8/2019 Lu ..... F21V 23/001
2003/0038607 A1 * 2/2003 Yim ..... B25J 9/08 318/568.11
2006/0134978 A1 * 6/2006 Rosen ..... A63H 33/042 439/581
2011/0263177 A1 * 10/2011 Lemchen ..... A63H 33/04 446/87
2012/0032393 A1 2/2012 Leicht
2012/0122059 A1 * 5/2012 Schweikardt ..... G09B 23/00 434/118
2012/0329359 A1 * 12/2012 Capriola ..... A63H 33/042 446/91
2013/0183882 A1 * 7/2013 Oschuetz ..... A63H 33/042 446/90
2015/0251104 A1 * 9/2015 Lange ..... A63H 33/042 446/92
2015/0258463 A1 * 9/2015 Park ..... A63H 33/102 446/124

* cited by examiner

ROTATE 15

ROTATE 280

CONNECTING STRUCTURES IN A MODULAR CONSTRUCTION KIT

CROSS-REFERENCE TO RELATED APPLICATIONS

The present application claims benefit of priority with U.S. Provisional Application No. 62/164,494, filed May 20, 2015, which is hereby incorporated by reference.

TECHNICAL FIELD

The claimed invention relates to construction kits and educational toys, and more particularly to modular construction kits with electrical and programmable components.

BACKGROUND

Currently available educational robotic construction kits include numerous modules (or pieces), where the modules may have integrated electrical and data links with other modules. By connecting the modules together, people may construct toy robots and program them using specific software. However, these modules are of different forms and shapes, and are often complicated to learn and to construct. Many modules are also small and may be hazardous to younger children. The currently available educational robotic construction kits are thus geared more towards high school or college level students.

The modular elements of the construction kits usually have specific functions and therefore limit the functionality of robots and other assembled constructions. In addition, current modules in robotic construction kits are normally put together utilizing complex and unreliable magnetic or mechanical connectors.

It is therefore desirable to provide a modular robotics construction kit, with electrical and programmable components, that is simple to learn and construct, and that provides advantages heretofore unknown in the art.

SUMMARY OF THE INVENTION

Provided herein are embodiments of a modular construction kit. A modular construction kit includes modular construction blocks, each includes at least one interface face. The interface face includes a recess, a plurality of connection apertures disposed proximate to the edge of the recess, and a circular interface receptacle disposed in the center of the recess. The kit also includes modular construction connectors, each includes two opposite sides, wherein each side including a body, a plurality of connection studs extending outwardly from the body, and a protrusion extending outwardly from the body. Some modular construction blocks include predetermined functions. A modular system block includes at least a processor, storage, and wireless communication.

In some embodiments, a programming user interface is provided to create a program that may be uploaded to a construction of a modular construction kit and that may cause the modular construction kit to operate autonomously.

In some embodiments, a user-definable control user interface provides interfaces for a user to control a construction of the modular construction kit.

BRIEF DESCRIPTION OF THE SEVERAL VIEWS OF THE DRAWINGS

Illustrated in the accompanying drawing(s) is at least one of the best mode embodiments of the present invention. In such drawing(s).

DETAILED DESCRIPTION OF THE PREFERRED EMBODIMENTS

Figure 1:
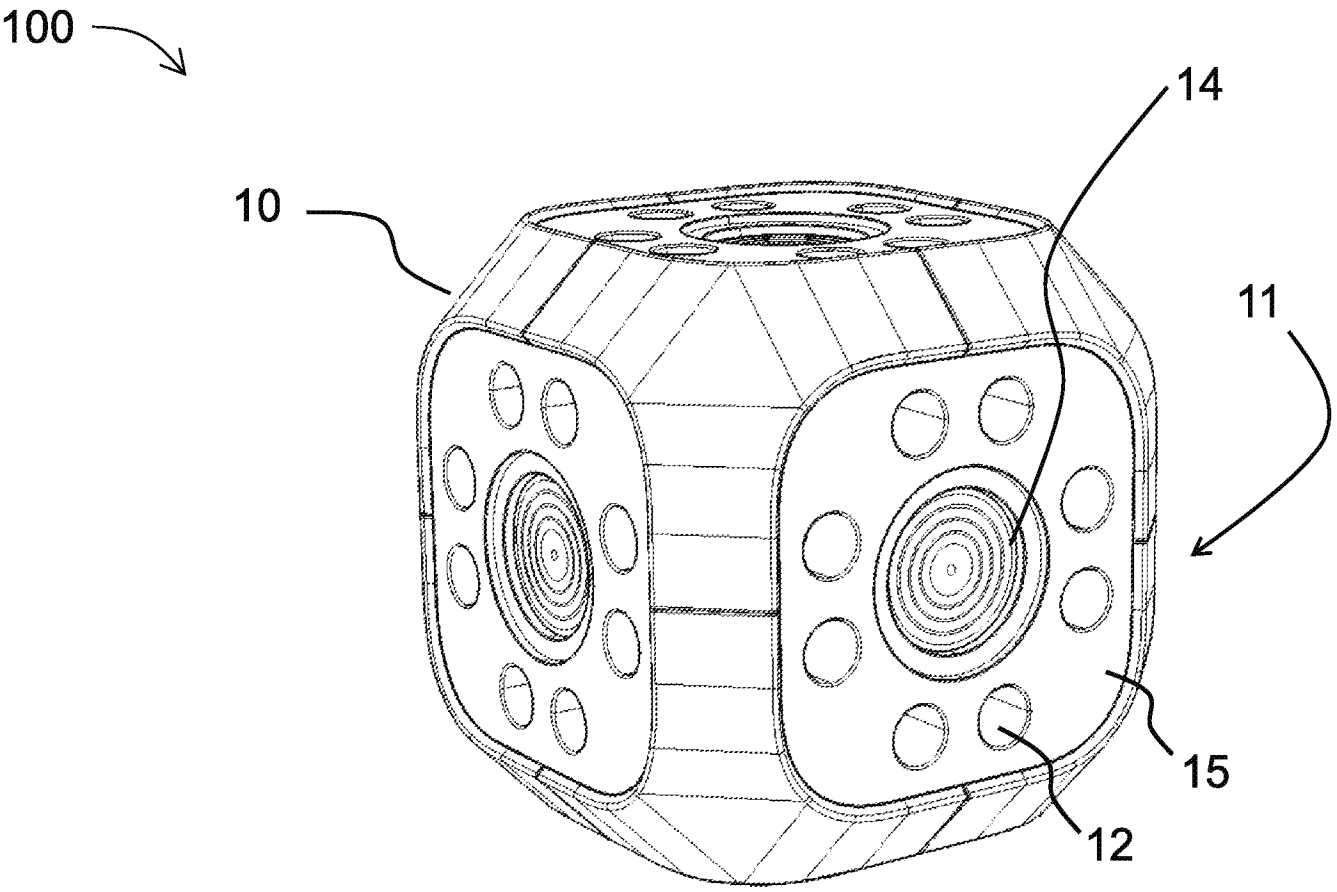
FIG. 1 illustrates a perspective view of a modular cube according to an embodiment of the present invention.

The below described drawing figures illustrate the described apparatus and its method of use in at least one of its preferred, best mode embodiment, which is further defined in detail in the following description. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present invention and its method of use.

In the following description and in the figures, like elements are identified with like reference numerals. The use of "e.g.," "etc," and "or" indicates non-exclusive alternatives without limitation, unless otherwise noted. The use of "including" or "includes" means "including, but not limited to," or "includes, but not limited to," unless otherwise noted.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

Turning to the drawings, FIGS. 1-24 illustrate exemplary embodiments of a modular construction kit 100. Generally, the modular construction kit 100 includes modular blocks (or cubes). At least one face (or side) or the cube may be connected to another cube. One or more other faces may include one or more elements that provide one or more specific functions. These functions may include, for example, a light emitting diode (LED) display, an e-ink display, an infrared sensor, a laser pointer, a light sensor, a meteorology sensor, a camera, a motor or servomotor with or without external shafts or studs for attaching a construction element, and so on. The modular construction kit 100 may also include special cubes that provide one or more specific functions without requiring a different, or special face. Some cubes may include a main processor, storage, a wireless communication module, and the like. The modular construction kit 100 may further include construction elements such as connectors, wheels, adapters for third-party kit, and the like. These and other elements of the modular construction kit 100 will be described in more detail herein.

It should be noted that although the exemplary embodiments of some modular blocks of the modular construction kit 100 may be in the shape of a cube, the blocks may also be in another shape. Therefore, although the description herein refers to cubes, it should be understood by a person of ordinary skill in the art that the blocks may be in another shape.

FIG. 1 illustrates a perspective view of an exemplary embodiment of a modular cube 10 of the modular construction kit 100. In some embodiments, the cube 10 may resemble a square cube, having cropped edges and corners. Although illustrated with three identical faces 11, a cube 10 may only have one connection face 11. A cube 10 may also have all identical faces 11. The connection face 11 may include a recess 15 disposed in the center of interface face 11. The recess 15 may include eight circular connection apertures 12 disposed proximate to the edge of the recess 15, with two connection apertures 12 disposed at each side of the four sides of the recess 15. The connection apertures 12 are sized to receive tubular (or cylindrical) connection studs 52 of the connector 50, which will be described in more detail herein. The connection studs 52 may fit into the connection apertures without leaving a gap. The recess 15 may also include a inwardly concave circular interface receptacle 14 disposed in the center of the recess 15. The center interface receptacle 14 is sized to receive a protrusion 54 of a connector 50 which will be described in more detail in FIG. 2. The protrusion 54 may fit into the center interface receptacle 14 without leaving a gap. The interface receptacle 14 may include a plurality of disjoint circular concentric connection interfaces. The circular connection interfaces provide interfaces at least for, for example, communication data, communication clock, power supply, power supply ground, and positioning and orientation detection. The circular positioning and orientation detection interface may be divided into four segments to allow for the detection of a rotation of a cube, for example, another cube 10, connected to the cube 10. The positioning and orientation detection interface may also detect which cube, or cube type, is being connected to the cube 10 at the connection face 11. When the cube 10 has more than one connection face 11, and each connection face 11 has a cube connected thereto, the positioning and orientation detection interface at each connection face 11 may detect which cube, or cube type, is being connected. As a result, the current configuration or construction of the modular construction kit 100 is known. The current configuration may be communicated to an external application as will be described in more detail herein.

Although the connection apertures 12 are described as being circular, in some embodiments, they may be in another shape. In these embodiments, the connection studs 52 may also be in the corresponding shape so as to fit into the connection apertures 12.

Figure 2:
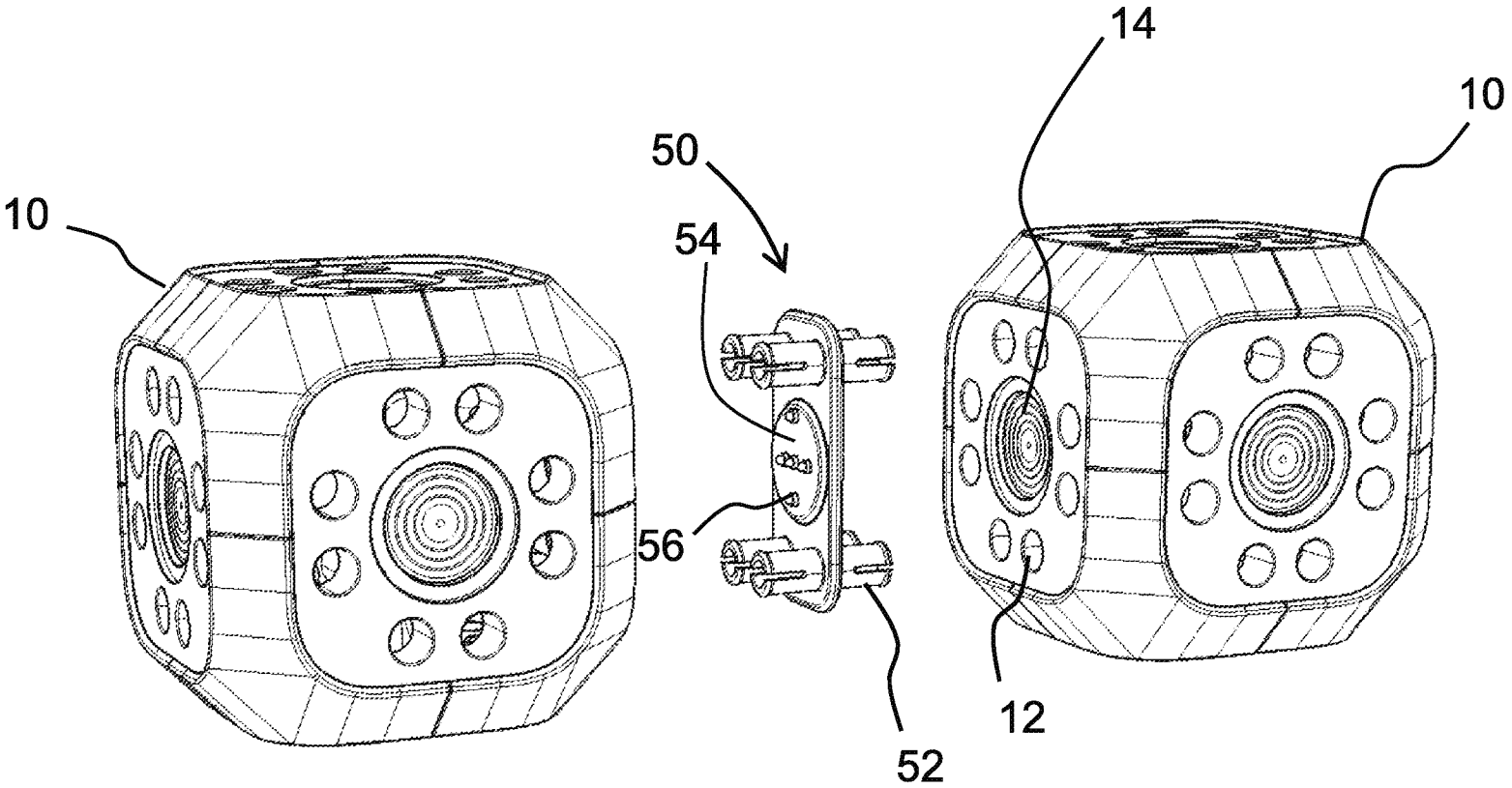
FIG. 2 illustrates a perspective view of two cubes and a connector according to an embodiment of the present invention.
Figure 3:
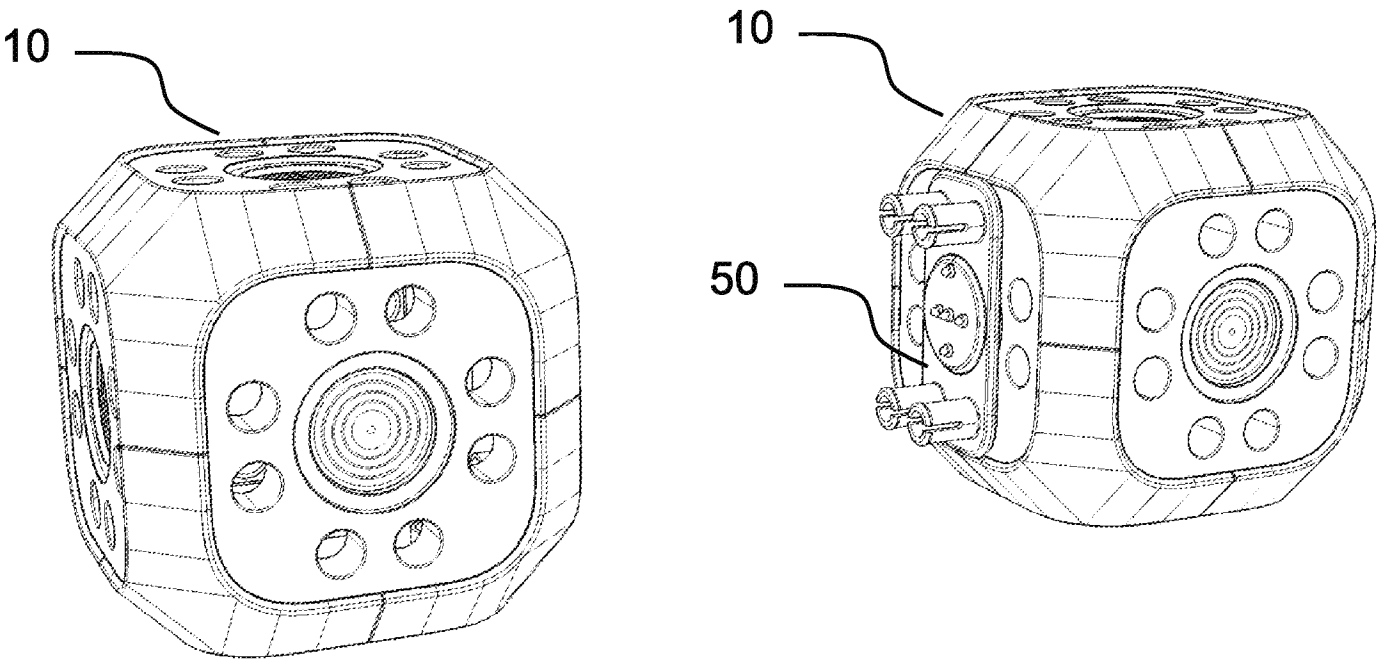
FIG. 3 illustrates another perspective view of two cubes and a connector according to an embodiment of the present invention.

The cube 10 may include electrical and/or electronic elements (not shown) disposed inside the cube 10. For example, the cube 10 may include a printed circuit board (PCB) which includes connection to the plurality of circular connection interfaces of the interface receptacle 14. When the cube 10 has more than one connection face 11, the PCB provides connection to and among the plurality of circular connection interfaces of each interface receptacle 14 of each connection face 11. As a result, when two or more cubes 10 are connected, as illustrated in FIGS. 2 and 3, connectivity between and among the cubes are provided. In some embodiments, a face or side PCB is provided for each connection face 11. In these embodiments, the face PCBs are connected, for example, to a main PCB, to provide connectivity between and among the connection faces 11 of the cube 10. The face or side PCB may be disposed adjacent to the inside of the face of the cube 10, and may be in a circular shape.

FIGS. 2 and 3 illustrate an exemplary embodiment of a perspective view of two cubes 10 and a connector 50 of the modular construction kit 100. Two cubes 10 may be connected together using a connector 50. The connector 50 may include a flat body 51 on each side of the connector 50, four tubular (or cylindrical) connection studs 52 extending outwardly from the flat body 51, and a circular protrusion 54 extending outwardly from the flat body 51 on each side of the connector 50. One or more spring-loaded interface pins 56 may be disposed on the protrusion 54. The connector 50 may include a printed circuit board (not shown) disposed inside the connector 50, in between the two opposite flat bodies 51. The printed circuit board (PCB) provides connections to the spring-loaded pins 56 on each side of the connector 50. As a result, the PCB provides connectivity between each corresponding pin 56 on each opposite protrusion 54 of the connector 50.

When the connector 50 is used to couple two cubes together, the connection studs 52 on opposite side of the connector 50 are inserted into the connection apertures 12 of each cube. When the connection studs 52 are fully inserted into the connection apertures 12, as illustrated in FIG. 3, the protrusion 54 are fitted into the center interface receptacle 14 on the respective face 11 of each cube. Each interface pin 56 on each protrusion 54 is coupled to, and provides a connection to a corresponding circular connection interface of the interface receptacle 14. As a result, connectivity, for example, power and communication, between the two cubes are provided through the pins 56 and the corresponding connection interfaces of the interface receptacle 14.

Figure 4:
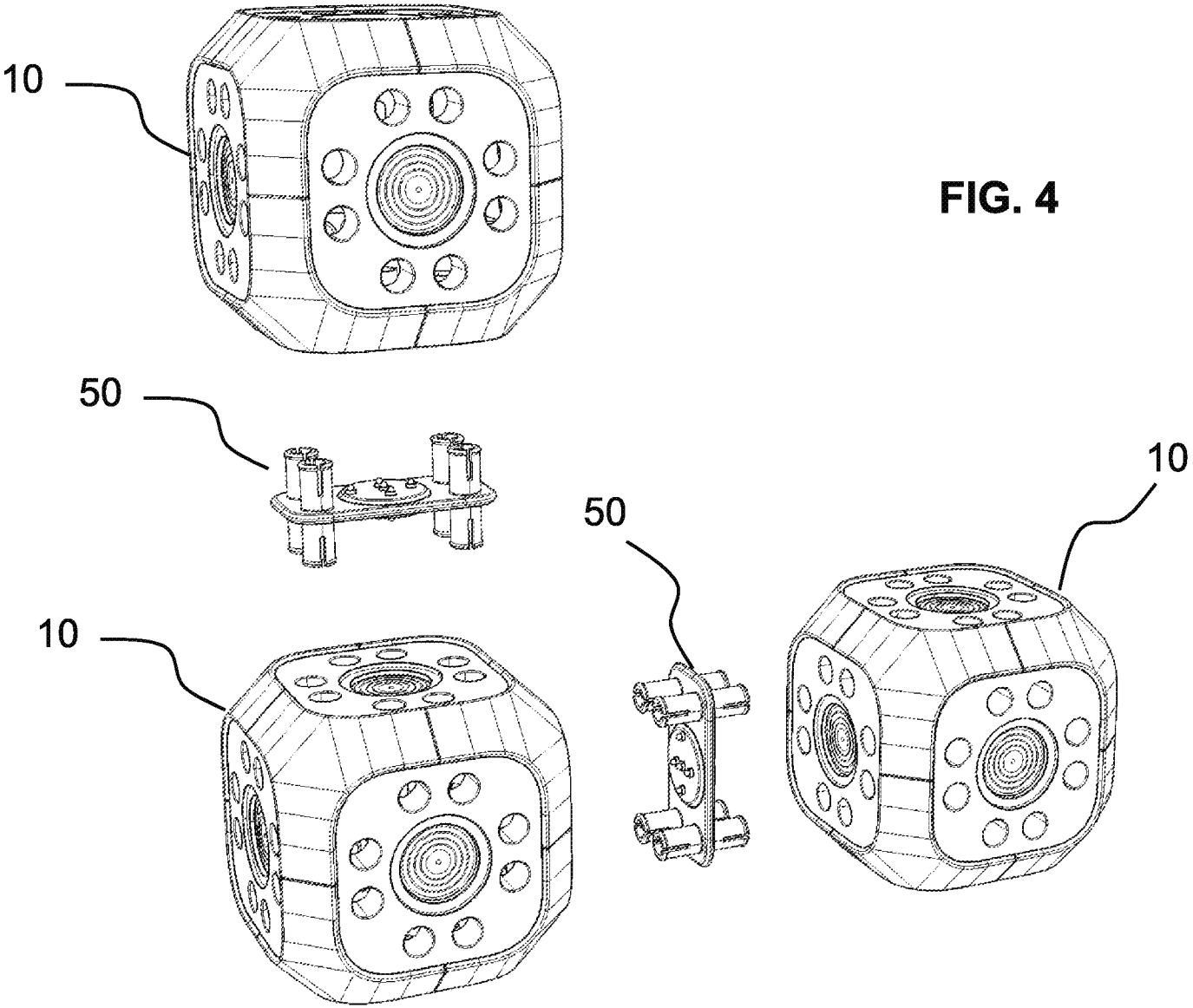
FIG. 4 illustrates a perspective view of three cubes and two connectors according to an embodiment of the present invention.

As illustrated in FIG. 4, using a plurality of connectors 50, a plurality of cubes may be connected into different configurations or constructions.

As described herein, the connector 50 may also be used to connect different types of cubes of the modular construction kit 100. Each type of cube of the modular construction kit 100 may include at least one connection face 11 used for connecting with a connector 50. As a result, connectivity, for example, power and communication, between different types of cubes may be provided using the connector 50. Connectivity between cube components may follow standards and protocols known in the art, for example, 12C protocol.

In some embodiments, the interface receptacle 14 includes five circular connection interfaces, and the protrusion 54 includes five corresponding pins 56. The five connection interfaces include interfaces for communication data, communication clock, power supply, power supply ground, and positioning and orientation detection. More or less connection interfaces and corresponding pins are also contemplated.

Figure 2A:
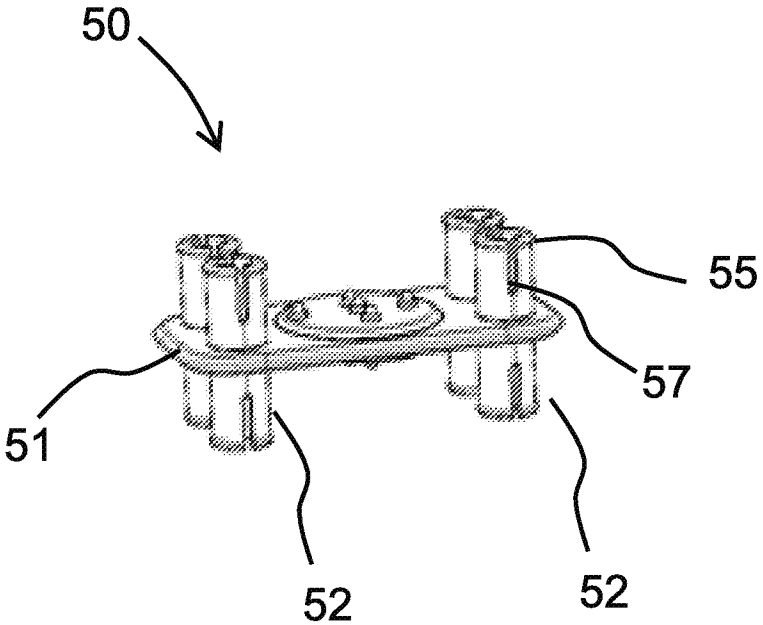
FIG. 2A illustrates a perspective view of a connector according to an embodiment of the present invention.

Referring back to FIG. 2A, an exemplary embodiment of a connector 50 of the modular construction kit 100 is illustrated. In some embodiments, the connection stud 52 may include a flange 55 at the distal end away from the flat body 51 of the connector 50. The flange 55 operates to catch on to the inside edge of the corresponding connection aperture 12 when the connection stud 52 is inserted into the connection aperture 12. The stud 52 may also include two or more slits 57 parallel to the axis of the connection stud 52, beginning at the distal end of the stud 52. The slits 57 operate to allow the connection stud 52 to be flexible, for example, the distal end of the stud 52 may be squeezed together during the insertion of the stud 52 into a connection aperture 12. In some embodiments, the connection stud 52 may also include a plurality of protrusions (not shown) disposed on the outside surface of the connection stud 52. The protrusions may provide better friction between the stud 52 and the wall of the connection aperture 12. It is noted that although the exemplary connector 50 includes fours studs 52, the connector 50 may include less than or more than four studs.

Figure 5:
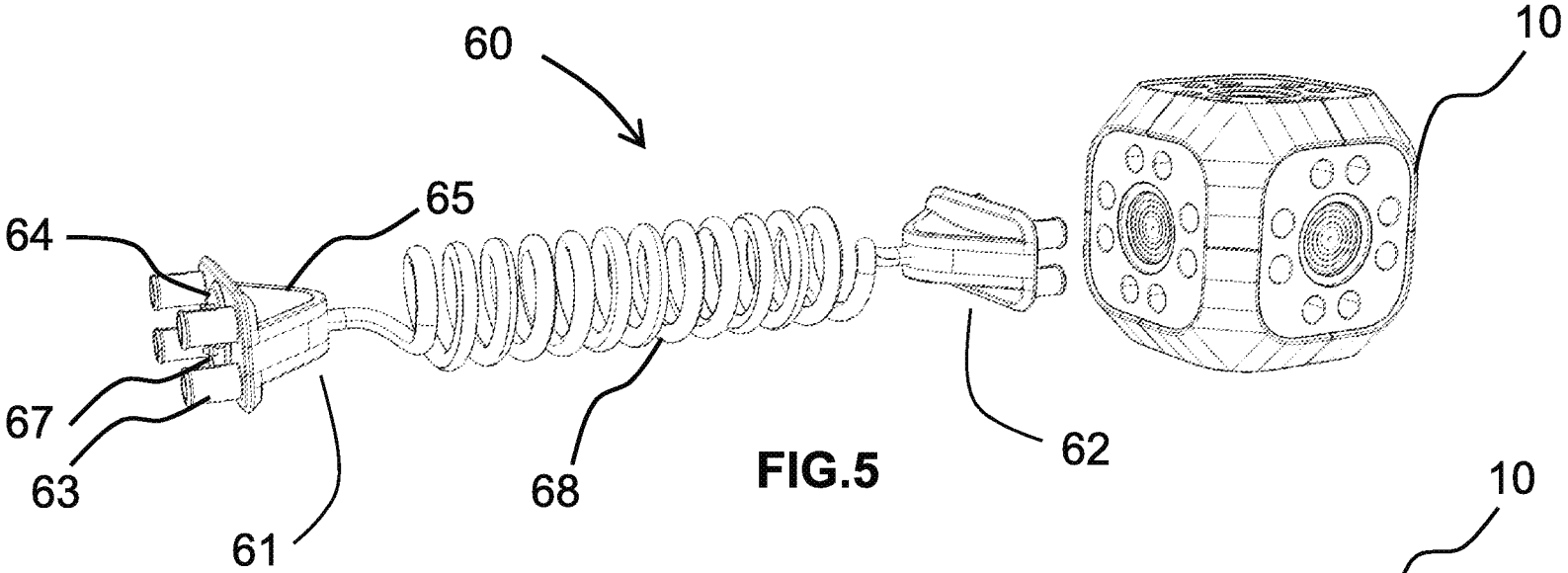
FIG. 5 illustrates a perspective view of a cube and a wire connector according to an embodiment of the present invention.
Figure 6:
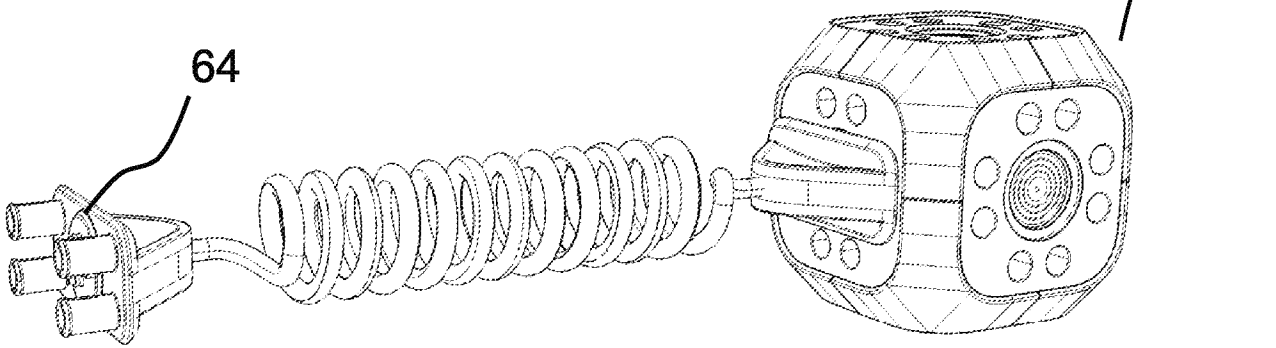
FIG. 6 illustrates another perspective view of a cube and a wire connector according to an embodiment of the present invention.

Referring to FIGS. 5 and 6, an exemplary embodiment of a wire connector 60 of the modular construction kit 100 is illustrated. As with the connector 50, the wire connector 60 may be used to connect two cubes of the modular construction kit 100, where each cube has at least one connection face 11. In some embodiments, the wire connector 60 may include to opposite end connectors 61 and 62. The end connectors 61 and 62 may be coupled together by connection wire 68. The end connectors 61 and 62 include elements similar to those of connector 50 as described herein. For example, each end connector 61 and 62 may include four connection studs 63 which are similar to connection studs 52 of connector 50. However, each end connector 61 and 62 may include only one outward facing protrusion 64 which is similar to protrusion 54 of connector 50, having spring-loaded pins 67. As with protrusion 54, when the connection studs 63 are fully inserted into the connection apertures 12 of a cube, the protrusion 64 are fitted into the center interface receptacle 14 on the respective connection face 11 of that cube. Each end connector 61 and 62 may include an inward facing bridge 65 which connects to the connection wire 68. The end connectors 61 and 62 may also include internal PCB which provides connectivity between the pins 67 and the connection wire 68.

In some embodiments, the modular construction kit 100 may include special cubes, for example, cubes that provide switch (e.g., on/off button), speaker, battery, storage, processor, wireless communications, light emitting diode (LED) display, e-ink display, infrared sensor, infrared blaster and receiver, ultrasonic sensor, laser pointer, light sensor, meteorology sensor, humidity sensor, temperature sensor, pressure sensor, camera, microphone, motor or servomotor with or without external shafts or studs for attaching a construction element, line following, fingerprint sensor and reader, GPS, and so on. The modular construction kit 100 may include construction elements such as wheels in various types and sizes, gripper, and so on. Some of the exemplary special cubes are illustrated in FIGS. 7 to 24.

Figure 7:
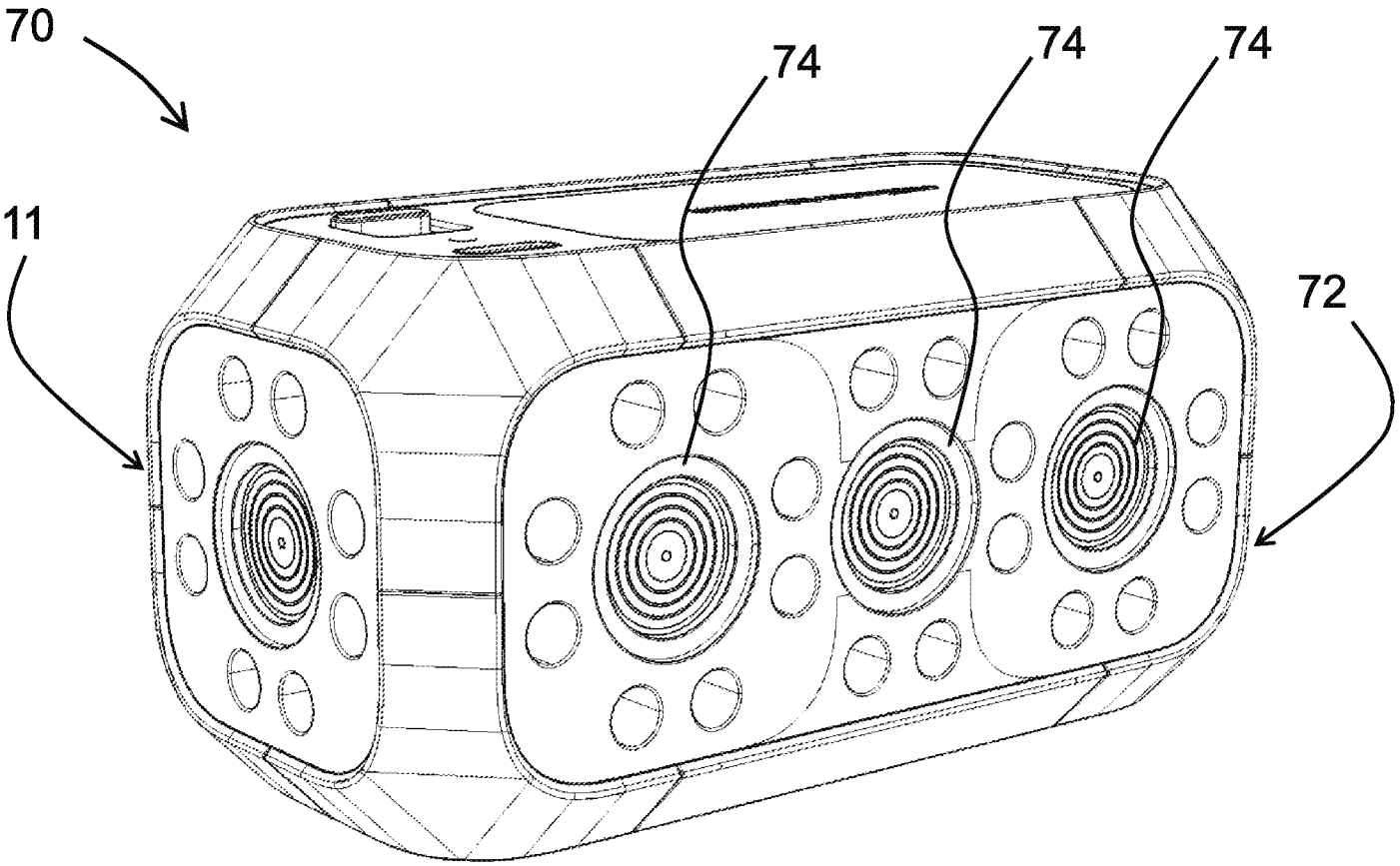
FIG. 7 illustrates a perspective view of a system cube according to an embodiment of the present invention.

FIG. 7 illustrates a perspective view of an exemplary embodiment of a system cube 70. In some embodiments of the modular construction kit 100, the system cube 70 may resemble a rectangular cube, having cropped edges and corners. The system cube 70 may include at least one connection face 11 similar to connection face 11 of the cube 10. The system cube 70 may also include at least one connection face 72. In some embodiments, the connection face 72 may have at least three interfaces 74 which are similar to the center interface receptacle 14 of the cube 10. The system cube 70 may have a PCB (not shown) positioned inside the system cube 70 to provide connectivity to the plurality of circular concentric connection interfaces of the interfaces 74. In some embodiments, the system cube 70 may include at least a processor, speaker(s), battery, storage, wireless communication elements, and an accelerometer. The system cube 70 may also include at least one universal serial bus (USB) or micro USB port, or other connector, suitable for connection with an external device. Wireless communication supported by the system cube 70 may include WiFi, Bluetooth, Radio Frequency (RF), or any suitable wireless communication technology known in the art. The storage may store system and application software as described herein. The system cube may also include a power connection port, a battery charging port, an on/off switch, and so on.

The processor executes the system and application software, and may control the functions, operations, and movements of the modular construction kit 100, by communicating with and controlling the various cubes present in the configuration or construction. For example, the processor may control the movement of a motor cube or a servomotor cube, an LED matrix of an LED cube, and so on.

Figure 8:
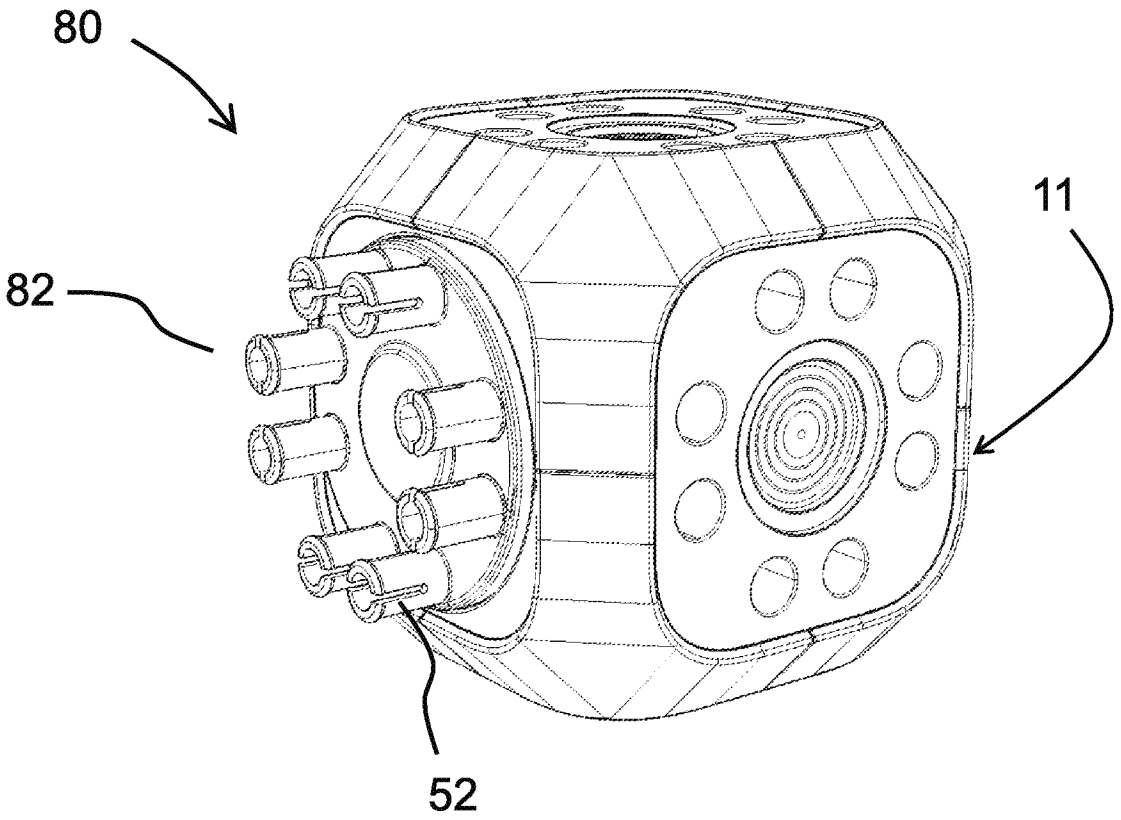
FIG. 8 illustrates a perspective view of a motor cube according to an embodiment of the present invention.
Figure 9:
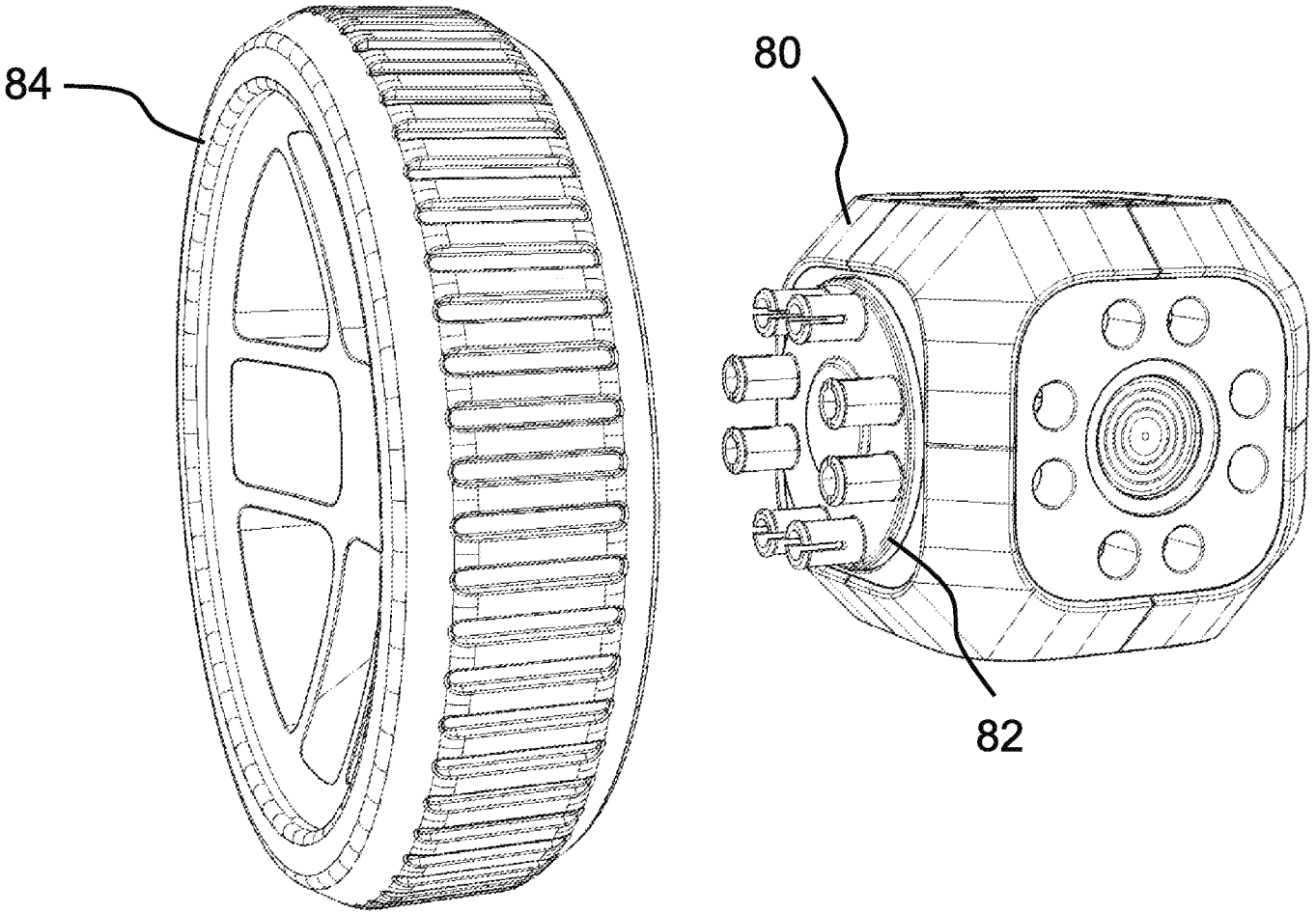
FIG. 9 illustrates a perspective view of a motor cube and an external wheel according to an embodiment of the present invention.
Figure 10:
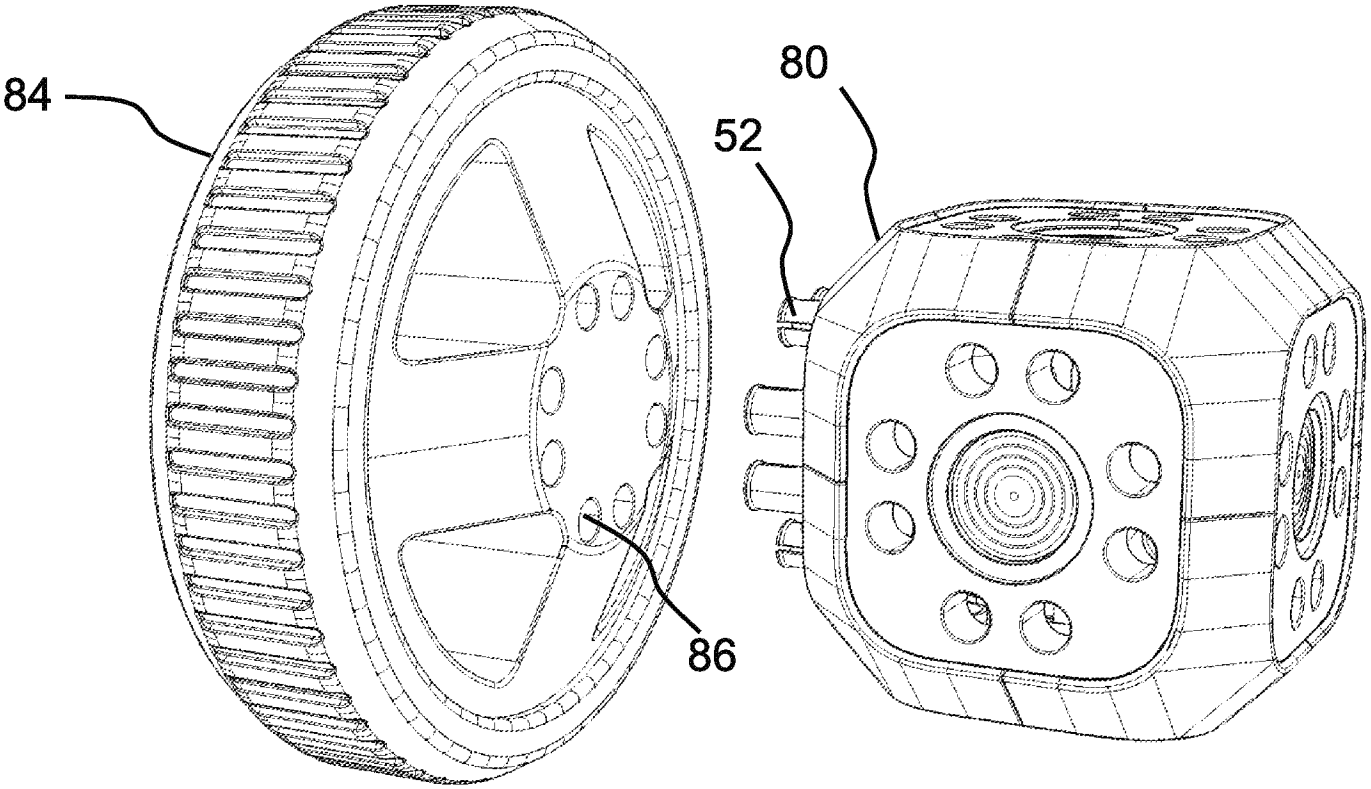
FIG. 10 illustrates another perspective view of a motor cube and an external wheel according to an embodiment of the present invention.

FIG. 8 illustrates a perspective view of an exemplary embodiment of a motor cube 80 of the modular construction kit 100. In some embodiments, the motor cube 80 may resemble a square cube, having cropped edges and corners. The motor cube 80 may include at least one connection face 11 similar to connection face 11 of the cube 10. The motor cube 80 may include a wheel 82 rotatably attached to a face of the motor cube 80. The wheel 82 may include eight connection studs 52 similar to connection studs 52 of the connector 50. The connection studs 52 may be used to attach an external wheel 84 to the motor cube 80, as illustrated in FIGS. 9 and 10. The connection studs 52 of the wheel 82 may be inserted into connection apertures 86 of the external wheel 84. In some embodiments, the motor cube 80 includes a motor (not shown), for example, a DC motor known in the art, disposed internal to the motor cube 80. As described herein, the motor of the motor cube 80 may be controlled by a system cube 70 when both are part of a configuration or construction of the modular construction kit 100. For example, the motor may start or stop rotating the wheel 82 clockwise or counterclockwise, at different speeds. As a result, an external wheel 84 attached to the wheel 82 will be correspondingly rotated. The wheel 82 may also be attached to another cube of the modular construction kit 100. Although illustrated with eight connections studs 52, the wheel 82 may include less than eight connection studs 52.

Figure 11:
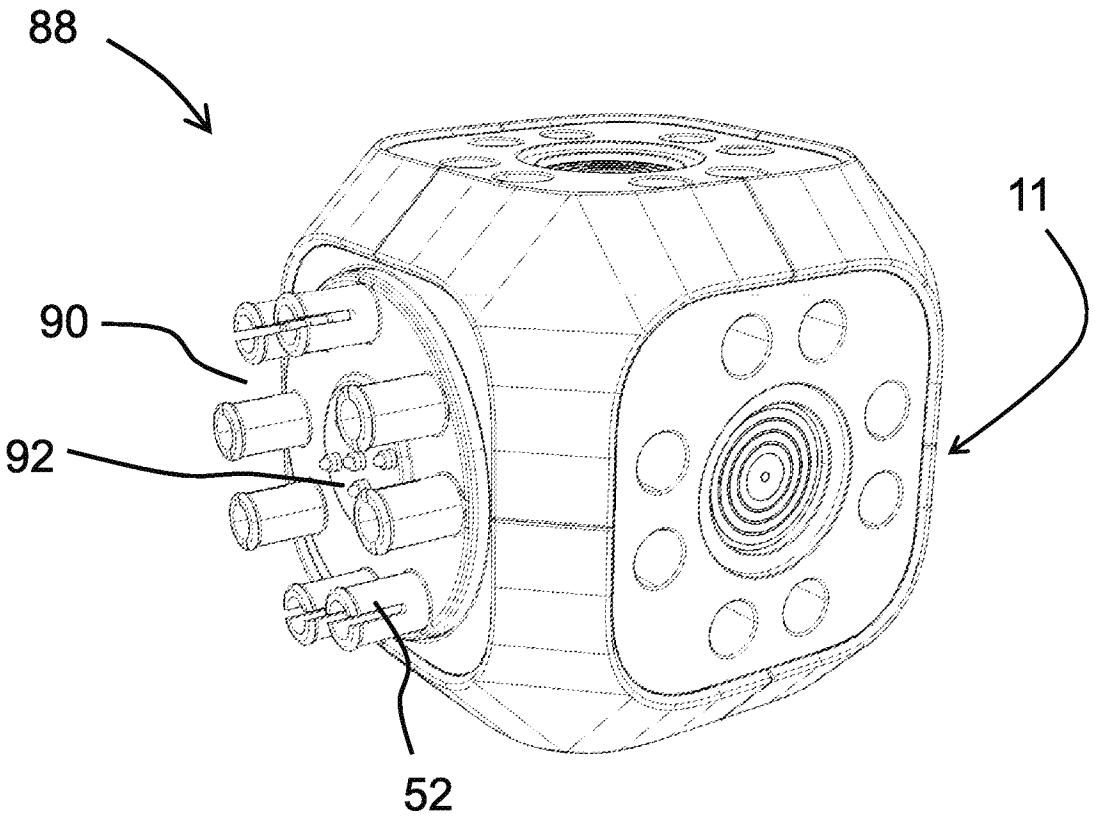
FIG. 11 illustrates a perspective view of a servomotor cube according to an embodiment of the present invention.
Figure 14:
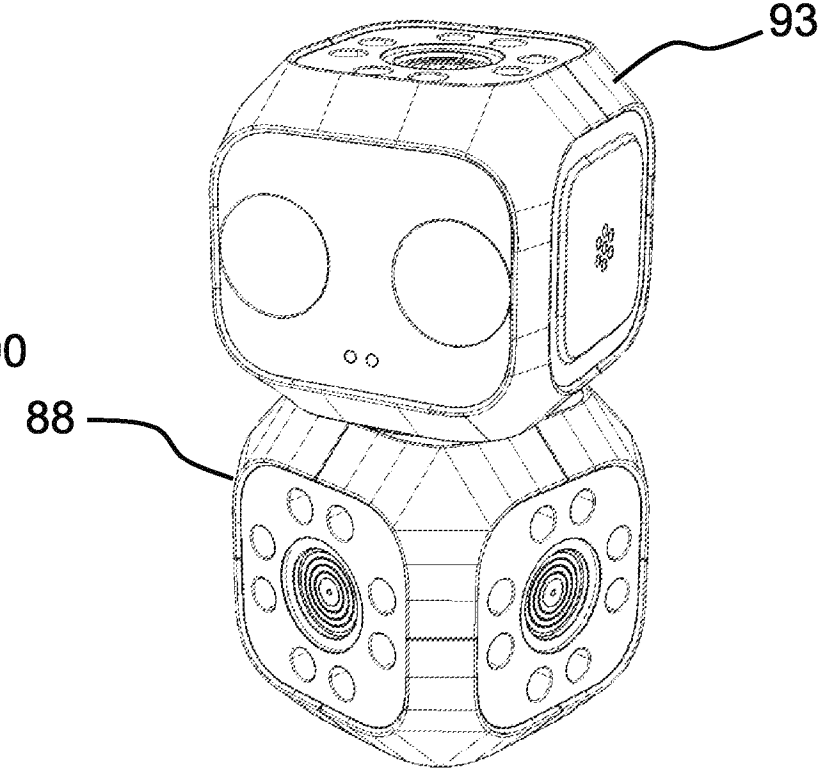
FIG. 14 illustrates another perspective view of a servomotor cube and a robot head cube according to an embodiment of the present invention.
Figure 13:
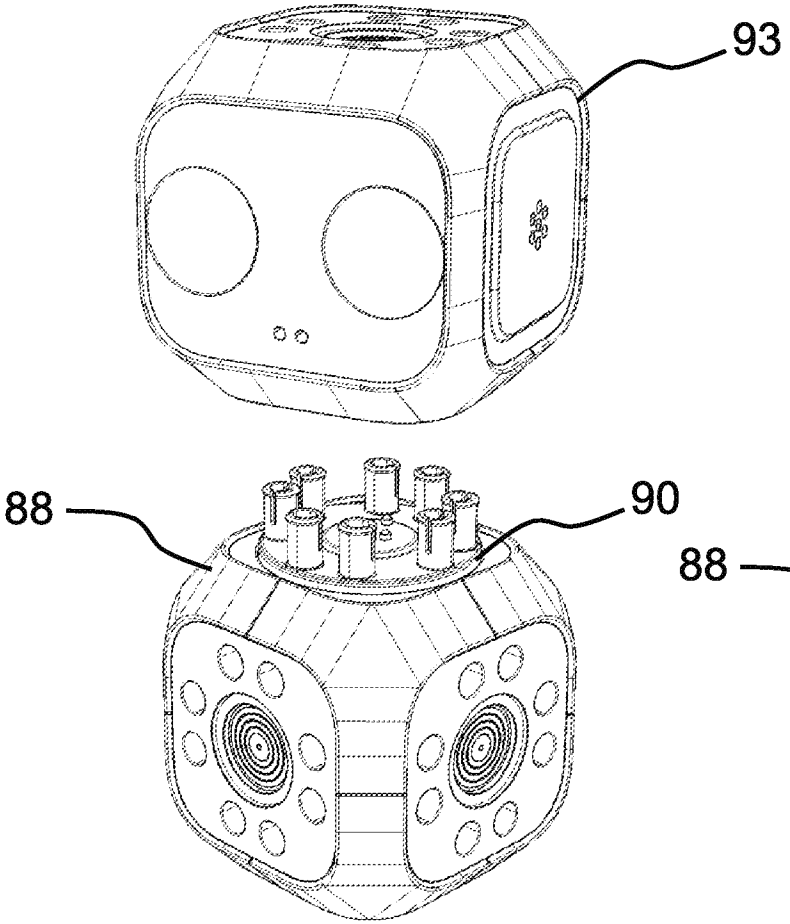
FIG. 13 illustrates a perspective view of a servomotor cube and a robot head cube according to an embodiment of the present invention.

FIG. 11 illustrates a perspective view of an exemplary embodiment of a servomotor cube 88 of the modular construction kit 100. In some embodiments, the servomotor cube 88 may resemble a square cube, having cropped edges and corners. The servomotor cube 88 may include at least one connection face 11 similar to connection face 11 of the cube 10. The servomotor cube 80 may include a wheel 90 rotatably attached to a face of the servomotor cube 88. The wheel 90 may include eight connection studs 52 similar to connection studs 52 of the connector 50. The connection studs 52 may be used to connect another cube of the modular construction kit 100 to the servomotor cube 88, as illustrated in FIGS. 13 and 14. The wheel 90 may include a protrusion 92 similar to the protrusion 54 of the connector 50. As with the protrusion 54, the protrusion 92 may include one or more spring-loaded pins disposed on the protrusion 92 for receiving and sending signals from the connected cube. In some embodiments, the servomotor cube 88 includes a servomotor (not shown), for example, a servomotor known in the art, disposed internal to the servomotor cube 88. As described herein, the servomotor of the servomotor cube 88 may be controlled by a system cube 70 when both are part of a configuration or construction of the modular construction kit 100. For example, the servomotor may start or stop rotating the wheel 90 clockwise or counterclockwise, at different speeds and distances. As a result, a cube connected to the wheel 90 will be correspondingly rotated.

Figure 12:
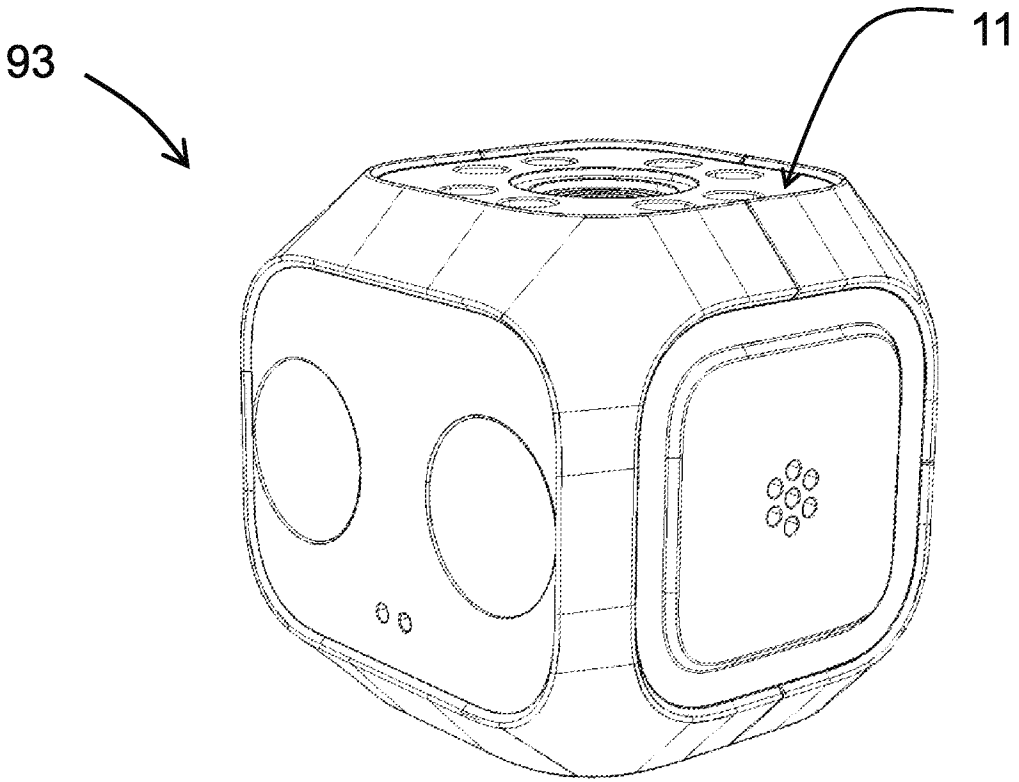
FIG. 12 illustrates a perspective view of a robot head cube according to an embodiment of the present invention.

FIG. 12 illustrates a perspective view of an exemplary embodiment of a robot head cube 93 of the modular construction kit 100. In some embodiments, the robot head cube 93 may resemble a square cube, having cropped edges and corners. The robot head cube 93 may include at least one connection face 11 similar to connection face 11 of the cube 10. In some embodiments, the robot head cube 93 may include a speaker and/or a microphone and/or ultrasonic distance sensor. In an exemplary configuration as illustrated in FIGS. 13 and 14, a robot head cube 93 may be connected to a servomotor cube 88. In this configuration, the servomotor cube 88 may be controlled, for example, by a system cube 70, to rotate the robot head cube 93.

Figure 15:
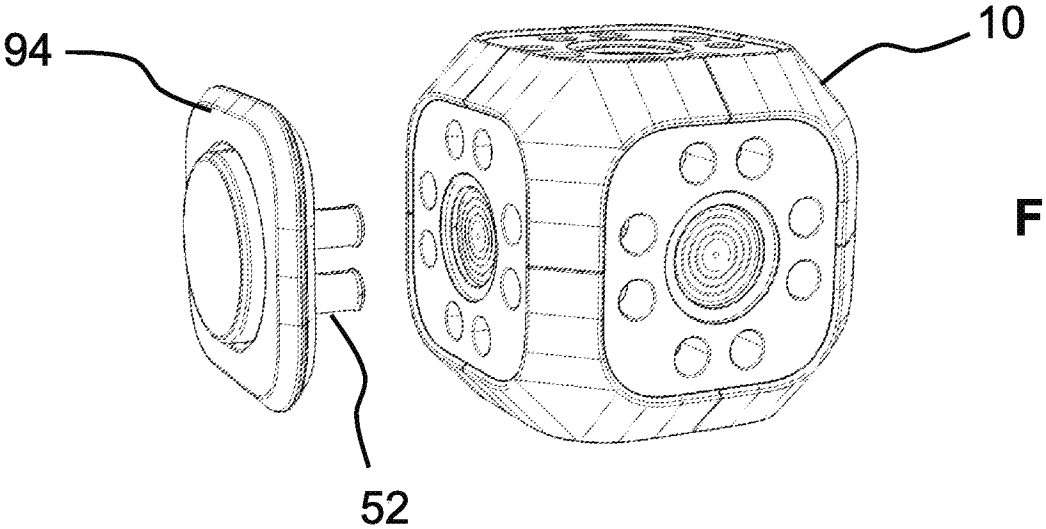
FIG. 15 illustrates a perspective view of a cube and an external button according to an embodiment of the present invention.
Figure 16:
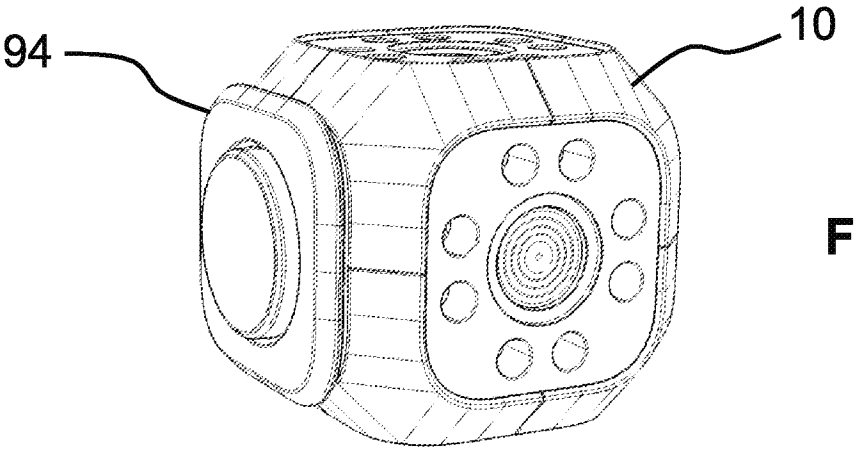
FIG. 16 illustrates another perspective view of a cube and an external button according to an embodiment of the present invention.

FIGS. 15 and 16 illustrate a perspective view of an exemplary embodiment of a button 94 of the modular construction kit 100. The button 94 may be used to send an on/off signal to, for example a system cube 70. The button 94 may include two or more connection studs 52 similar to the connection studs 52 of the connector 50, for connecting the button 94 to a connection face 11 of a cube of the modular construction kit 100. The button 94 may include a protrusion and spring-loaded pins (not shown) similar to the protrusion 54 of the connector 50.

Figure 17:
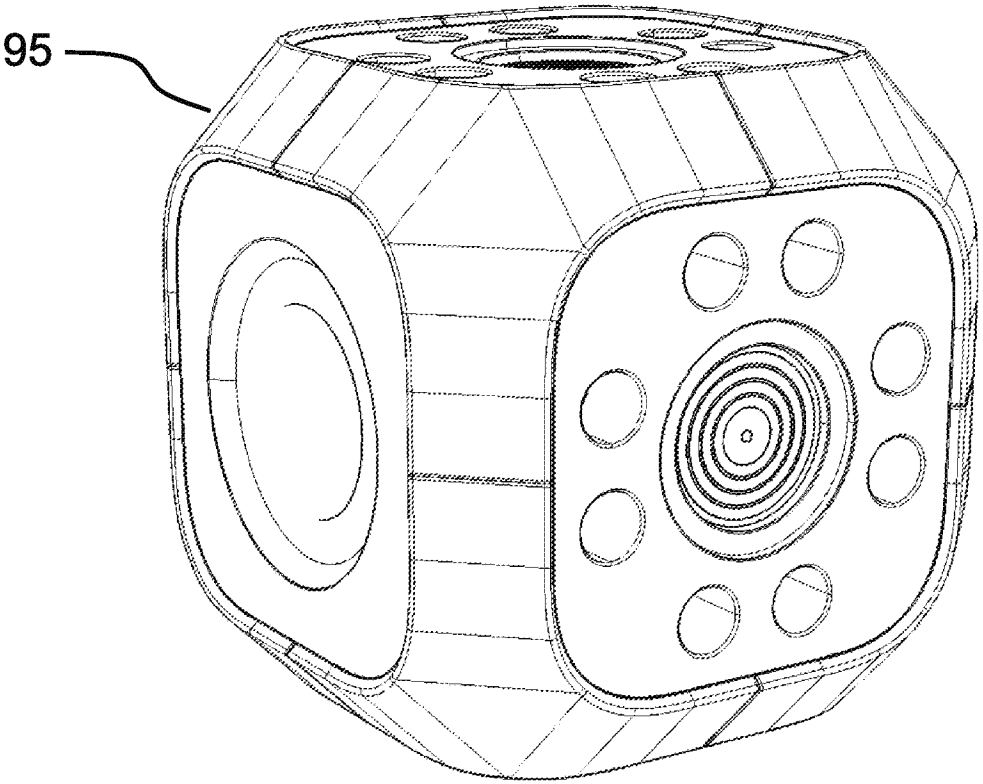
FIG. 17 illustrates a perspective view of a sensor cube according to an embodiment of the present invention.

FIG. 17 illustrates a perspective view of an exemplary embodiment of a sensor cube 95 of the modular construction kit 100. In some embodiments, the sensor cube 95 may resemble a square cube, having cropped edges and corners. The sensor cube 95 may include at least one connection face 11 similar to connection face 11 of the cube 10. The sensor cube 95 may include one or more sensors disposed on a face, or inside, of the sensor cube 95. The sensor cube 95 may be used to detect a condition its vicinity and send a signal to, for example, a system cube 70. For example, the sensor cube 95 may include a light sensor disposed on a face of the sensor cube 95. The light sensor may be used to detect environmental light in its vicinity and send a signal to a system cube 70. Sensor cubes may include design elements specific for their particular features. For example, a meteorology cube may include holes on one side.

Figure 18:
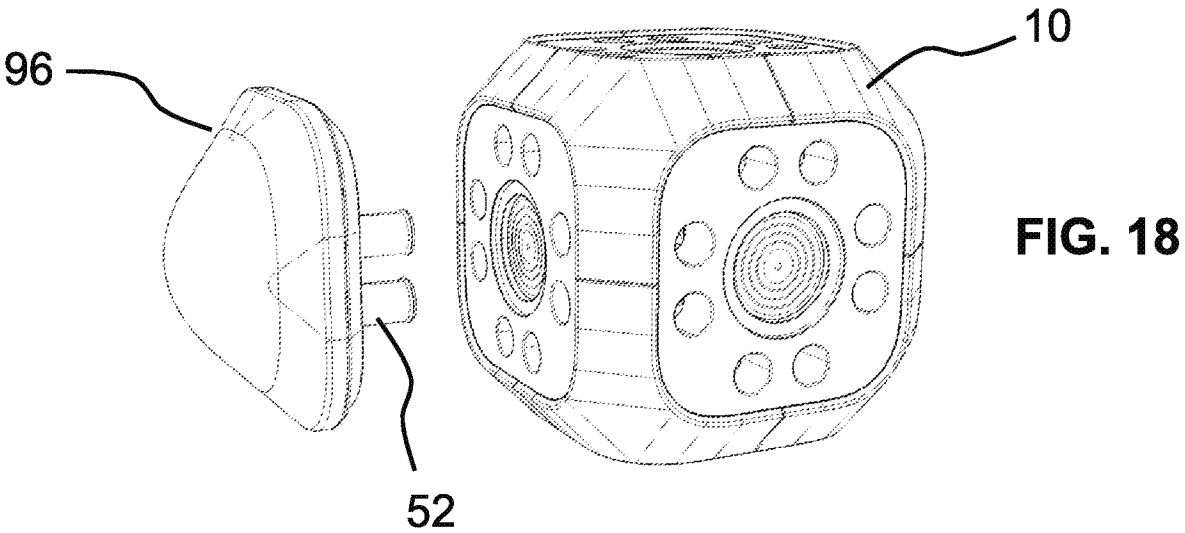
FIG. 18 illustrates a perspective view of a cube and an LED add-on according to an embodiment of the present invention.
Figure 19:
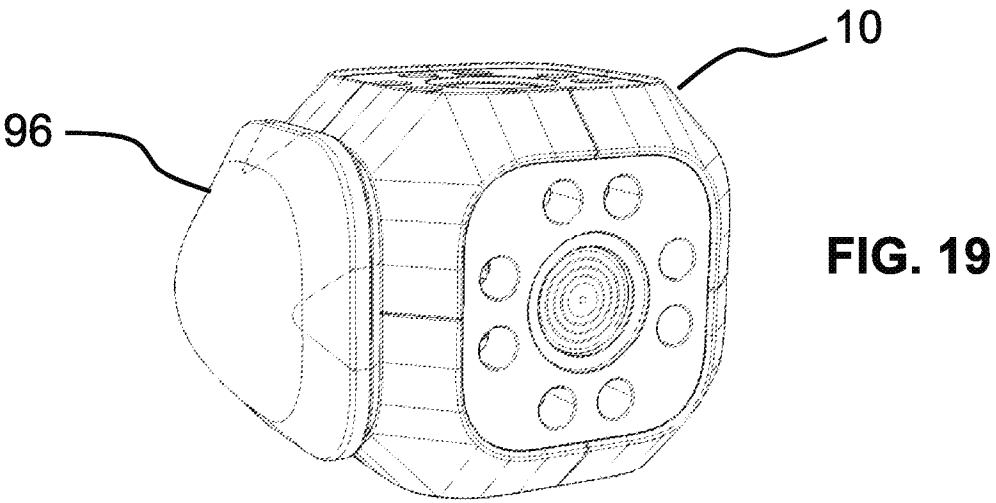
FIG. 19 illustrates another perspective view of a cube and an LED add-on according to an embodiment of the present invention.

FIGS. 18 and 19 illustrate a perspective view of an exemplary embodiment of an external LED add-on 96 of the modular construction kit 100. The LED add-on 96 may include two or more connection studs 52 similar to the connection studs 52 of the connector 50, for connecting the LED add-on 96 to a connection face 11 of a cube of the modular construction kit 100. The LED add-on 96 may include a protrusion and spring-loaded pins (not shown) similar to the protrusion 54 of the connector 50. Other add-on elements are also contemplated.

FIGS. 20(A-) illustrates exemplary embodiments of some special cubes of the modular construction kits 100. Each special cube may include design elements specific for its particular feature. FIG. 20A illustrates a perspective view of an exemplary embodiment of a meteorology cube 97 of the modular construction kit 100. In some embodiments, the meteorology cube 97 may resemble a square cube, having cropped edges and corners. The meteorology cube 97 may include at least one connection face 11 similar to connection face 11 of the cube 10. The meteorology cube 97 may include one or more meteorology sensors or readers disposed on a face, or inside, of the meteorology cube 97. The meteorology cube 97 may be used to detect one or more conditions, for example, humidity, pressure, and temperature, its vicinity and send and receive one or more signals to, for example, a system cube 70.

Figure 20A:
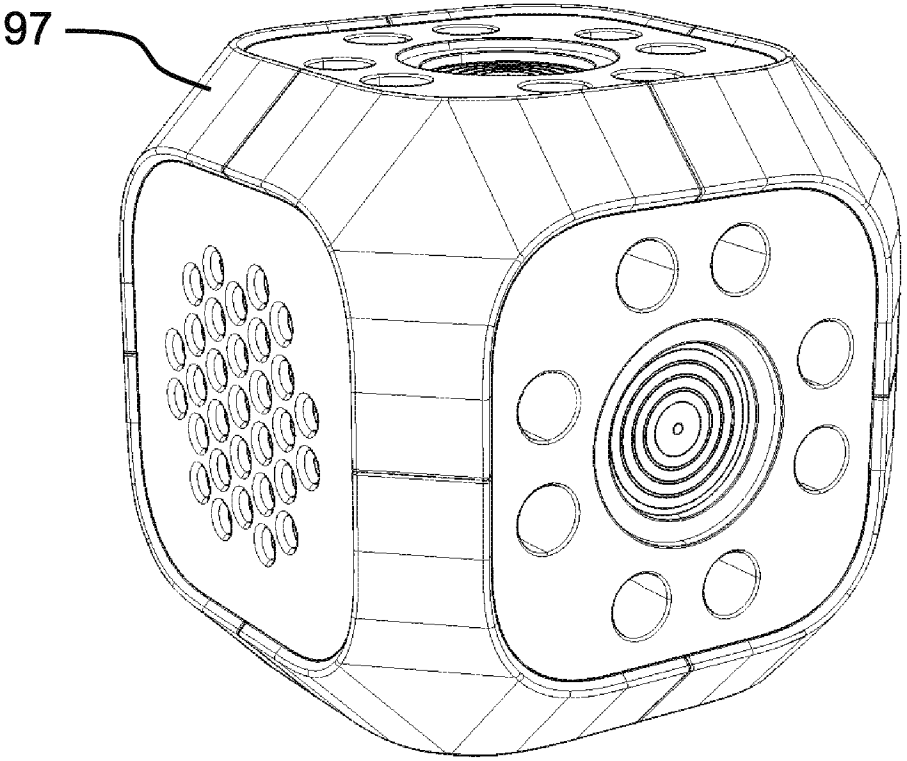
FIGS. 20A to 20H illustrate exemplary special cubes according to an embodiment of the present invention.
Figure 20B:
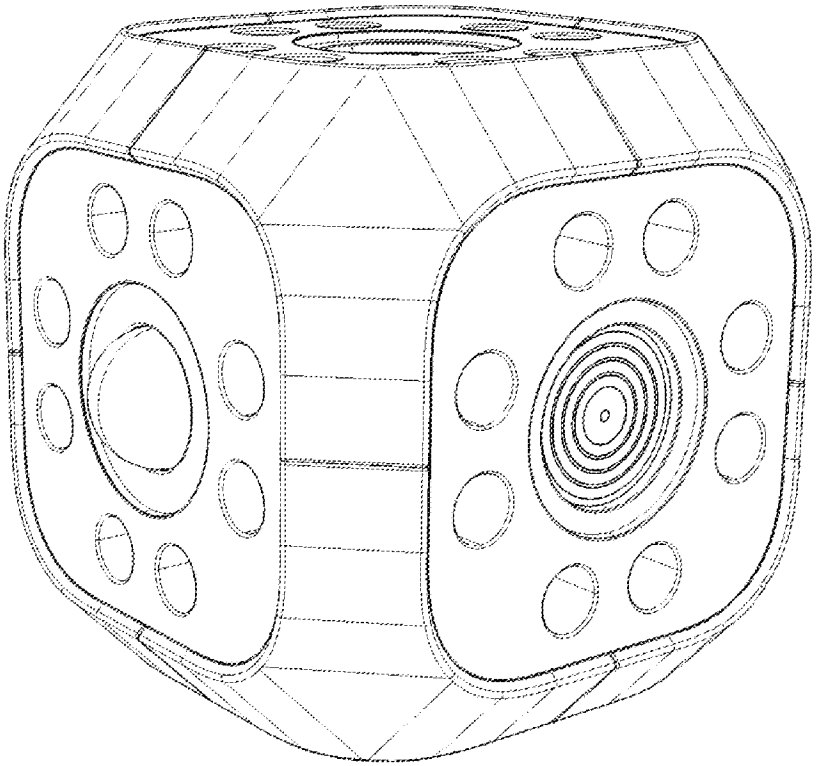
Figure 20C:
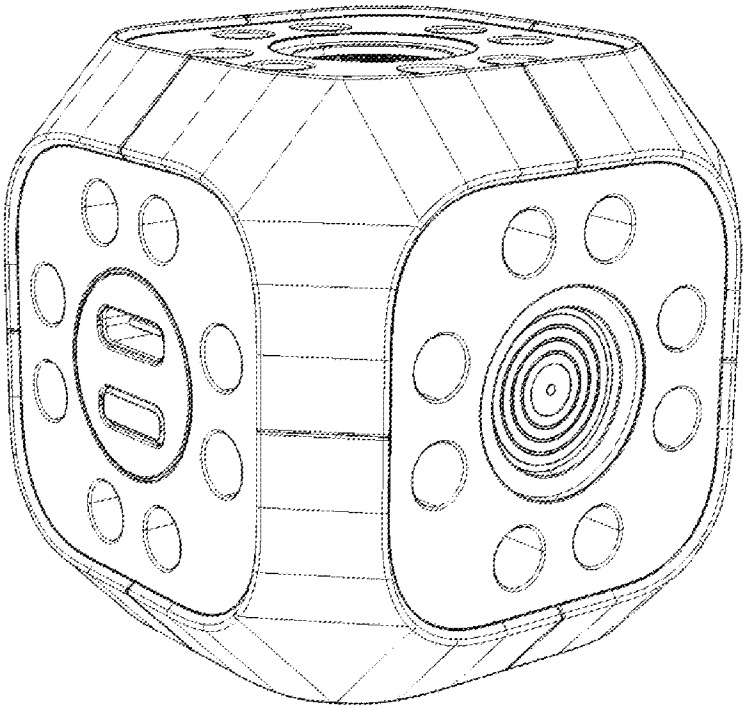
Figure 20D:
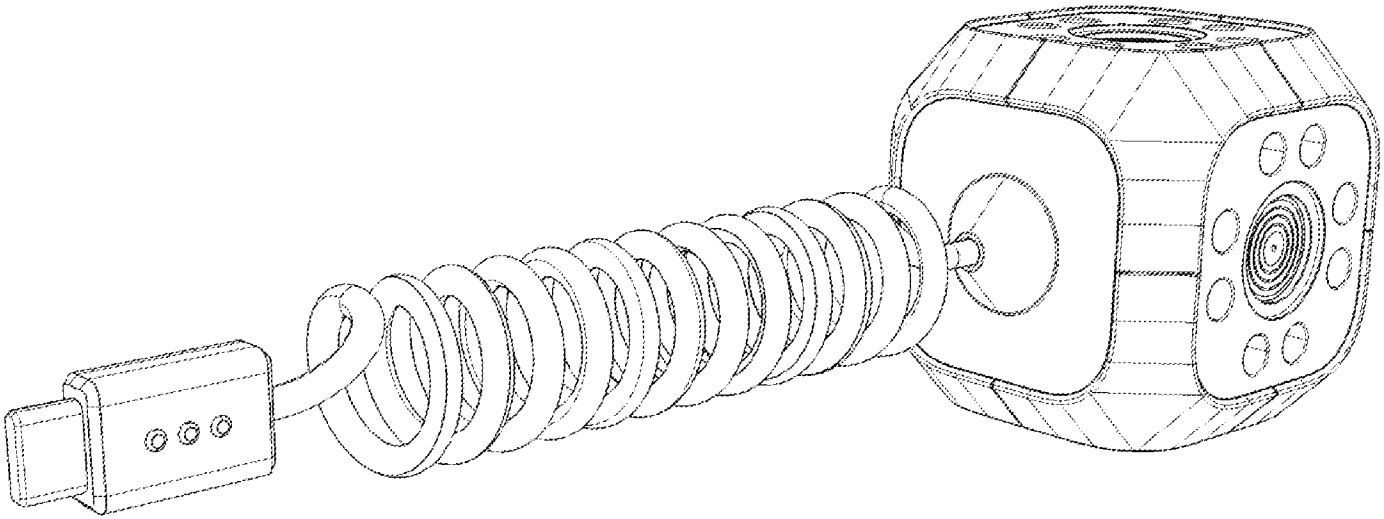
Figure 20E:
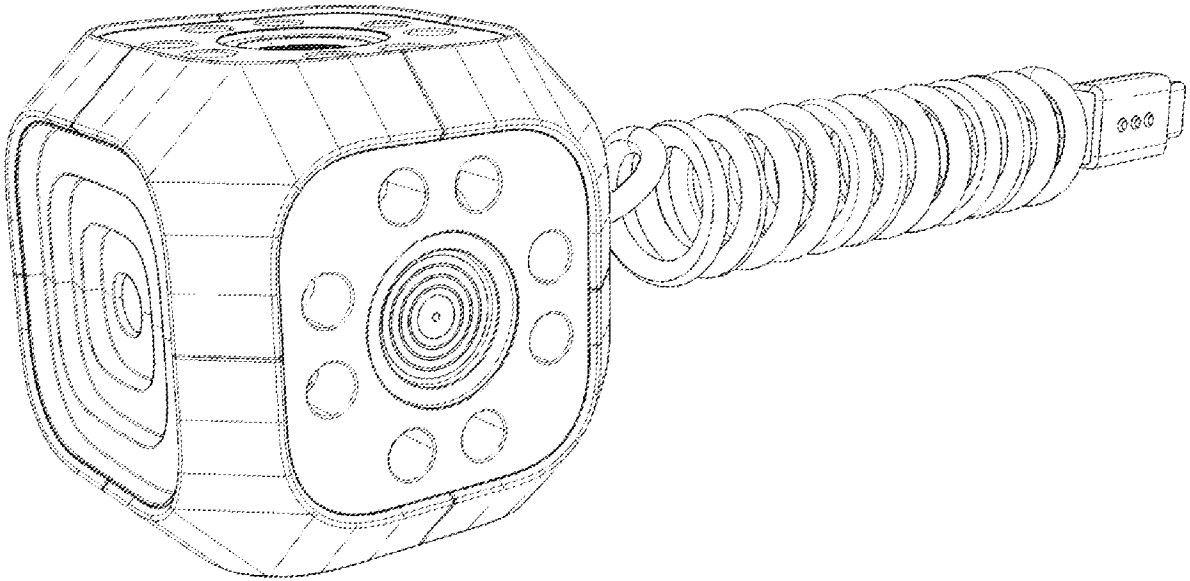
Figure 20F:
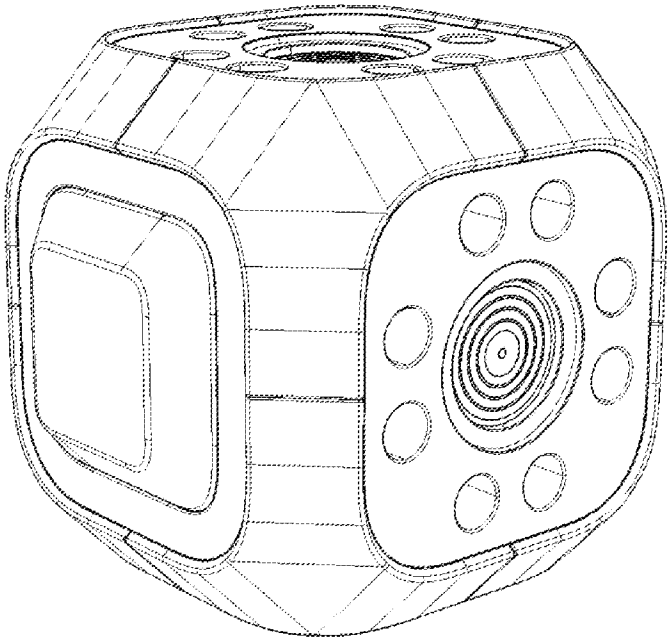
Figure 20G:
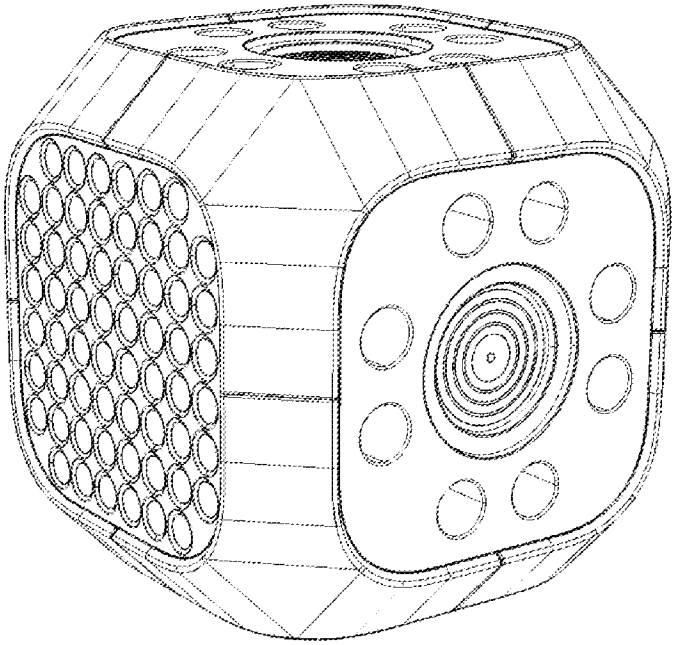
Figure 20H:
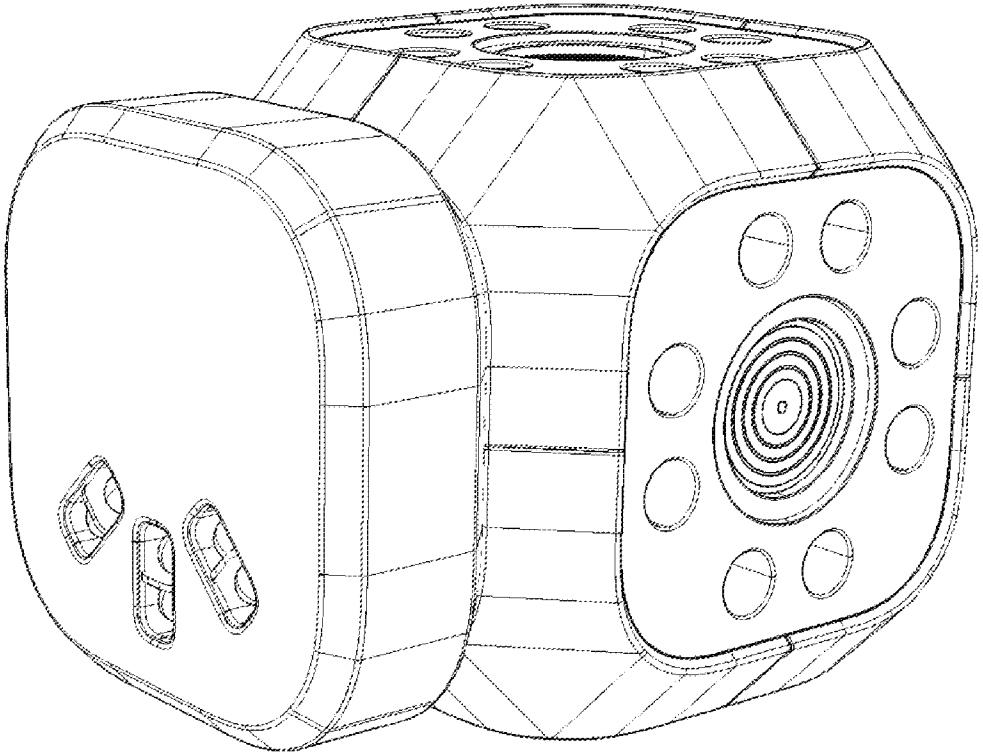

FIG. 20B illustrates a perspective view of an exemplary embodiment of a motion trigger cube of the modular construction kit 100. FIG. 20C illustrates a perspective view of an exemplary embodiment of a battery cube of the modular construction kit 100. FIGS. 20D and 20E illustrate perspective views of an exemplary embodiment of a camera cube of the modular construction kit 100. FIG. 20F illustrates a perspective view of an exemplary embodiment of an IR blaster and receiver cube of the modular construction kit 100. FIG. 20G illustrates a perspective view of an exemplary embodiment of an LED array cube of the modular construction kit 100. FIG. 20H illustrates a perspective view of an exemplary embodiment of a line following cube of the modular construction kit 100.

Figure 22:
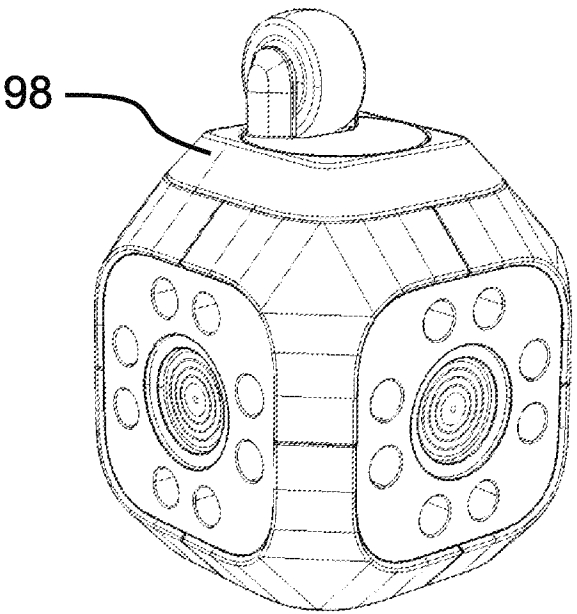
FIG. 22 illustrates another perspective view of a cube and an external wheel assembly according to an embodiment of the present invention.
Figure 21:
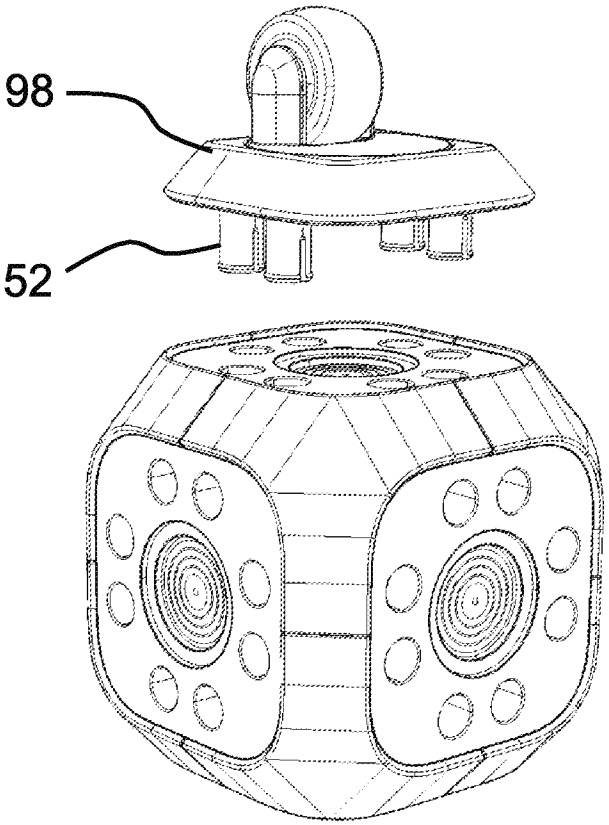
FIG. 21 illustrates a perspective view of a cube and an external wheel assembly according to an embodiment of the present invention.

FIGS. 21 and 22 illustrate a perspective view of an exemplary embodiment of an external wheel assembly 98 of the modular construction kit 100. The wheel assembly 98 may include two or more connection studs 52 similar to the connection studs 52 of the connector 50, for connecting the wheel assembly 98 to a connection face 11 of a cube of the modular construction kit 100.

Figure 23:
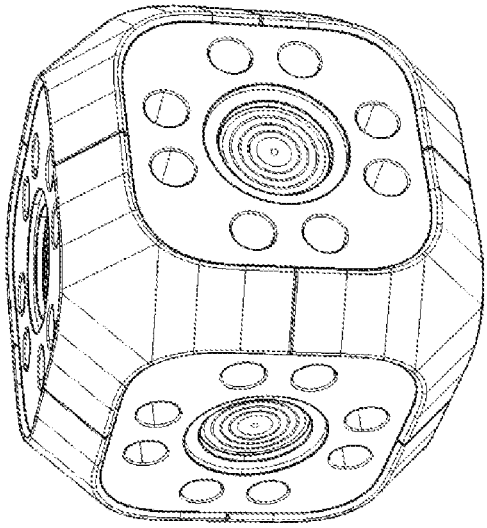
FIG. 23 illustrates a perspective view of a cube and an extension connector according to an embodiment of the present invention.
Figure 23:
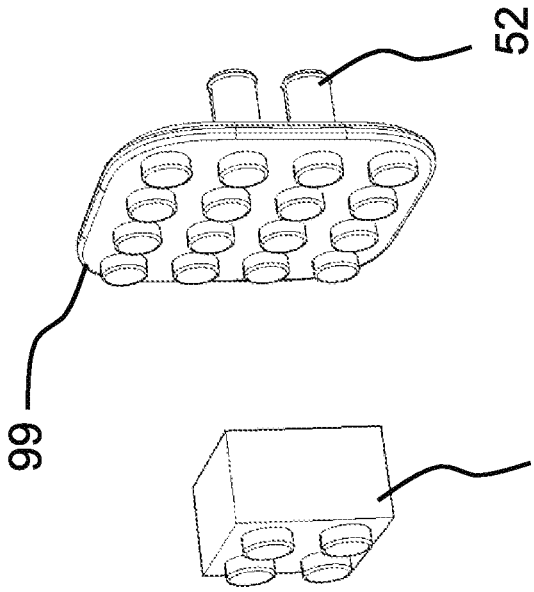
Figure 24:
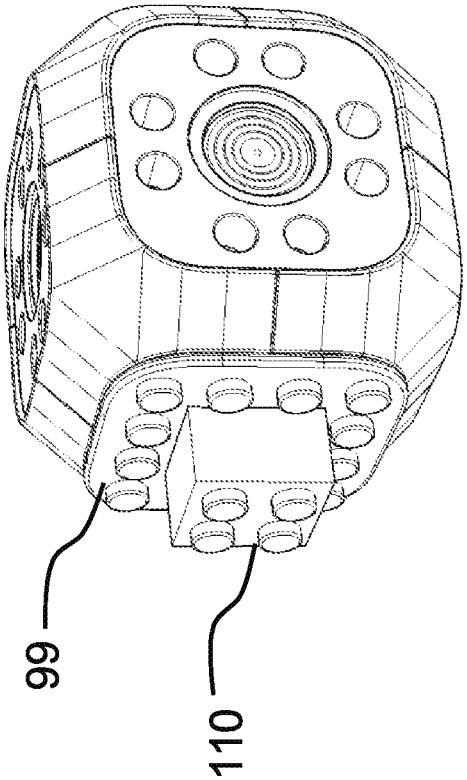
FIG. 24 illustrates another perspective view of a cube and an extension connector according to an embodiment of the present invention.

FIGS. 23 and 24 illustrate a perspective view of an exemplary embodiment of an extension connector 99. The extension connector 99 allows a cube of the modular construction kit 100 to couple to a third-party block 110, for example, a Lego block. In some embodiments, one side of the extension connector 99 includes two or more connection studs 52 similar to connection studs 52 of connector 50, for connecting the extension connector 99 to a connection face 11 of a cube of the modular construction kit 100. The opposite side of the extension connector 99 includes protrusions compatible with the third-party blocks 110.

In some exemplary operations, various cubes and external elements of the modular construction kit 100 may be connected to create a configuration such as a robot. For example, servomotor cubes and gripper cubes may be built together to make a robotic arm, crane, leg, or any robotic manipulator. Various robotic configurations may be built with servomotor cubes, for example, to move joints in different configurations. A robot may be built with the modular construction kit 100 to bipedal. A robot may be built in a car configuration, or into a crane configuration. These are only a few examples of configurations that may be built with the modular construction kit 100.

In some embodiments, the modular construction kit 100 may include swarm algorithm, or swarm intelligence. In these embodiments, a construction created using the cubes of the modular construction kit 100 may communicate and coordinate with one or more other constructions of the modular construction kit 100. These constructions may be in the same vicinity and may communicate and coordinate, for example, to achieve shared goals.

In some embodiments, the modular construction kit 100 may include Simultaneous Localization and Mapping (SLAM) Autonomous algorithms. Using sensor cubes such as camera and/or ultrasonic module combined with encoder values, the modular construction kit 100 may generate virtual maps of the location of a construction.

In some embodiments, the modular construction kit 100 may include motor encoders to obtain a relative position estimation. The encoders may be used to sense and send distance, velocity, and acceleration commands. In these embodiments, autonomous algorithms may be generated, and a construction may operate autonomously.

In some embodiments, the modular construction kit 100 may include position estimations using Wi-Fi or Bluetooth Triangulation or GPS. The modular construction kit 100 may use wide angle IR LED proximity sensor to sense objects near a construction.

In some embodiments, the modular construction kit 100 may use light sensor to detect gradients in light. As a result, the modular construction kit 100 may provide line following robot applications, night/day modes, light following, and so on.

In some embodiments, the modular construction kit 100 may include facial detection, for example, using a camera and facial recognition software. The modular construction kit 100 may use the fingerprint sensor for authentication, for example, to authenticate an operator of a construction.

In some embodiments, a construction may respond to a user's device. For example, a construction may wake up out of sleep mode when the user's tablet or phone closes.

As described herein, the modular construction kit 100 may provide programmable functions and features. In some embodiments, application software may be uploaded to the system cube 70. The application may cause a construction of the modular construction kit 100 to operate autonomously, for example, without being controlled and/or operated by an operator. Alternatively or additionally, the application may communicate, for example, wirelessly, with an external device, to operate a construction of the modular construction kit 100. The external device may include wireless devices such as an iPad, a tablet, a laptop, a smart phone, or any wireless device having communication capability (e.g., WiFi, Bluetooth, or RF). The modular construction kit 100 may be controlled and operated within a local WiFi network, or from across the Internet, at a remote location. The modular construction kit 100 may retrieve remote data, for example, weather, news, data from the Internet, and so on. The wireless communication capability may also allow the modular construction kit 100 to operate as an Internet of Things device.

In some exemplary operations, the modular construction kit 100 may be programmed or controlled to, for example, detect and avoid an obstacle, solve a maze, detect room temperature, make a sound when light in room is detected or presence of a person is detected, react to a sound, hide from or follow source of light, make decisions based on the presence of a magnetic field, and so on. The modular construction kit 100 may be programmed to monitor the states of rooms (e.g., C02 detection), objects (e.g., burglary), or weather and send visual, or digital notifications to a user. The modular construction kit 100 may be used as a security device, for example, as a finger print scanner or voice command to enter rooms, homes, or secure boxes. The modular construction kit 100 may function as a controller for many different hardware projects, for example, as garage door operator or in other home automation projects. A plurality of constructions may form their own Wi-Fi Mesh network, for example, when one construction includes a primary connection to a Wi-Fi network, and the others can communicate between themselves to relay send/receive requests to and from the primary construction connected to the Internet.

In some embodiments, the modular construction kit 100 may include application program interfaces (APIs) to interface with external software application. The modular construction kit 100 may also communicate with a simulation program.

In some embodiments, the modular construction kit 100 includes a scripting language and a programming user interface (UI) for programming the operations, functions, movements, and the like, of the various cubes. The scripting language may be designed to educate small children in robotics and logical thinking while being a fun sandbox environment to play in, for example, as in a game. Using the UI, a user can create a program which may then be uploaded to a construction, for example, a robot, constructed with one or more cubes of the modular construction kit 100. The program created with the scripting language may execute using best effort, even when the logic of the program is flaw or contradictory. The program thus may forgive mistakes and reward achievements, allowing the user to see results and learn. In some embodiments, it may be possible to create random programs, the modular construction kit 100 can still cause the construction to function.

Figure 25:
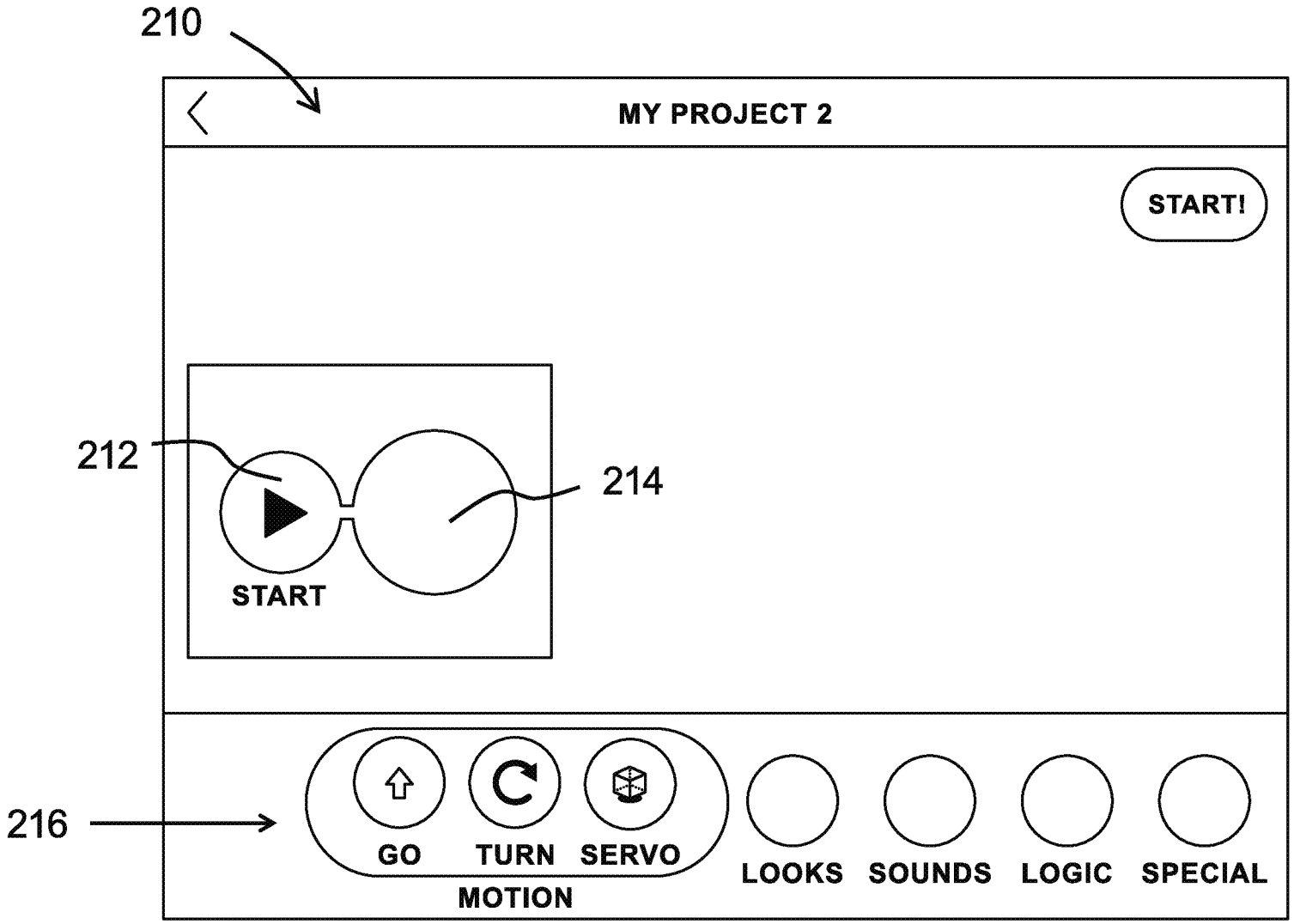
FIGS. 25-41 illustrate a programming user interface (UI) for a modular construction kit according to an embodiment of the present invention.

FIGS. 25-41 illustrate an exemplary embodiment of a programming UI 200 of the modular construction kit 100. As described herein, the programming UI may be provided at a wireless device, for example, a tablet, a laptop, a smart phone, or any wireless device having communication capability (e.g., WiFi, Bluetooth, or RF). The programming UI may include a Start UI 210, as illustrated in FIG. 25, where the user may begin creating an application program. The Start UI 210 may include a Start bubble 212 and a blank field or bubble 214. Each blank bubble 214 represents a logical step wherein the user can insert an available command (which may also be referred to herein as command action, or action) from the command menu bar 216. The commands may be grouped into categories, for example, Motion, Looks, Sounds, Logic, Special, Triggers, and so on.

Figure 26:
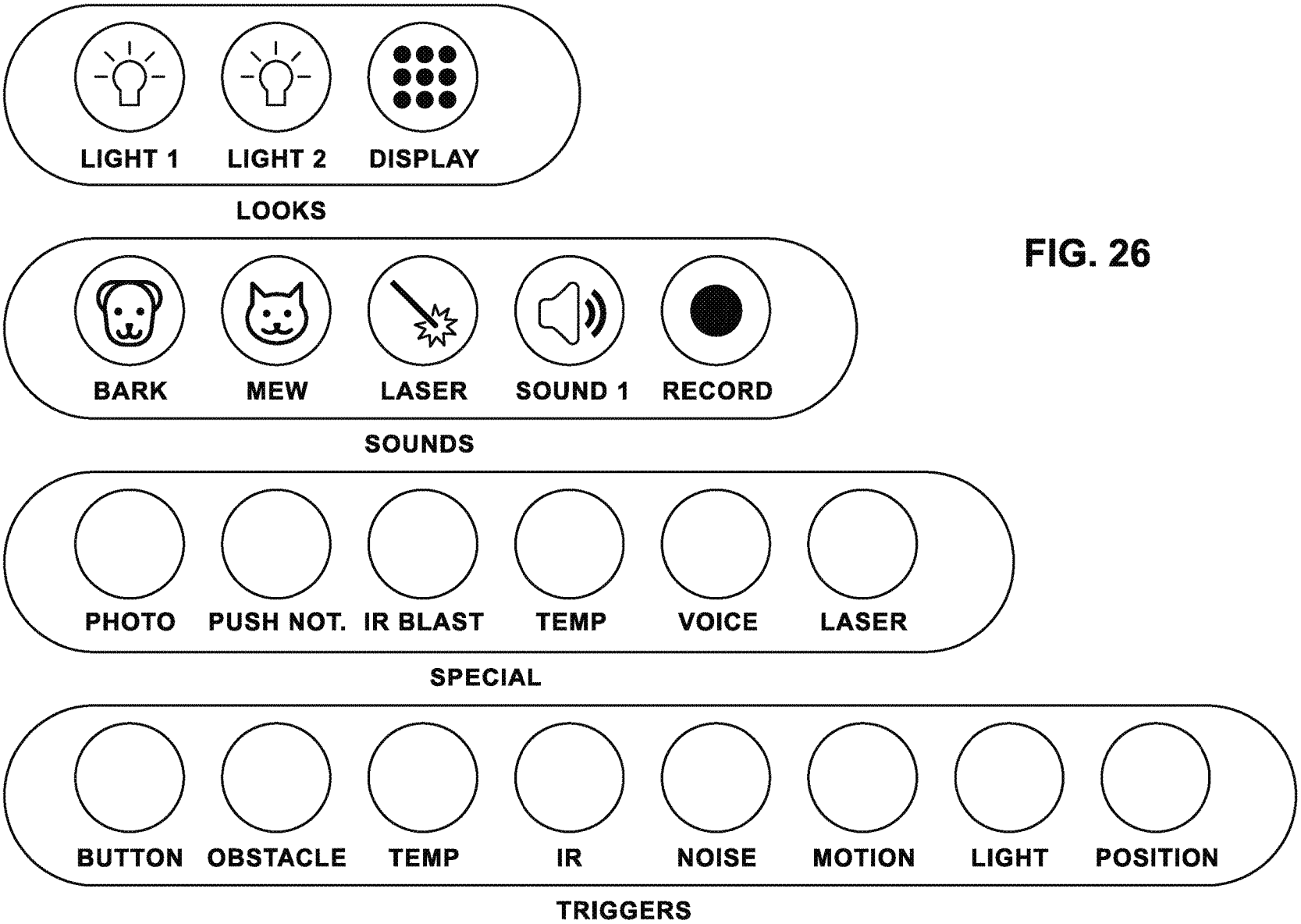

In some embodiments, the Motion category may include commands such as Go, Turn, Servo, and so on. In some embodiments, when the user selects (e.g., places a cursor over, or touches) a category, a command selection window may be displayed. Referring to FIG. 26, exemplary embodiments of some command categories are illustrated. For example, commands under the Looks category may include command operating Light 1, Light 2, and LED Display. Commands under the Sounds category may include Bark, Meow, Laser, Sound 1, and Record. Commands under the category Special may include Photo, Push Notification, Infrared (IR) Blast, Temperature, Voice, and Laser. Commands under the category Triggers may include Button, Obstacle, Temperature, IR, Noise, Motion, Light, and Position. These commands are illustrated as examples. Other commands for receiving and sending data from or operating the various cubes of the modular construction kit 100 are also contemplated.

Figure 27B:
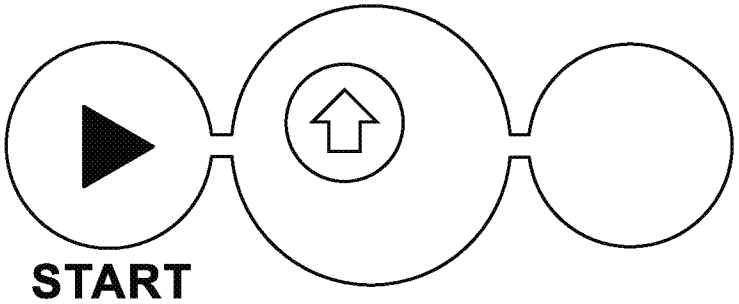
Figure 27A:
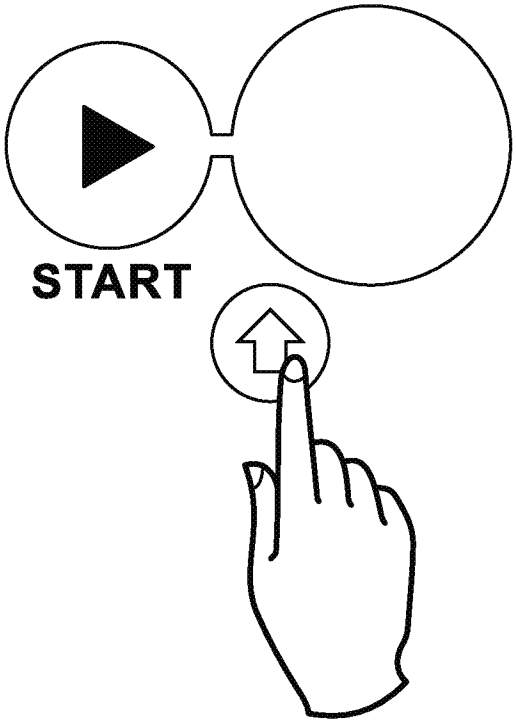
Figure 27C:
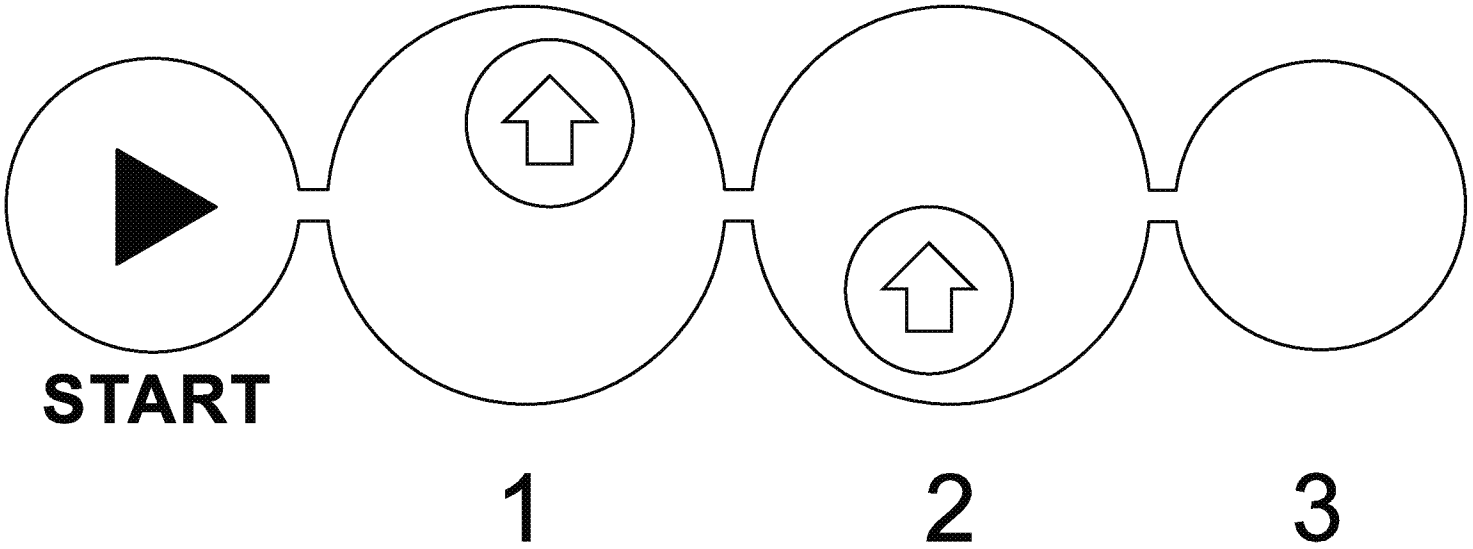
Figure 28A:
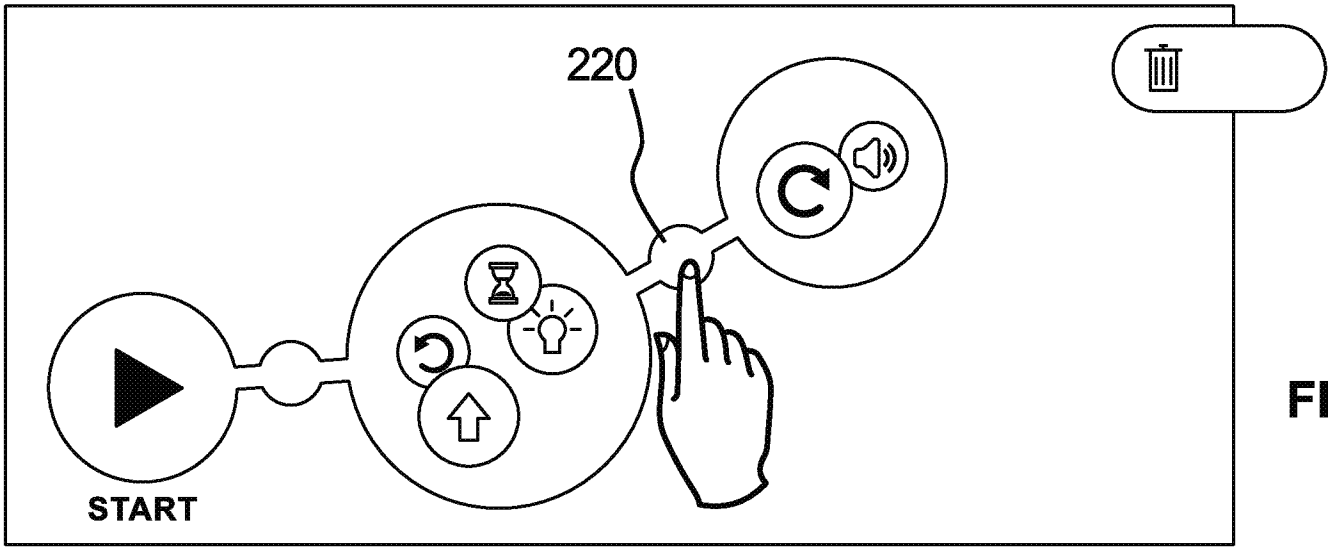
Figure 28B:
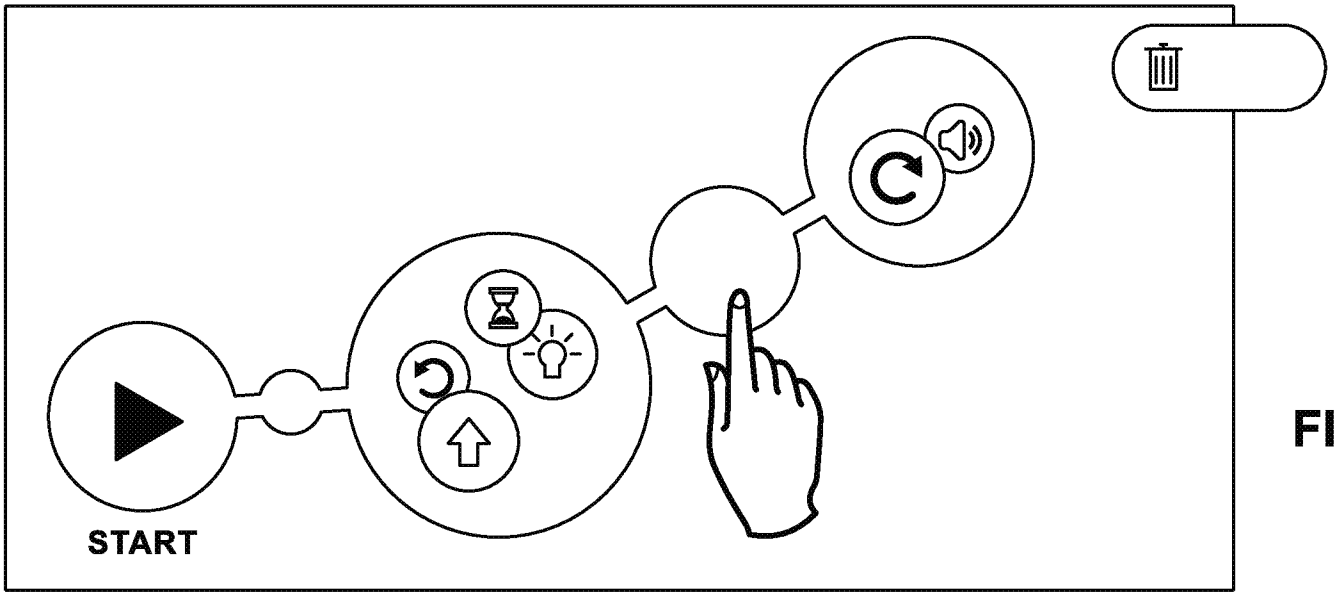
Figure 28D:
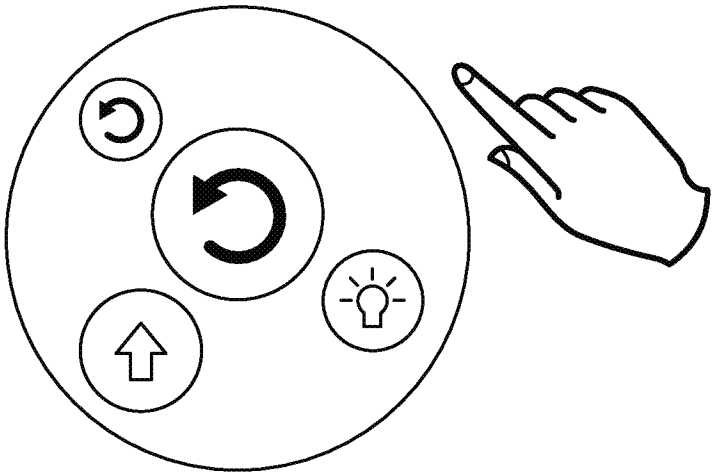
Figure 28C:
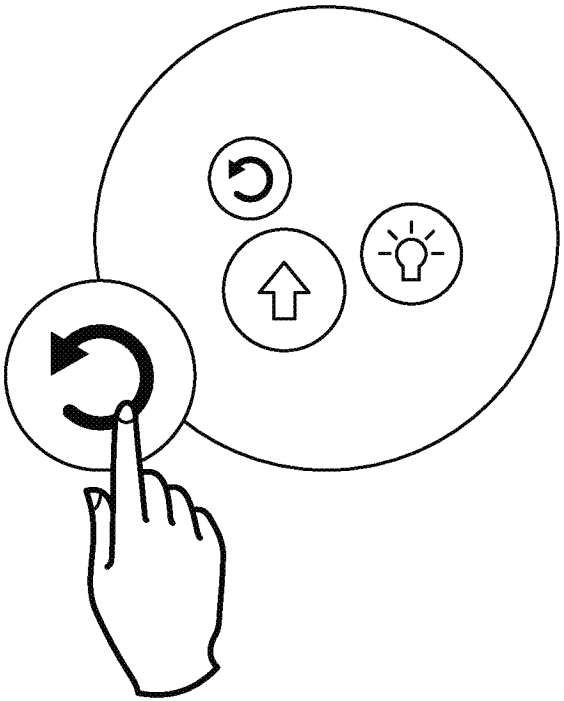
Figure 28G:
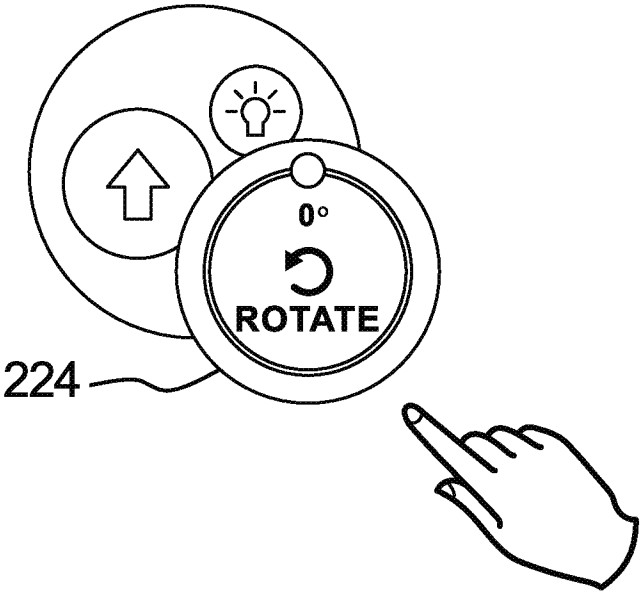
Figure 28F:
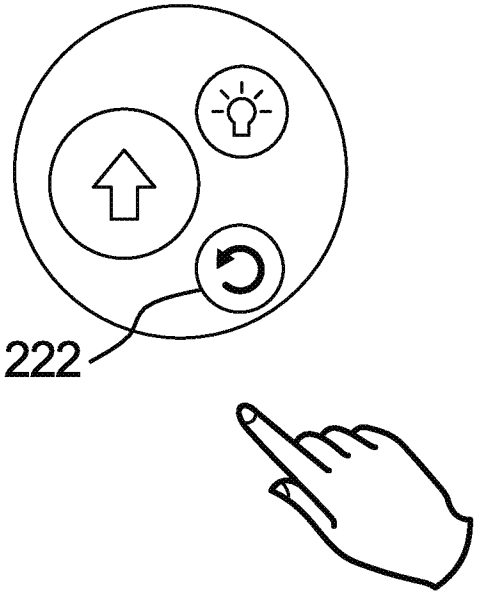
Figure 28E:
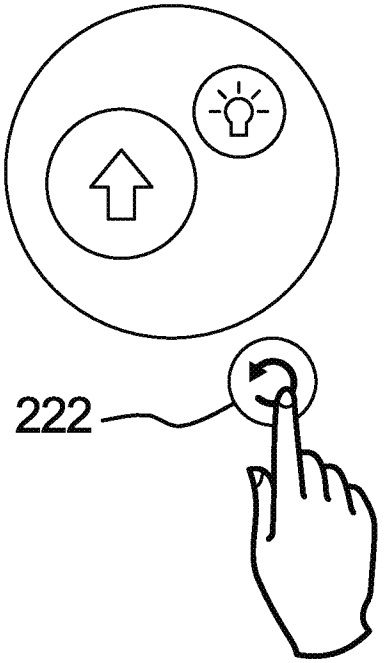
Figure 29A:
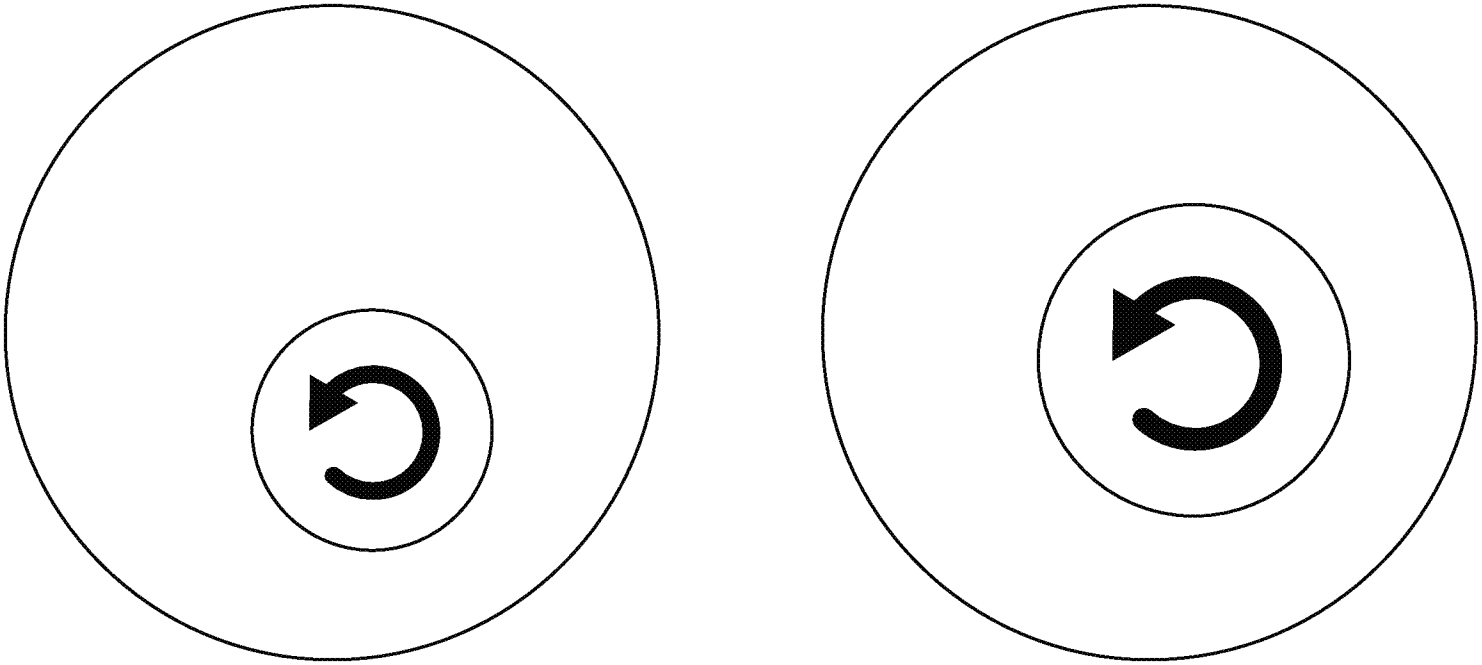
Figure 29B:
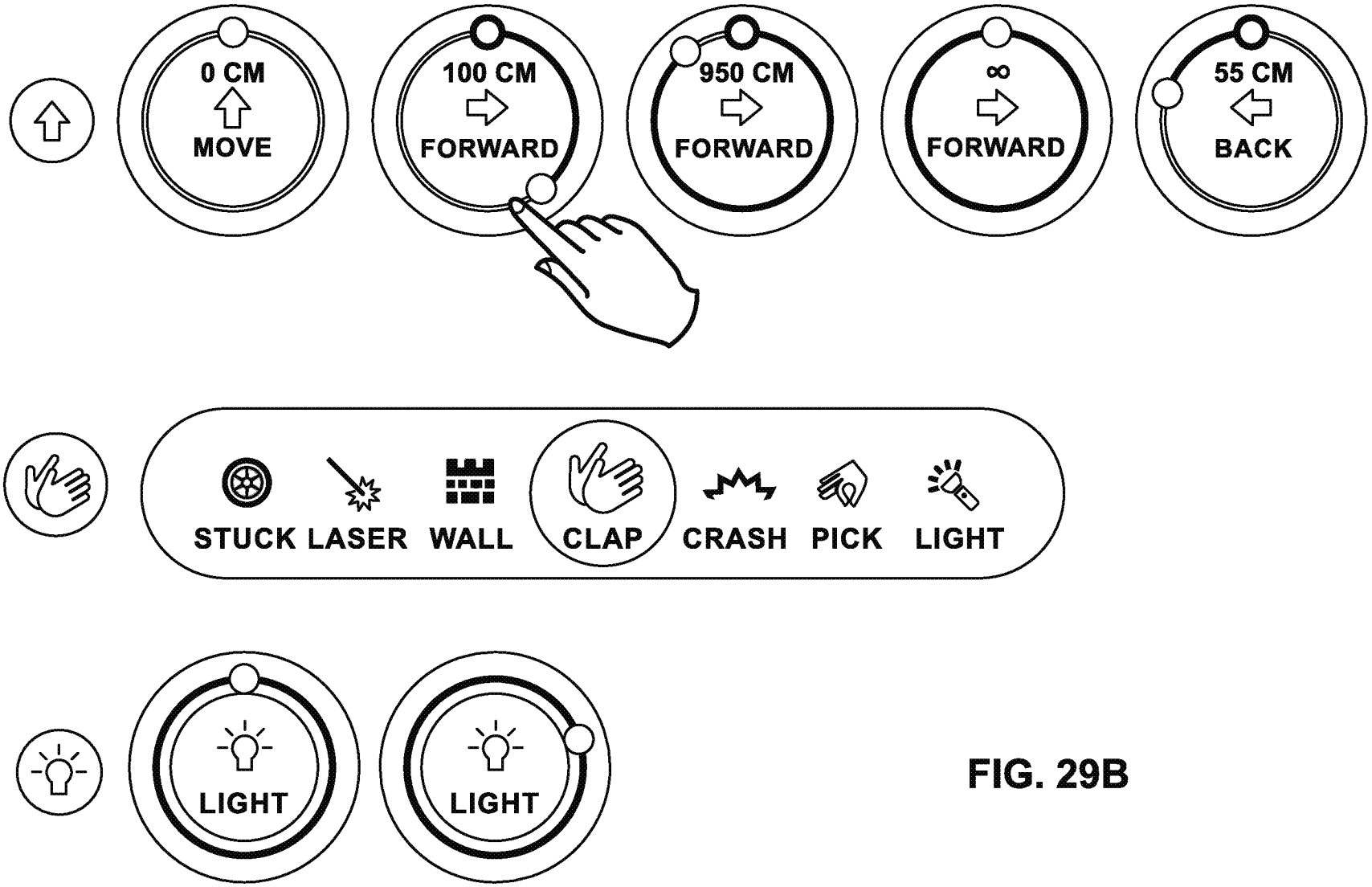
Figure 29C:
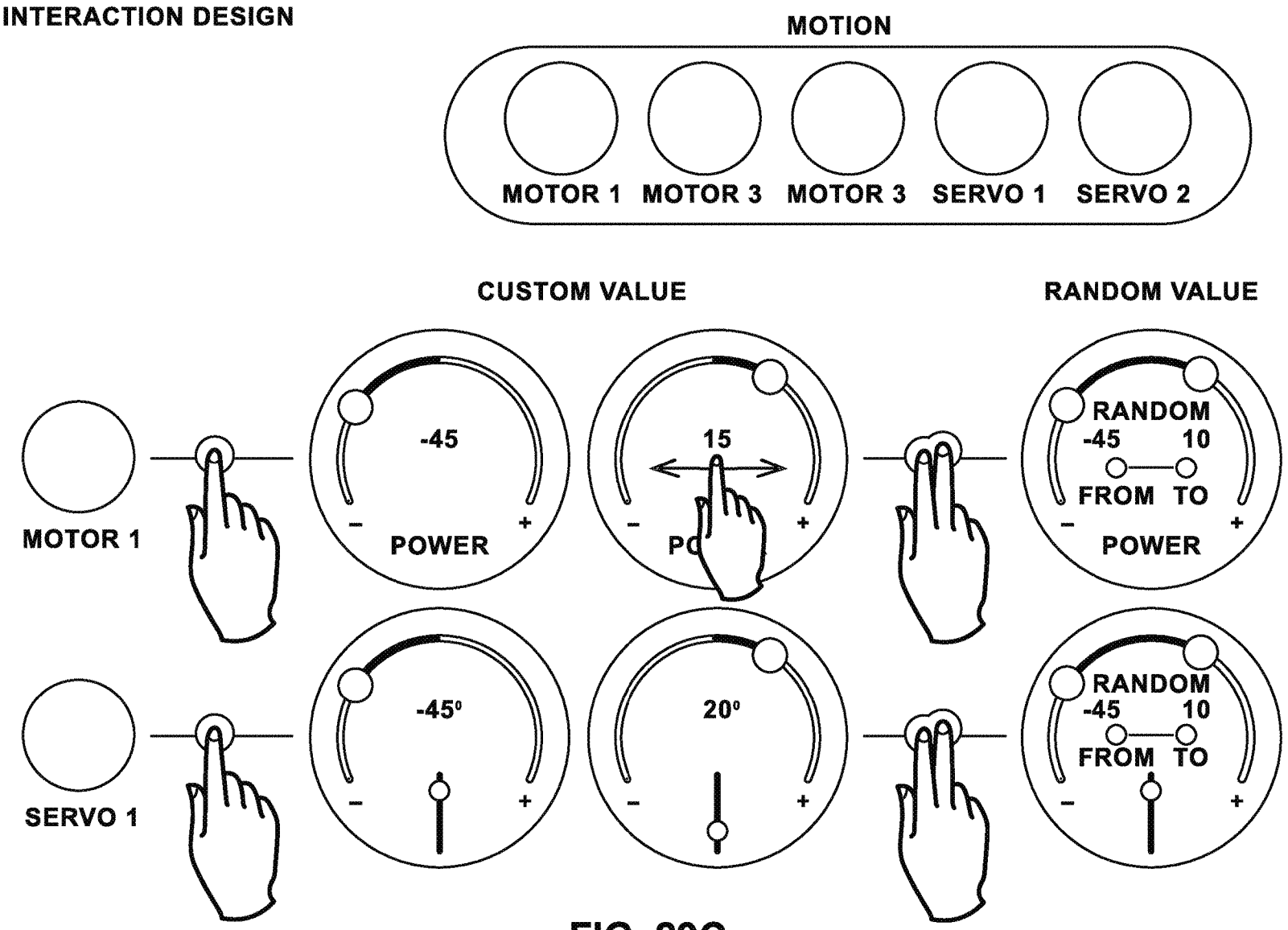
Figure 29D:
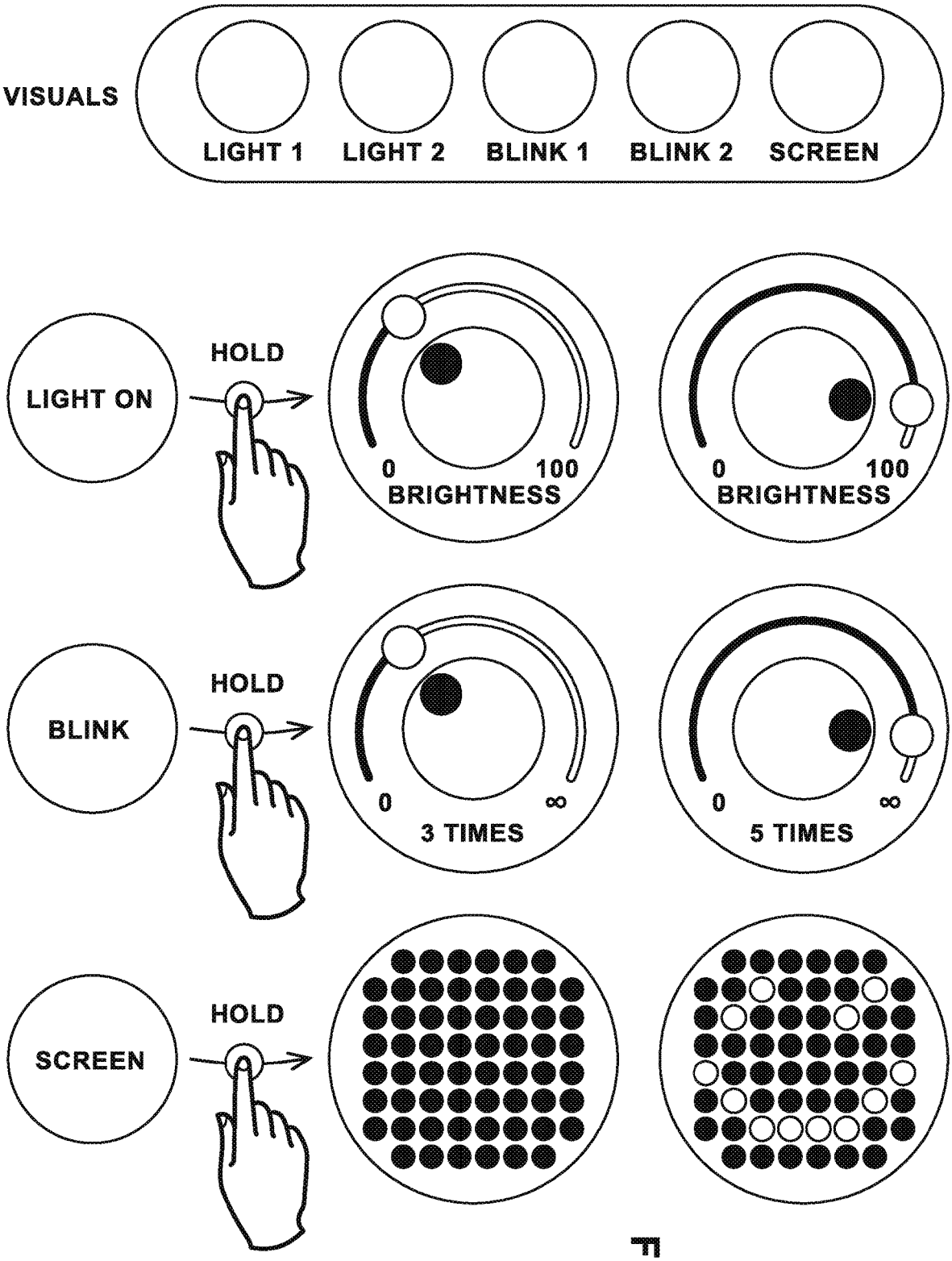
Figure 30B:
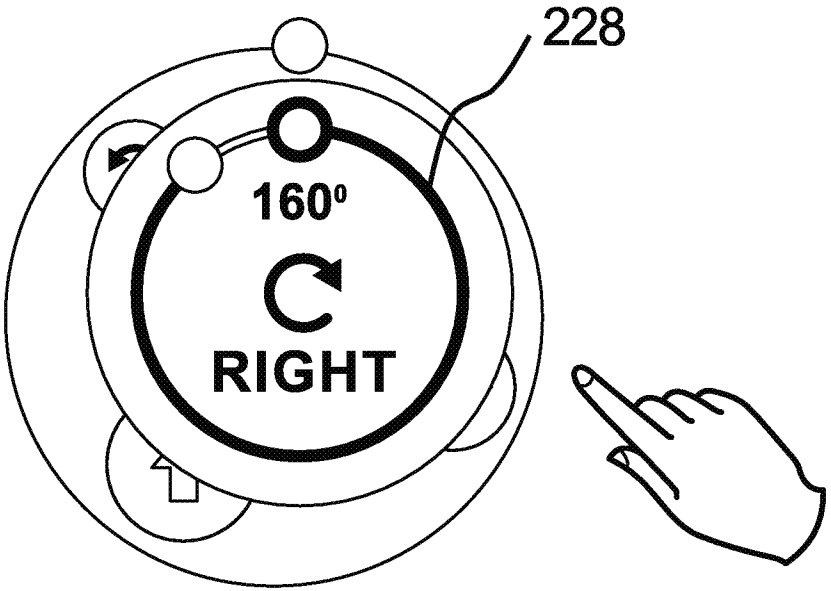
Figure 30A:
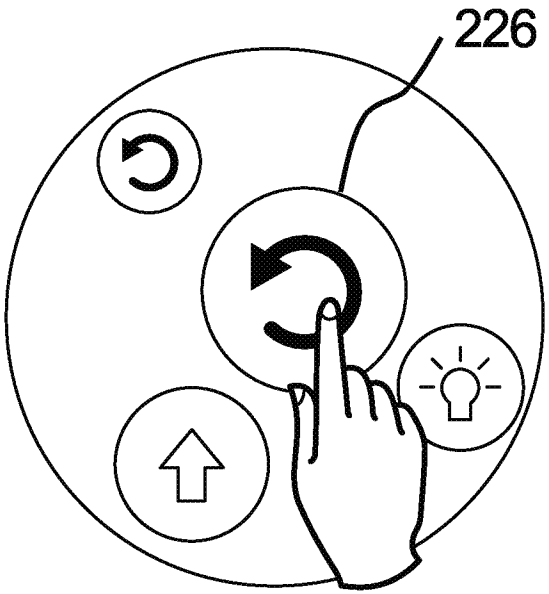
Figure 30C:
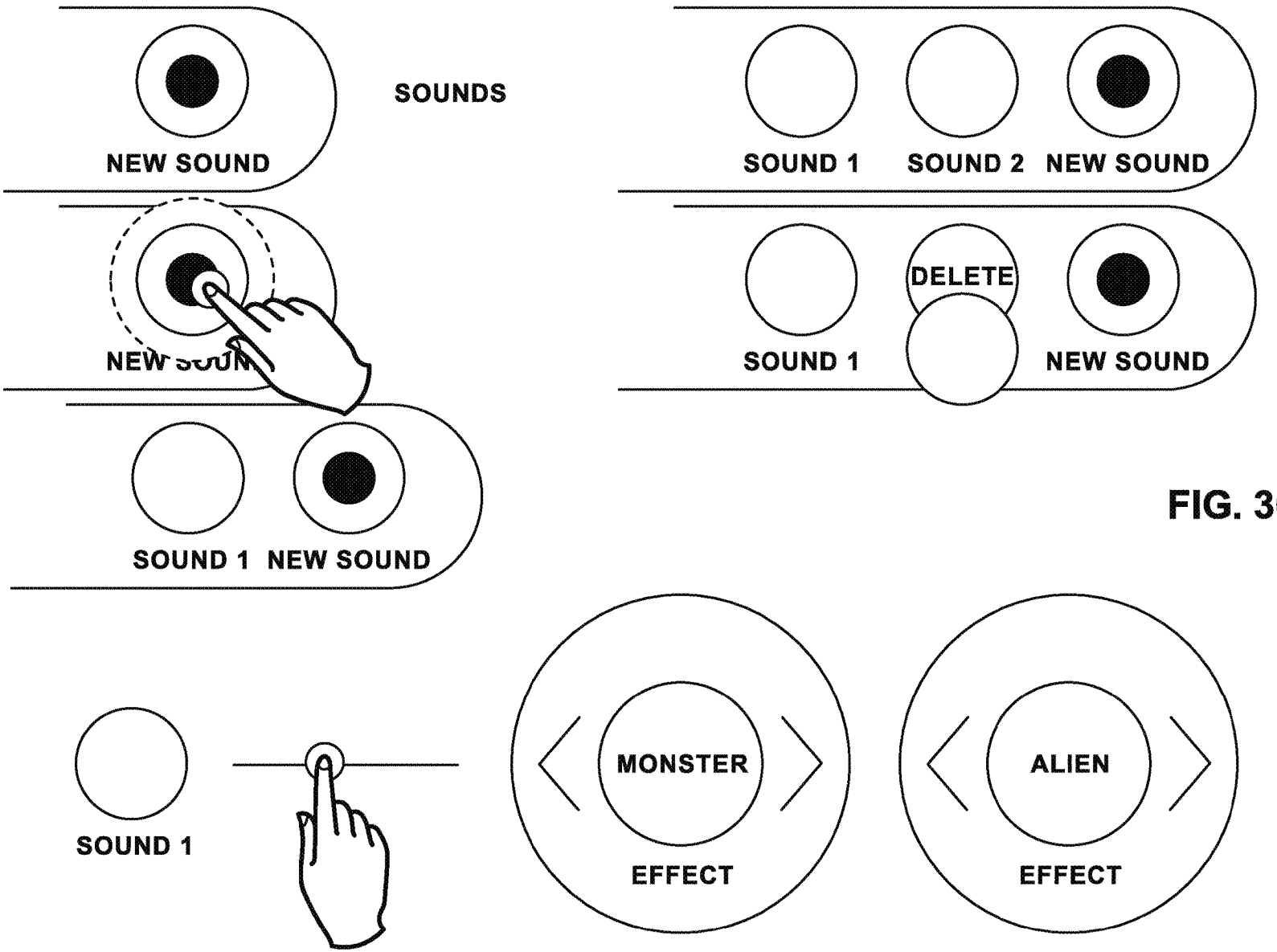
Figure 30D:
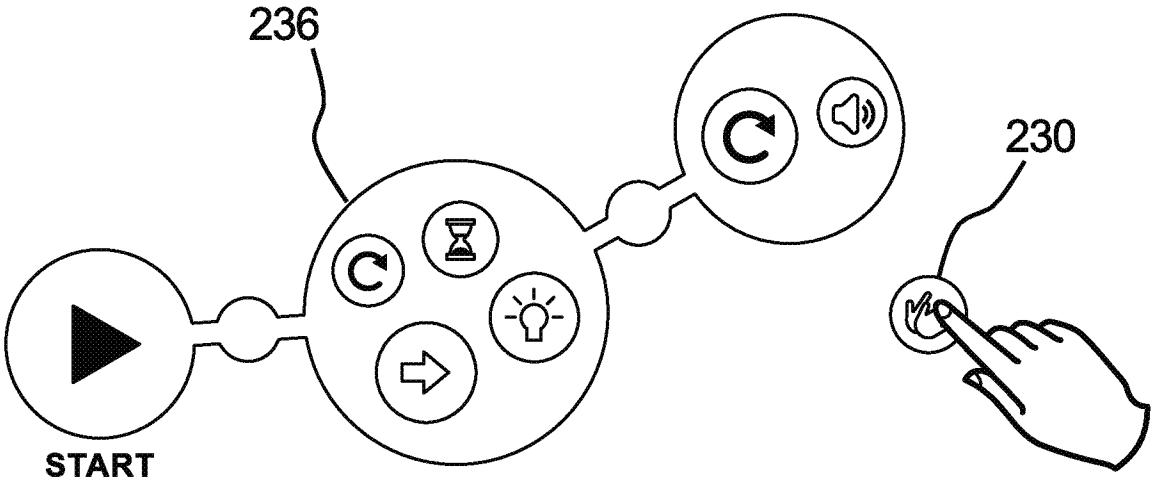
Figure 30E:
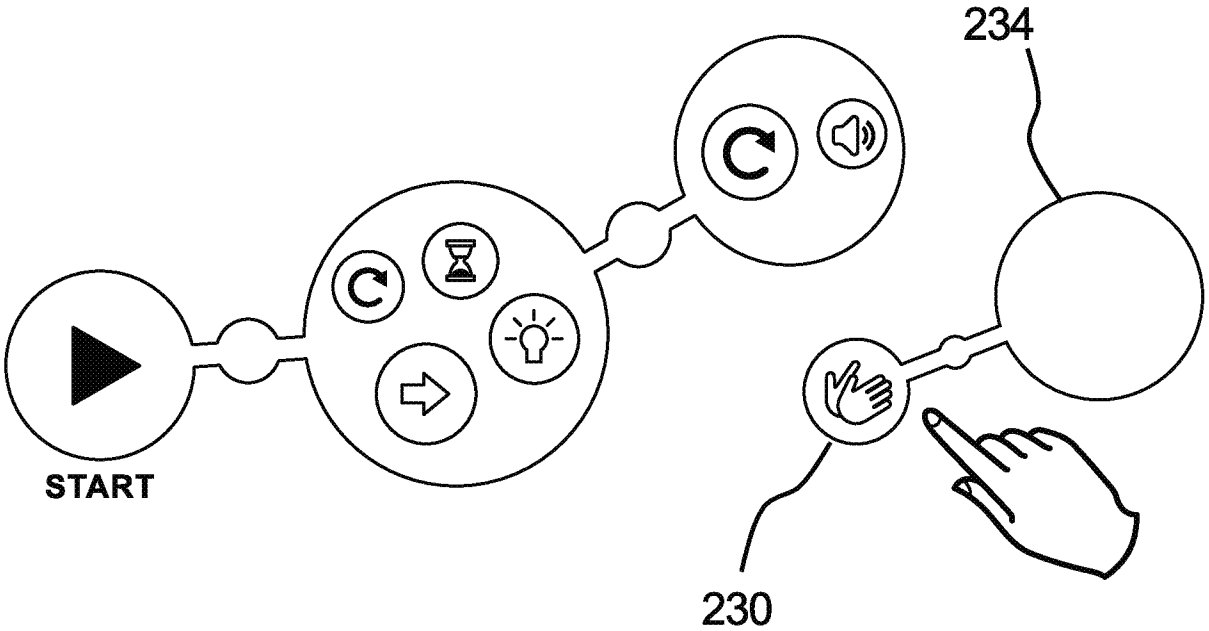

FIGS. 27(A-C) illustrate exemplary operations of selecting a command, for example, Go (shown as an up arrow), for the first logical step (or bubble) or the program being created. In some embodiments, when a bubble is filled, a new empty bubble may be created, for example, growing out of the filled bubble. An empty bubble may also be created by selecting (e.g., tapping) a small empty bubble 220, as illustrated in FIGS. 28(A-B).

As illustrated in FIGS. 28(A-B), more than one action commands (e.g., Move Forward, Turn Left, Blink Light, Take Photo, Play Sound) may be added to one bubble. The modular construction kit 100 will function its best to execute these actions within one logical step. In some embodiments, these steps may be executed substantially simultaneously. As illustrated in FIGS. 28(C-D), the commands are displayed in a bubble with a floating effect. When a new command is added into a bubble, the existing commands are moved around (float) to create space for the new command. As illustrated in FIGS. 28(E-G), when a new command 222 is selected and dropped outside of a bubble, it is moved inside the bubble and placed next to a nearest command. In some embodiments, a menu 224 for the new command 222 may be automatically displayed.

As illustrated in FIGS. 29(A-D), actions may have degree of values, intensity or measurements. For example, rotation may be specified in degrees, move may be specified in centimeters, light may be specified in brightness, blink may be specified in number per second, and the like. The degree of values may be a random value. For example, the user may indicate a random value by using a touch-and-spread motion input of two fingers to indicate a random value within a range. The size of the round command icon may vary with the degree of values of the action.

As illustrated in FIGS. 30(A-B), a user may tap on a displayed command 226, a menu 228 may be opened, showing the stored value for the command 226. The user may then change the value for the command 226. FIG. 30C illustrates exemplary menus for the Sound category. In some embodiments, the user may also record a new sound.

Figure 31A:
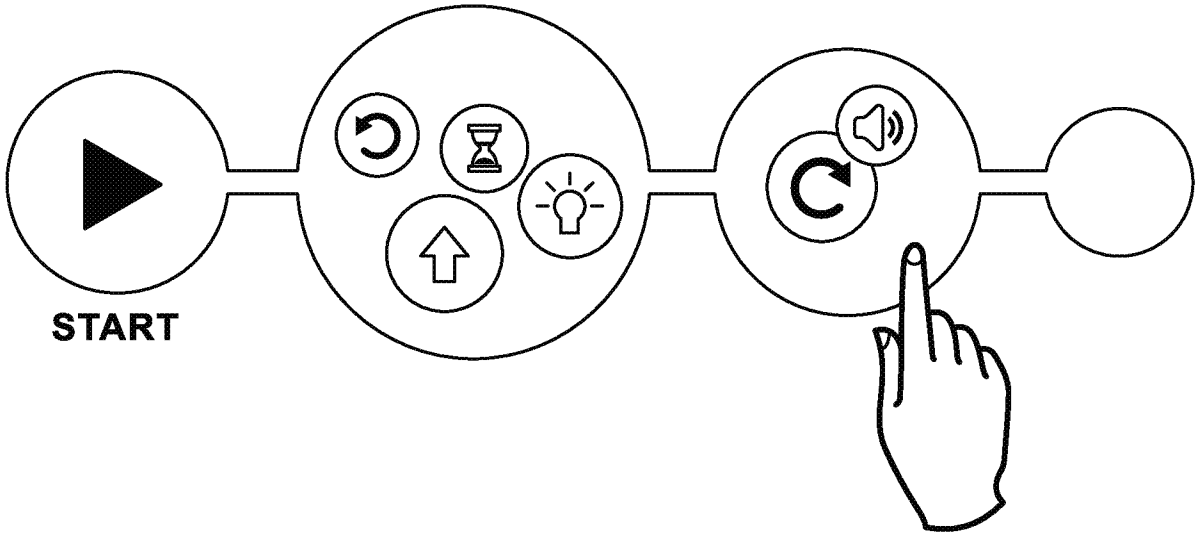
Figure 31B:
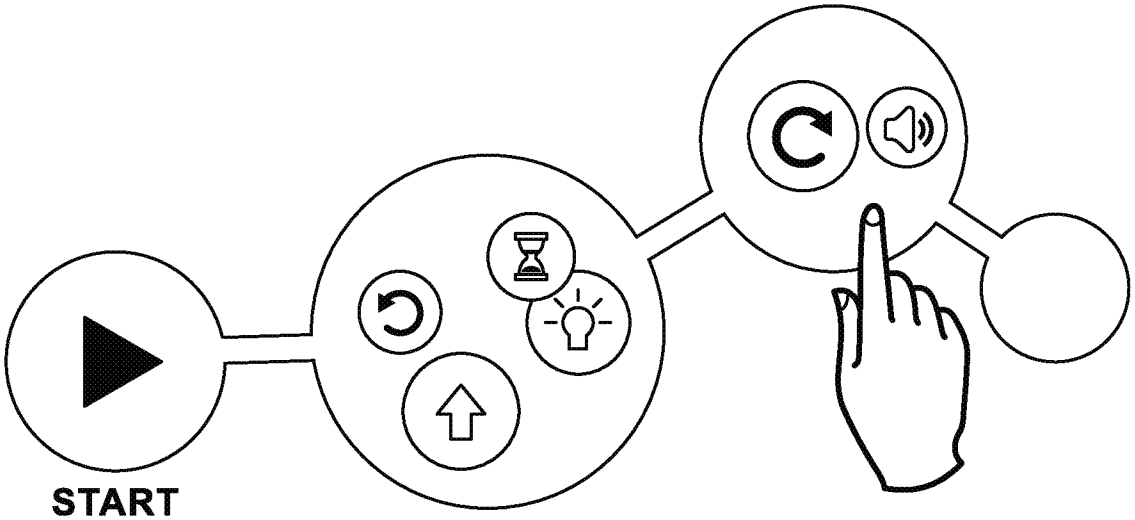

As illustrated in FIGS. 30(A-B), a new chain of bubble 234 may be created by selecting and dropping a command 230 outside of an existing chain 236. Chains of bubble may also be created and moved (dragged) around the program, as illustrated in FIGS. 31(A-B).

Figure 32A:
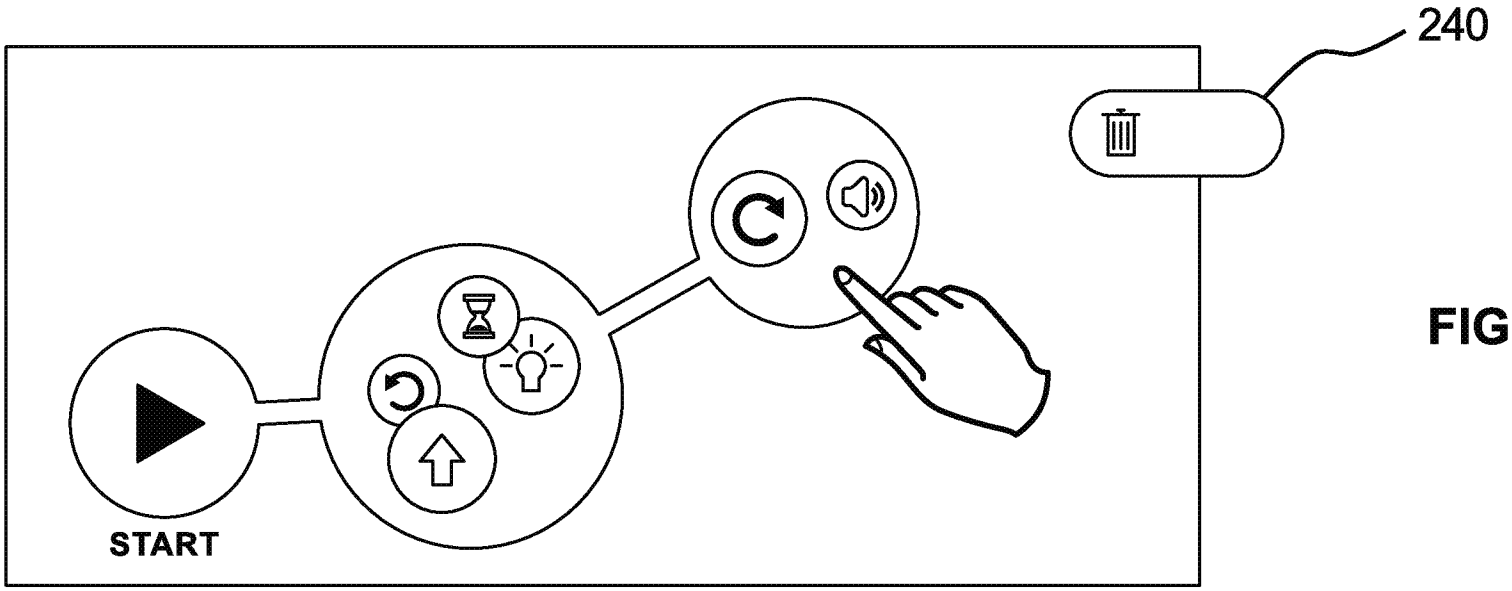
Figure 32B:
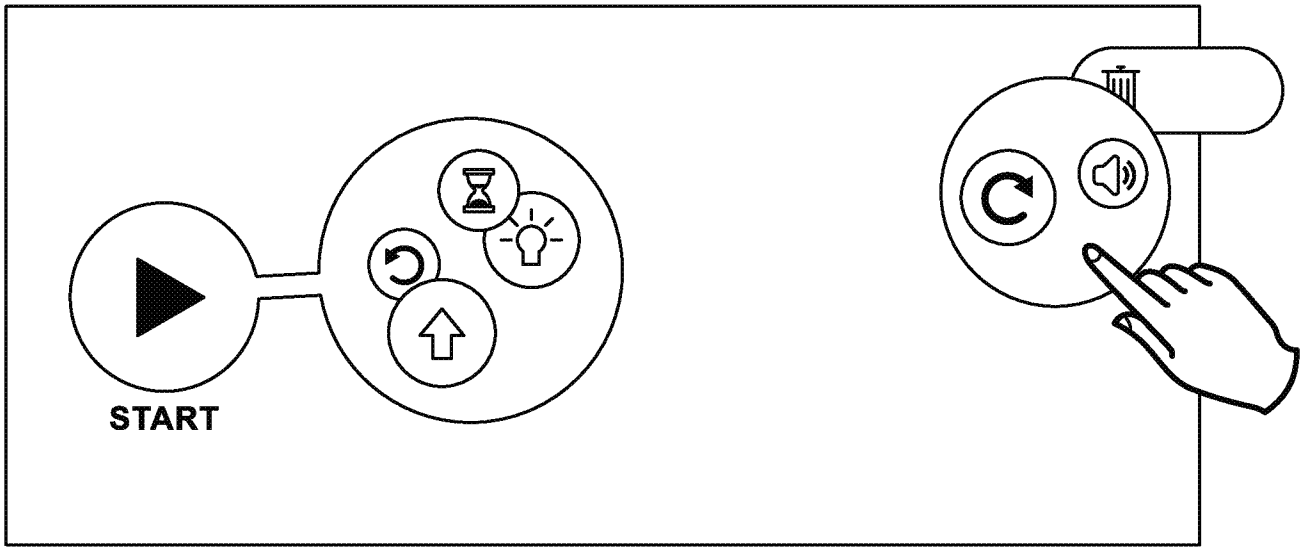

As illustrated in FIGS. 32(A-B), an action or entire bubble may be deleted my selecting and moving it to the Trash Bin icon 240.

Figure 33B:
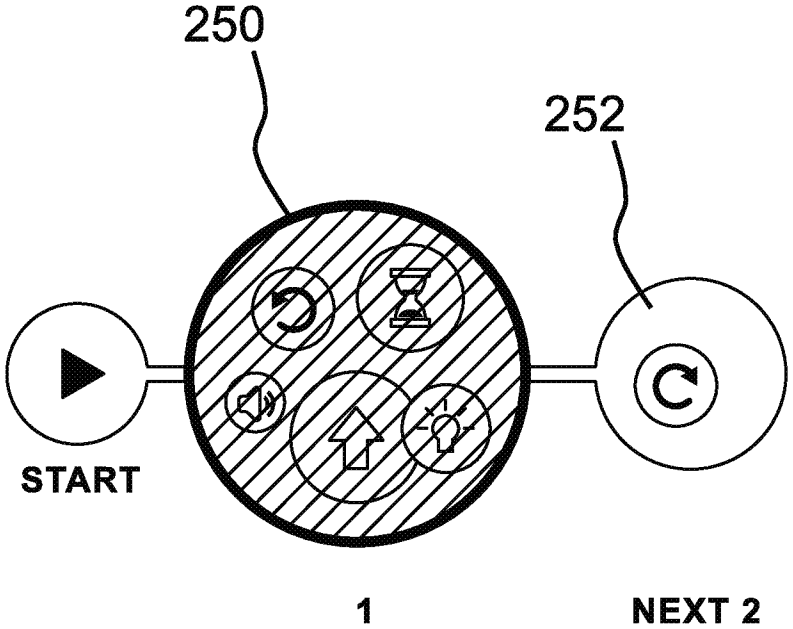
Figure 33A:
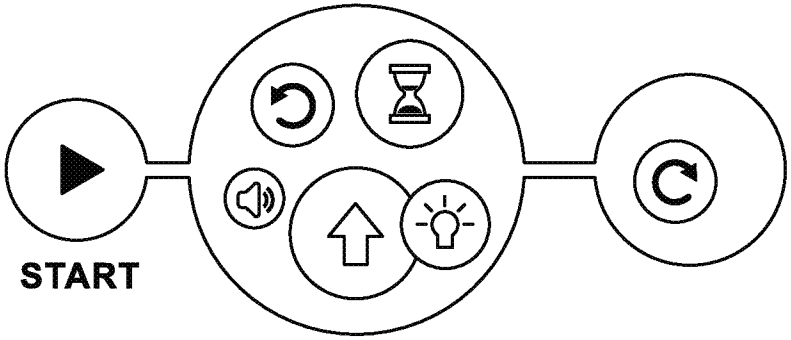
Figure 34A:
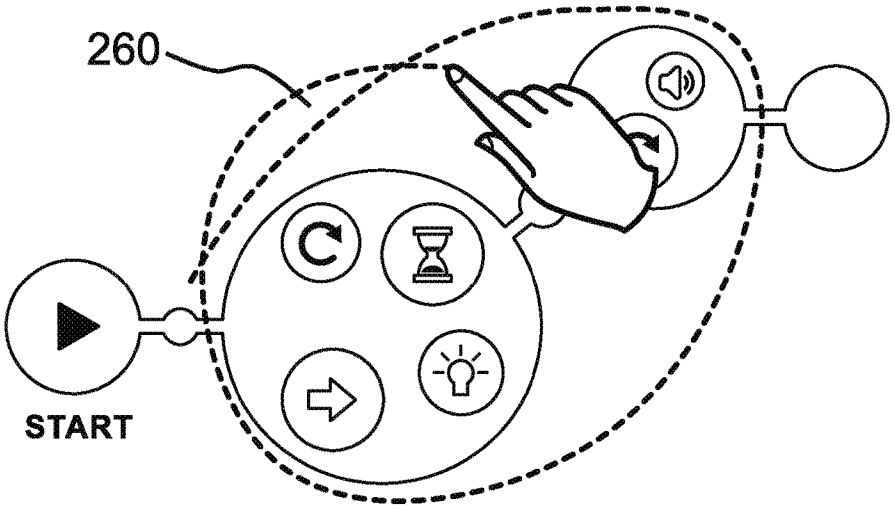
Figure 34B:
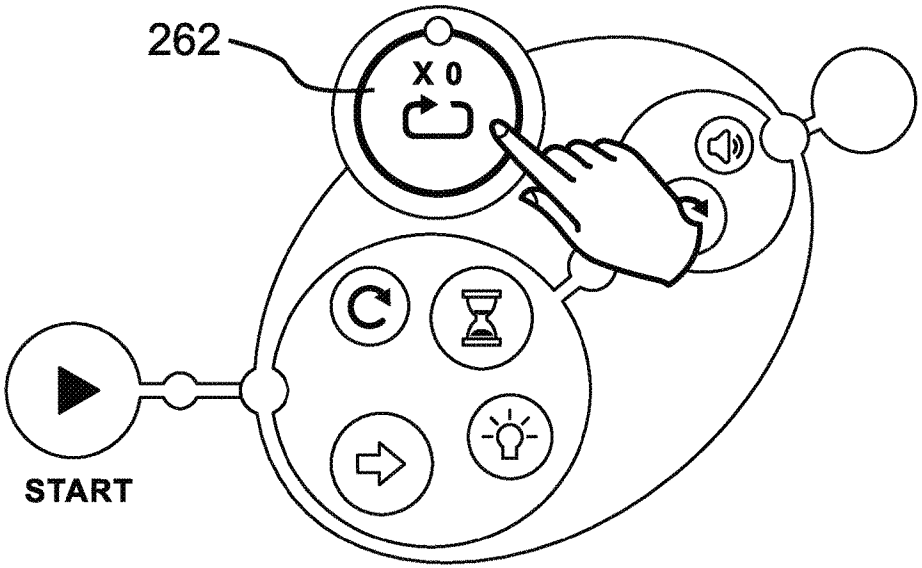
Figure 34C:
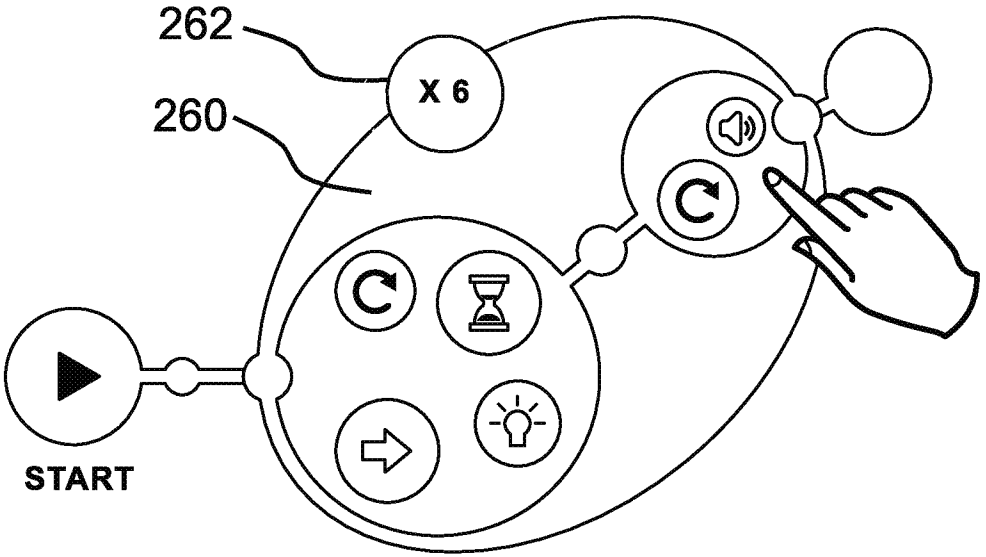
Figure 34D:
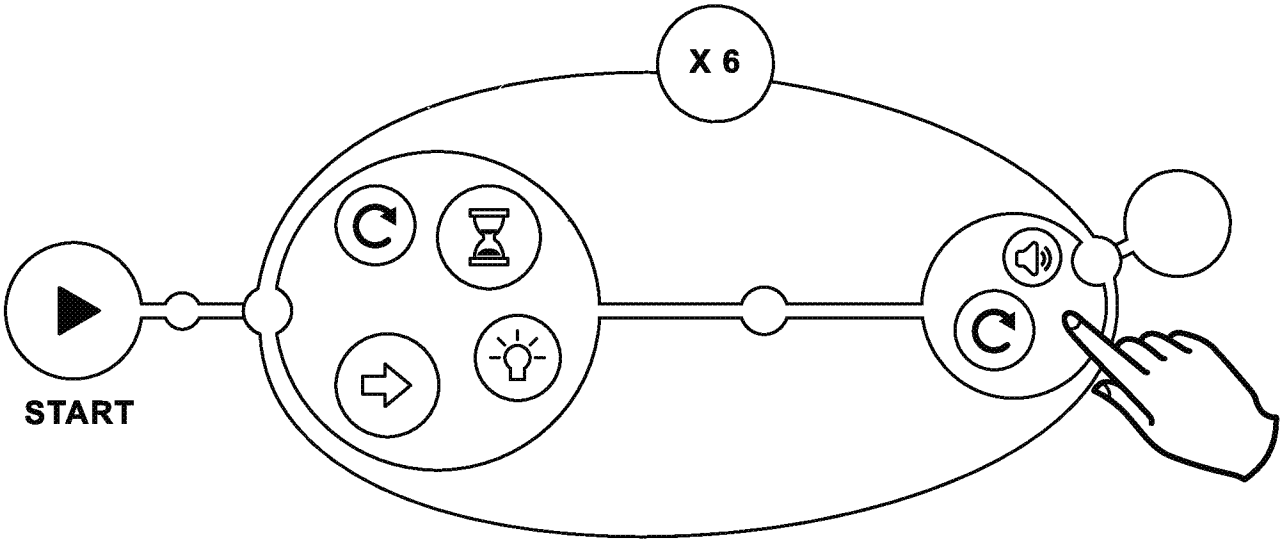
Figure 35A:
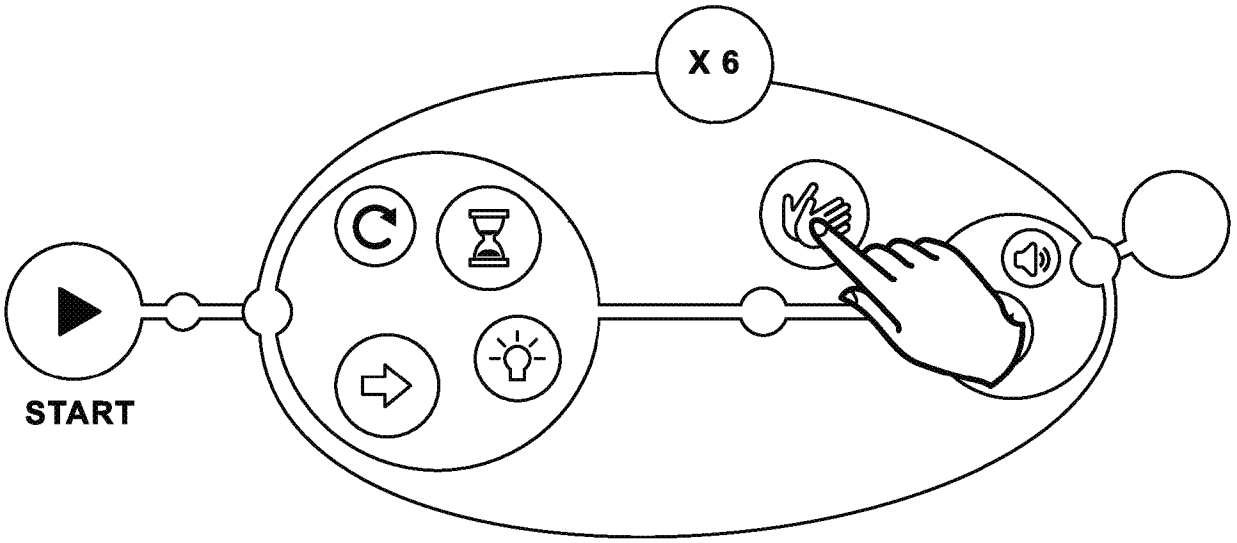
Figure 35B:
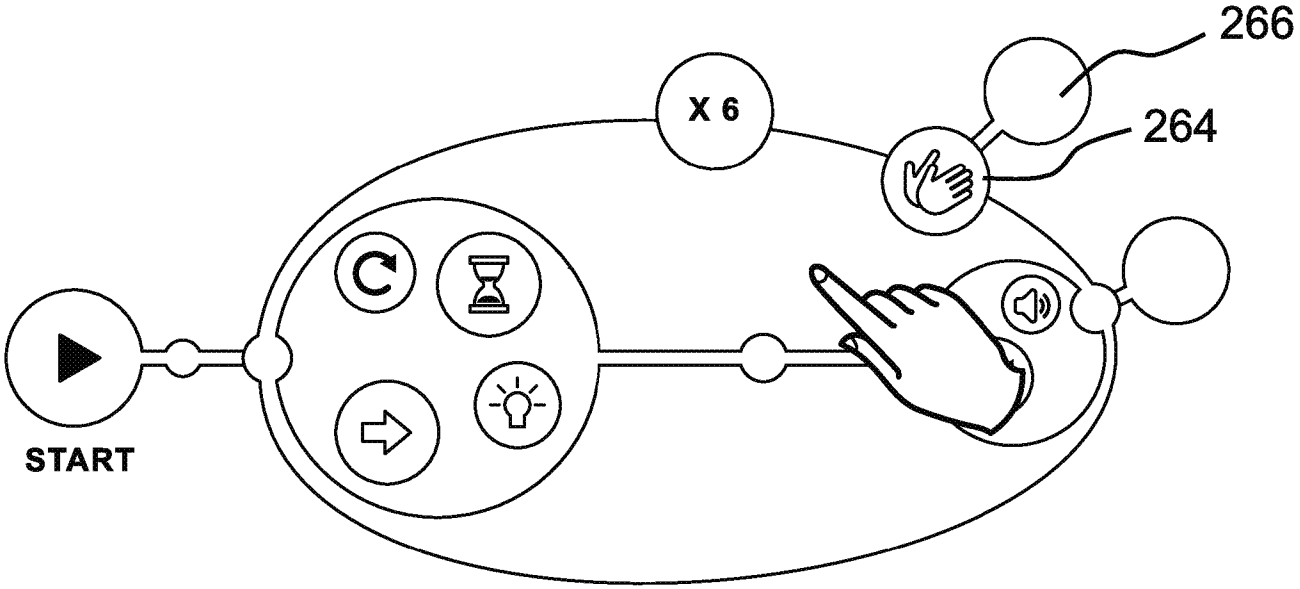
Figure 35C:
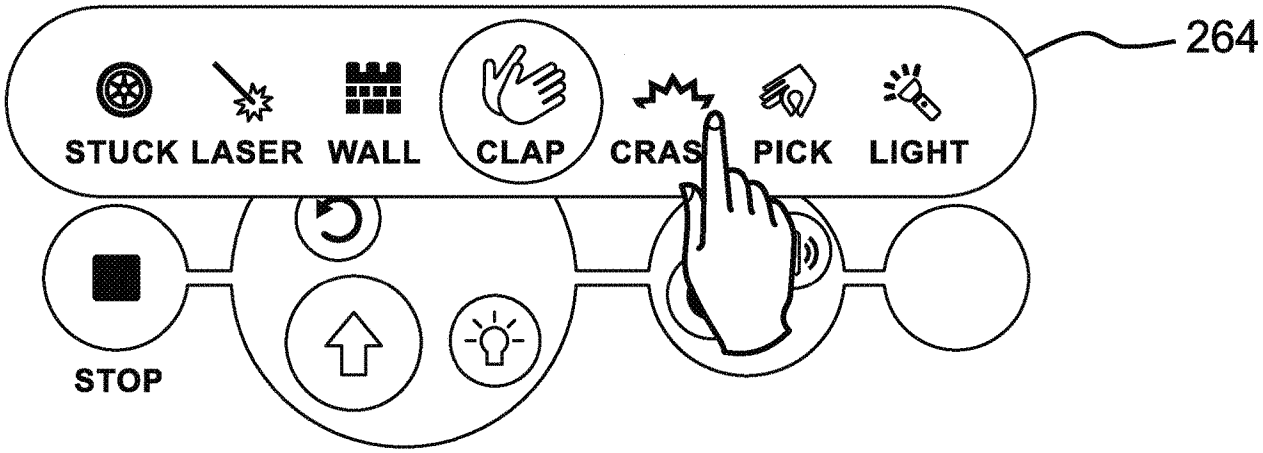
Figure 35D:
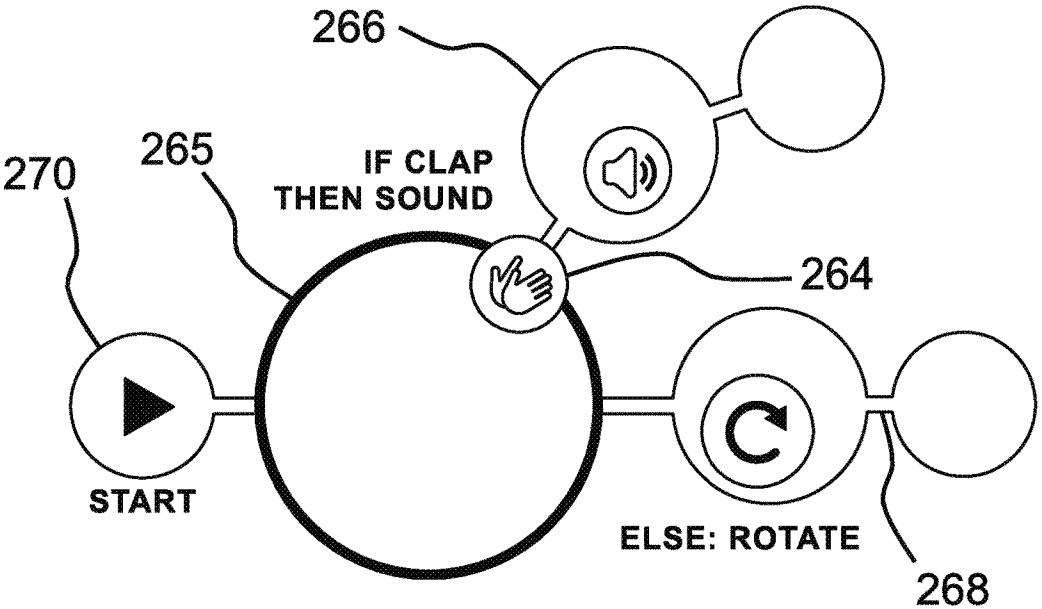

As illustrated in FIGS. 33(A-B), the modular construction kit 100 moves on to execute the next bubble 252 when all commands in a bubble 250 are completed and, for example, there is no special condition as described herein.

FIGS. 34(A-D) illustrate an exemplary creation of a loop bubble (operation) 260, by drawing a circle around selected bubbles. The number of times 262 to execute the loop 260 may be entered (e.g., ×6 as illustrated).

FIGS. 35(A-D) illustrate an exemplary creation of an "if" chain (operation) 266, by selecting and dropping a command or action (e.g., Clap) at the edge of a bubble 265. The "else" chain 268 (of the if-then-else logic) may then be the other bubble chain from the bubble 265. In some embodiments, while the modular construction kit 100 executes the action commands, it monitors the condition(s) of the "if" command. If the condition is met, for example, a clap sound is received or an obstacle is sensed, it stops executing all actions and moves to the bubble attached to the "if".

Figure 36:
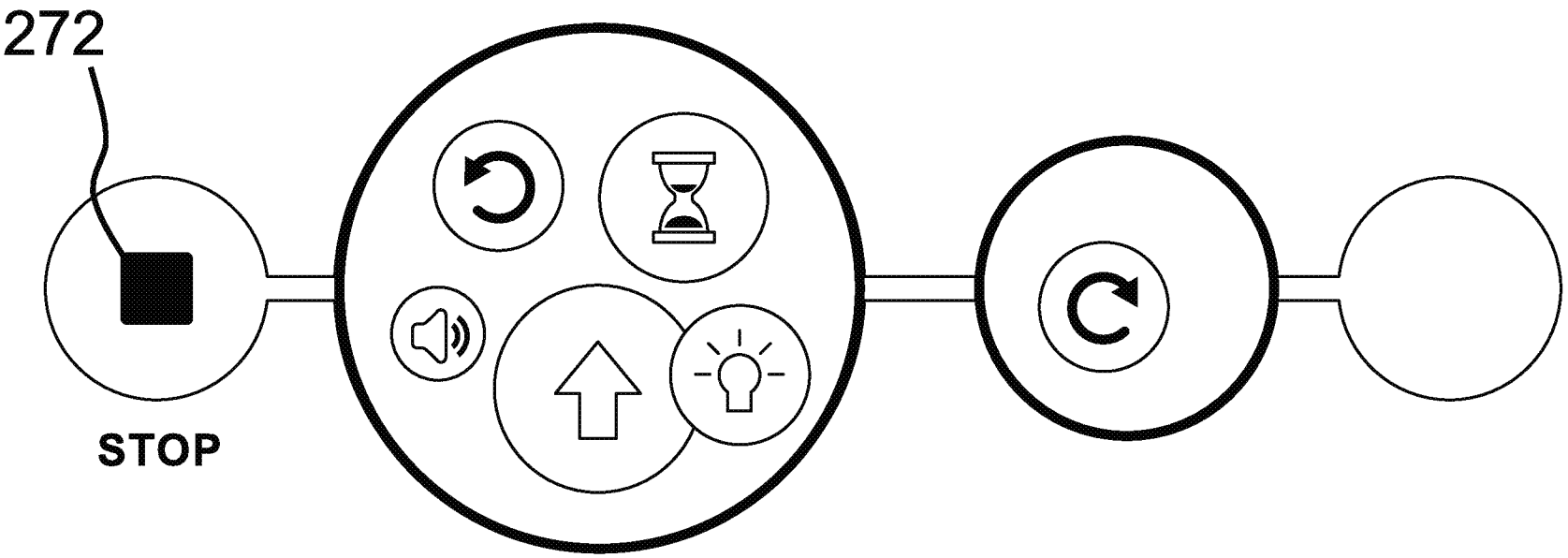

In some exemplary operations, when a user selects or presses the Start (Play) bubble 270, the program may be sent from the wireless device to the modular construction kit 100. The modular construction kit 100 may then execute the program step by step until the chain of bubbles ends, or when the user presses the Stop bubble 272, as illustrated in FIG. 36.

Figure 37:
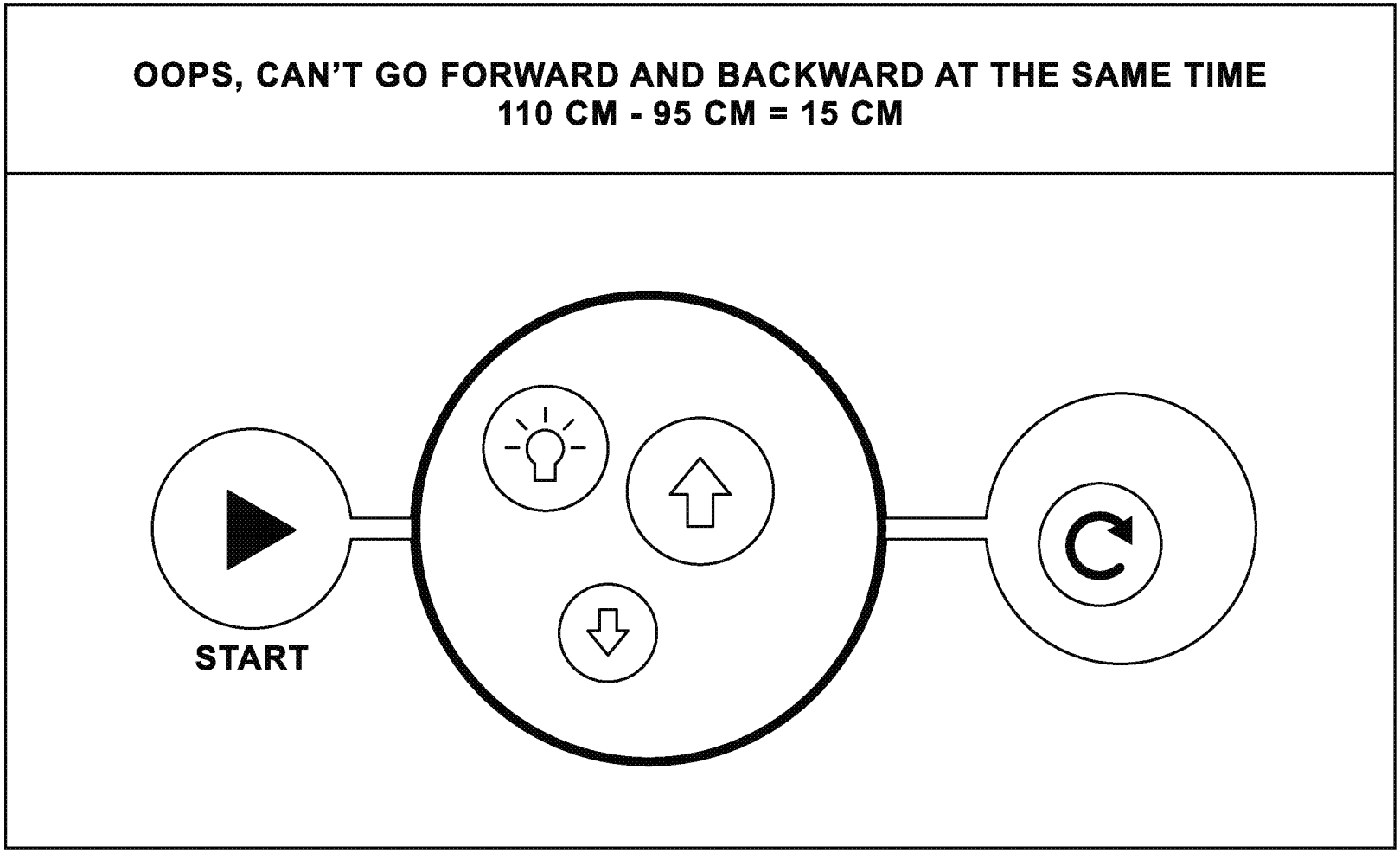

FIG. 37 illustrates exemplary embodiments of error handling. For example, some bubbles may contain contradictory actions, such as Move Forward 110 cm and Move Backward 95 cm, so that execution of the actions may not be possible. In these embodiments, the modular construction kit 100 may display an error message, for example, "Oops, can't go forward and backward at the same time."). The modular construction kit 100 may use best effort to execute the action commands. In the example, the modular construction kit 100 may move forward 15 cm, and displays the message "110 cm−95 cm=15 cm." The modular construction kit 100 may not require additional action from the user and educates the user about how the modular construction kit 100 interprets the commands.

Figure 38:
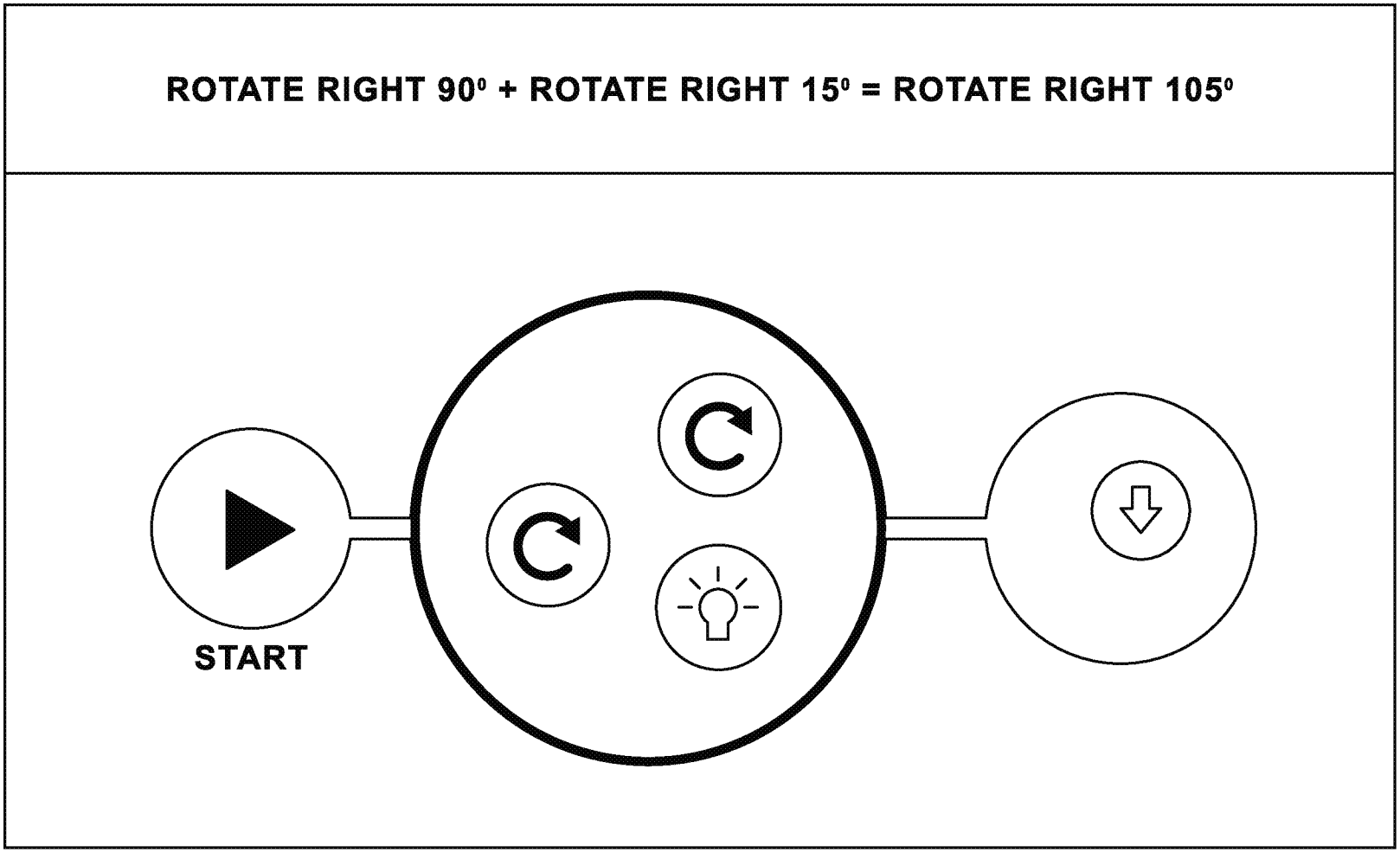

FIG. 38 illustrates exemplary embodiments of duplicated actions handling. For example, some bubbles may contain duplicated actions, such as Rotate Right 90° and Rotate Right 15°. The modular construction kit 100 may use best effort to execute the action commands. In the example, the modular construction kit 100 may rotate right 105°, and displays the message "Rotate right 90°+Rotate right 15°=rotate right 105°."

Figure 39:
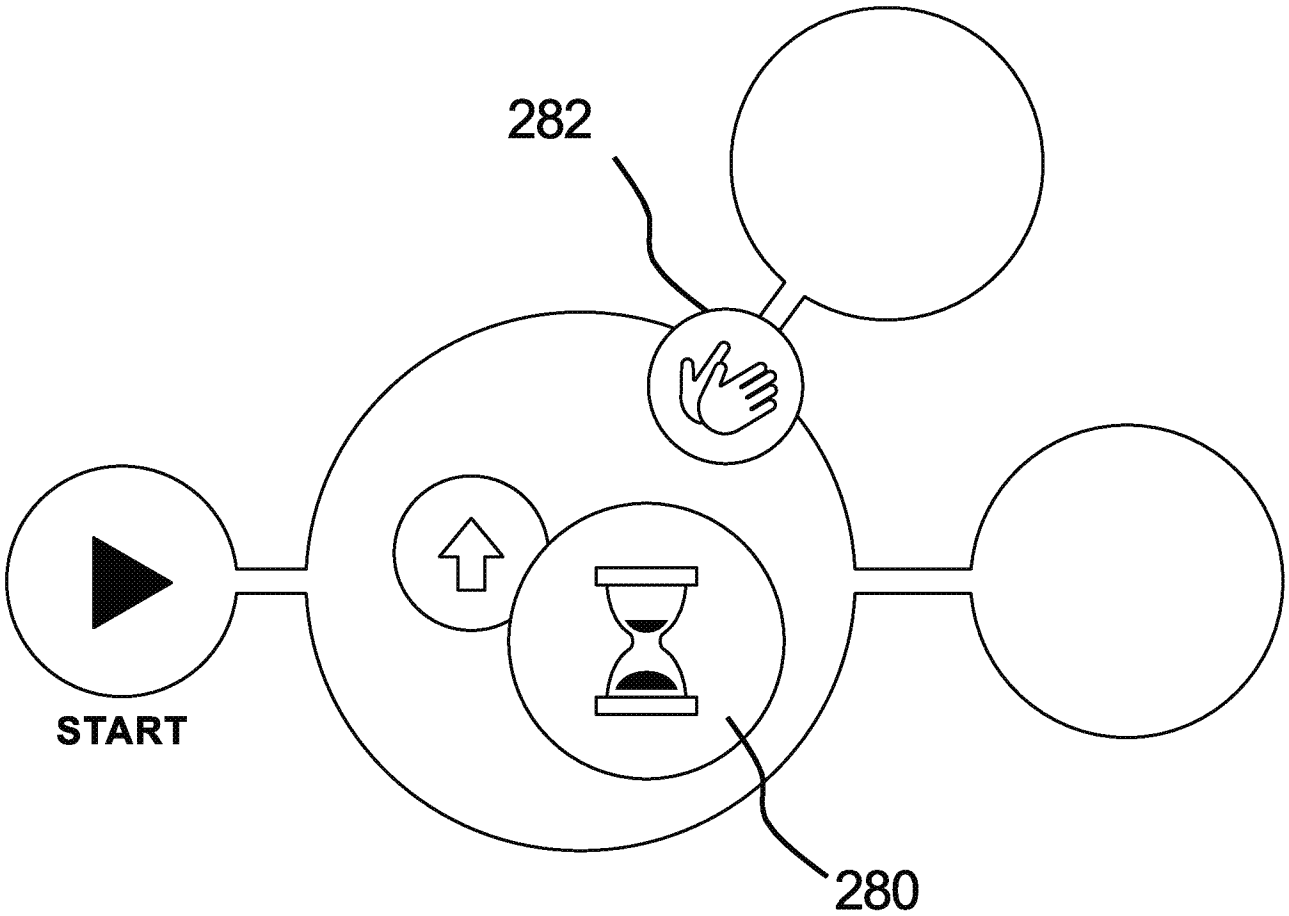

FIG. 39 illustrates an exemplary embodiment of a Wait command 280, as illustrated with a glass timer icon. When executing a bubble with a Wait command 280, the modular construction kit 100 may execute all other commands in the bubble, then waits for the amount of time specified in the Wait command 280. When the Wait timer expires, the modular construction kit 100 may move on to the next bubble. However, when the bubble also includes an "if" condition, as illustrated with condition 282, the modular construction kit 100 may execute the "if" chain when the condition is met, although the Wait timer has not expired.

Figure 40:
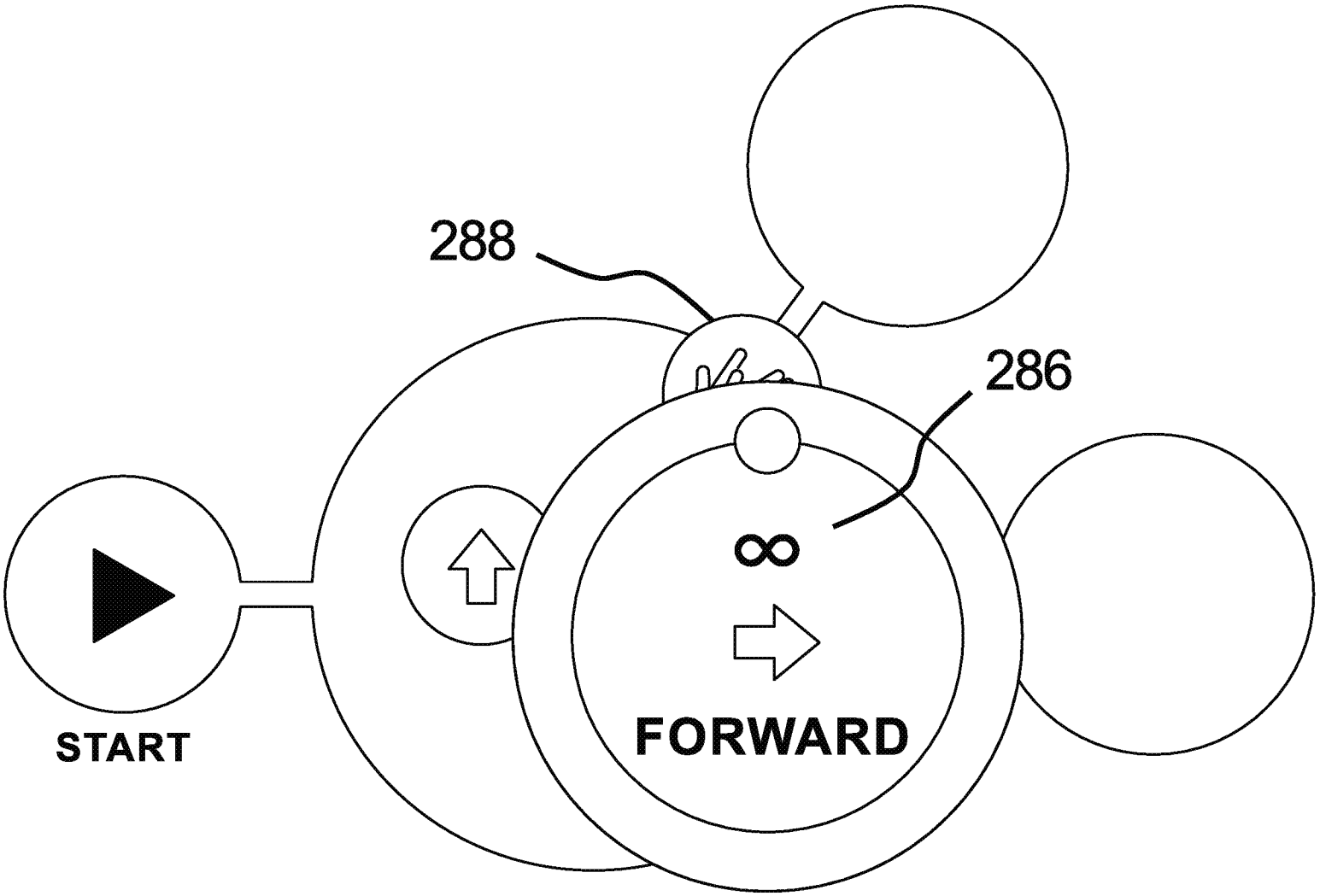

FIG. 40 illustrates an exemplary embodiment of an Infinite action, as illustrated with an infinity icon 286. An Infinite action may be executed indefinitely. For example, rotate indefinitely, move forward indefinitely, and so on. However, when the bubble also includes an "if" condition, as illustrated with condition 288, the modular construction kit 100 may execute the "if" chain when the condition is met, interrupting the infinite action.

Figure 41:
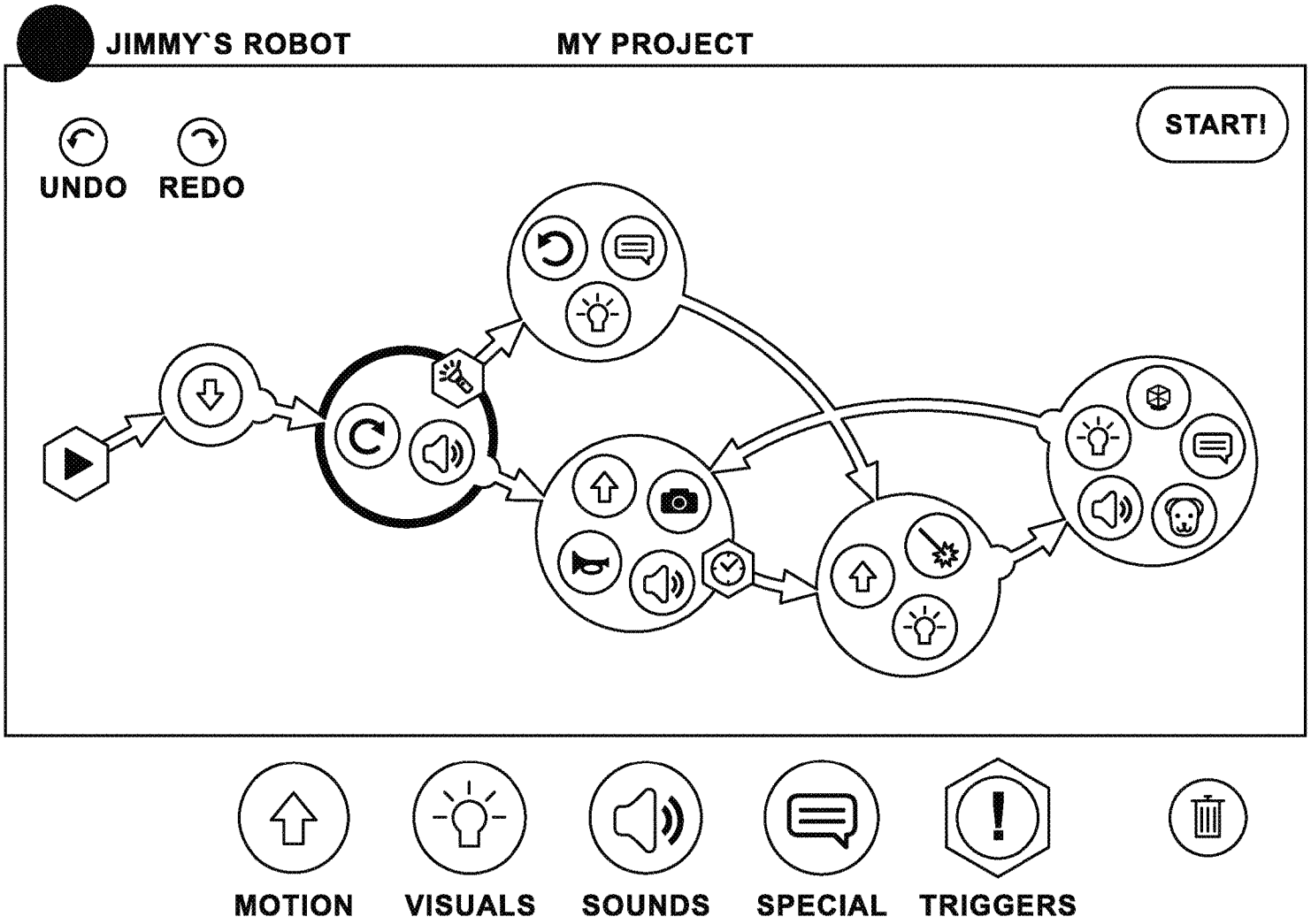

FIG. 41 illustrates an exemplary program using the programming UI 200 of the modular construction kit 100. As described herein, a program may be uploaded to a construction of the modular construction kit 100 and may cause the modular construction kit 100 to operate autonomously.

FIGS. 42-55 illustrate an exemplary embodiment of a user-definable control UI 300 of the modular construction kit 100. As described herein, the control UI may be provided at a wireless device, for example, a tablet, a laptop, a smart phone, or any wireless device having communication capability (e.g., WiFi, Bluetooth, or RF). The control UI may provide interfaces for a user to control a construction of the modular construction kit 100, for example, a robot. The control UI may provide a grid 310 where windows or boxes 312 may be created, for example, by a user to represent the actions of the modular construction kit 100. In some embodiments, the windows 312 may have predetermined dimensions. In some embodiments, the user may define the dimensions.

Figure 42:
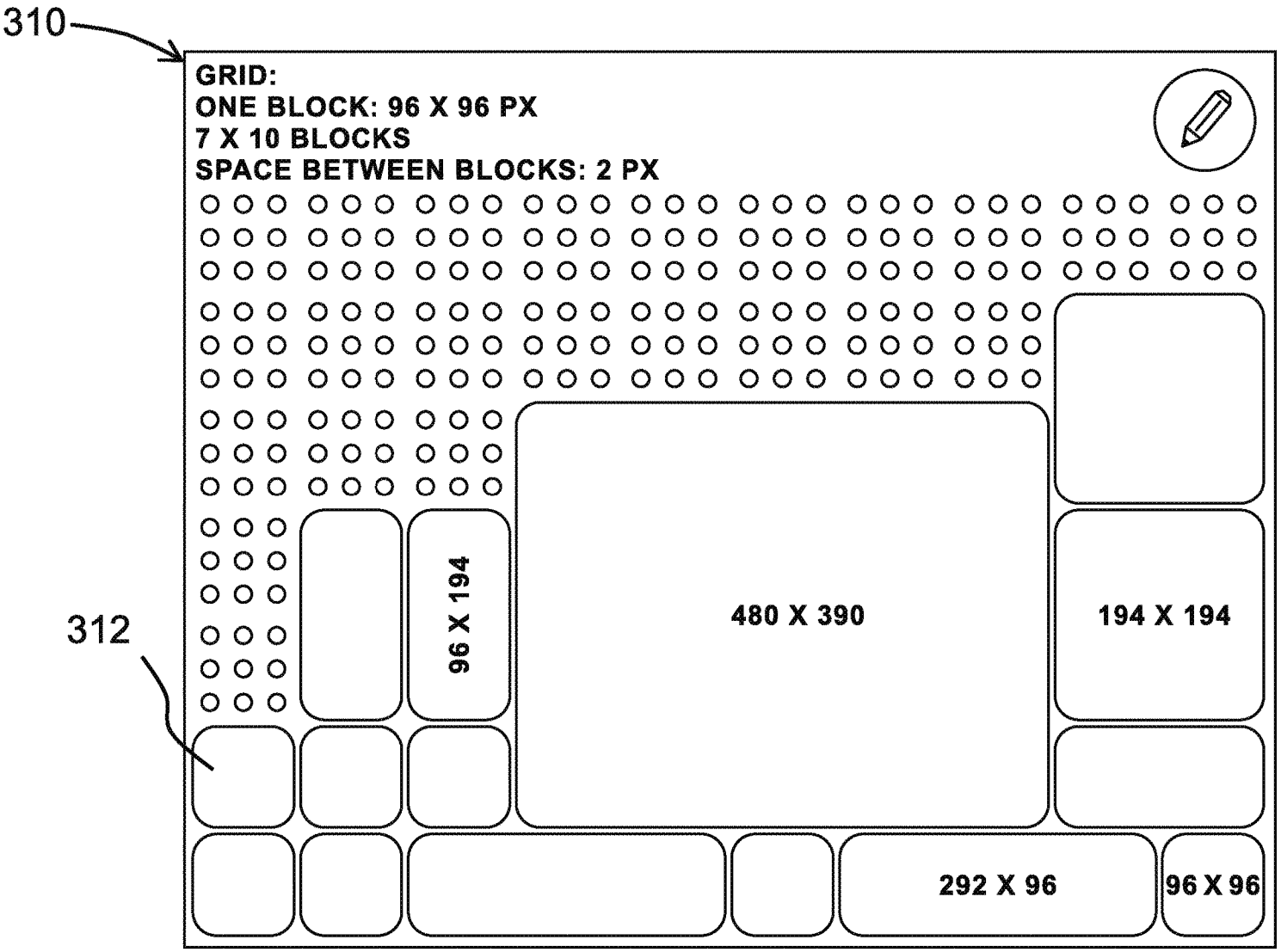
FIGS. 42-52 illustrate a user-definable control user interface (UI) for a modular construction kit according to an embodiment of the present invention.
Figure 43:
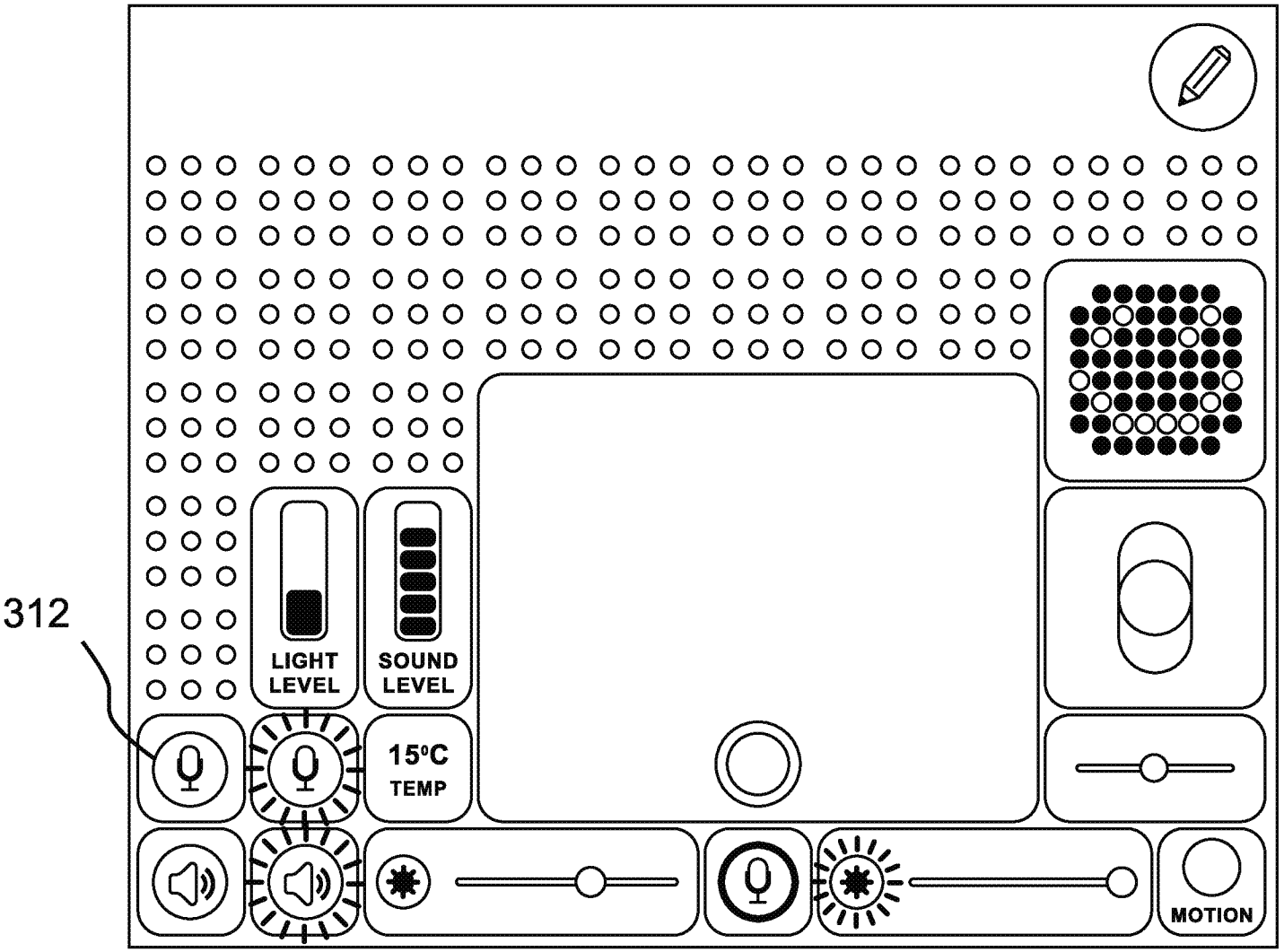
Figure 44:
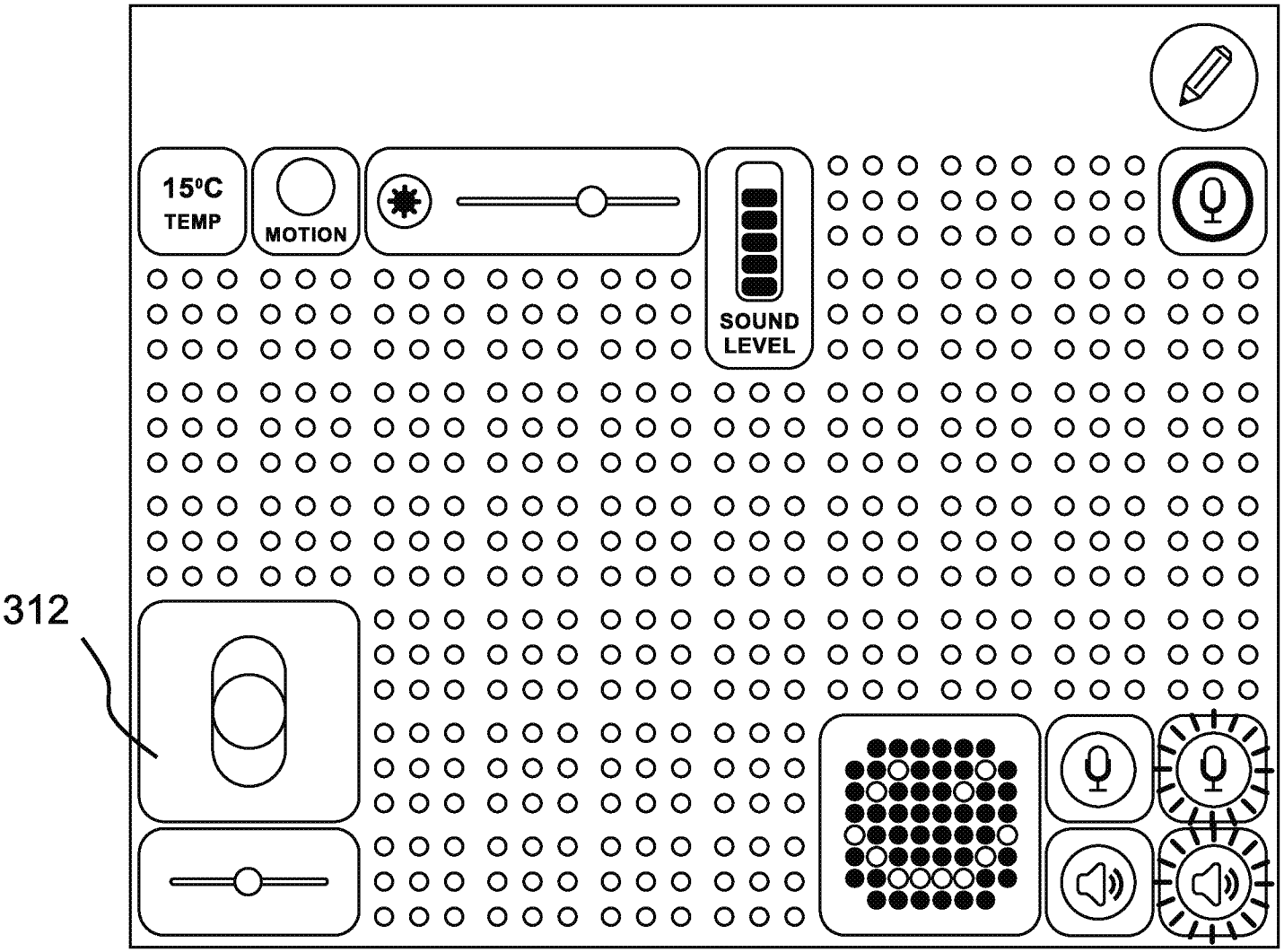

FIG. 43 illustrates an exemplary control UI of FIG. 42 with the windows 312 filled with action controls, which will be described in more detail herein. In some embodiments, the windows 312 may be rearranged, added or deleted. FIG. 44 illustrates an exemplary control UI with some windows from FIG. 43 rearranged and some deleted.

Figure 45:
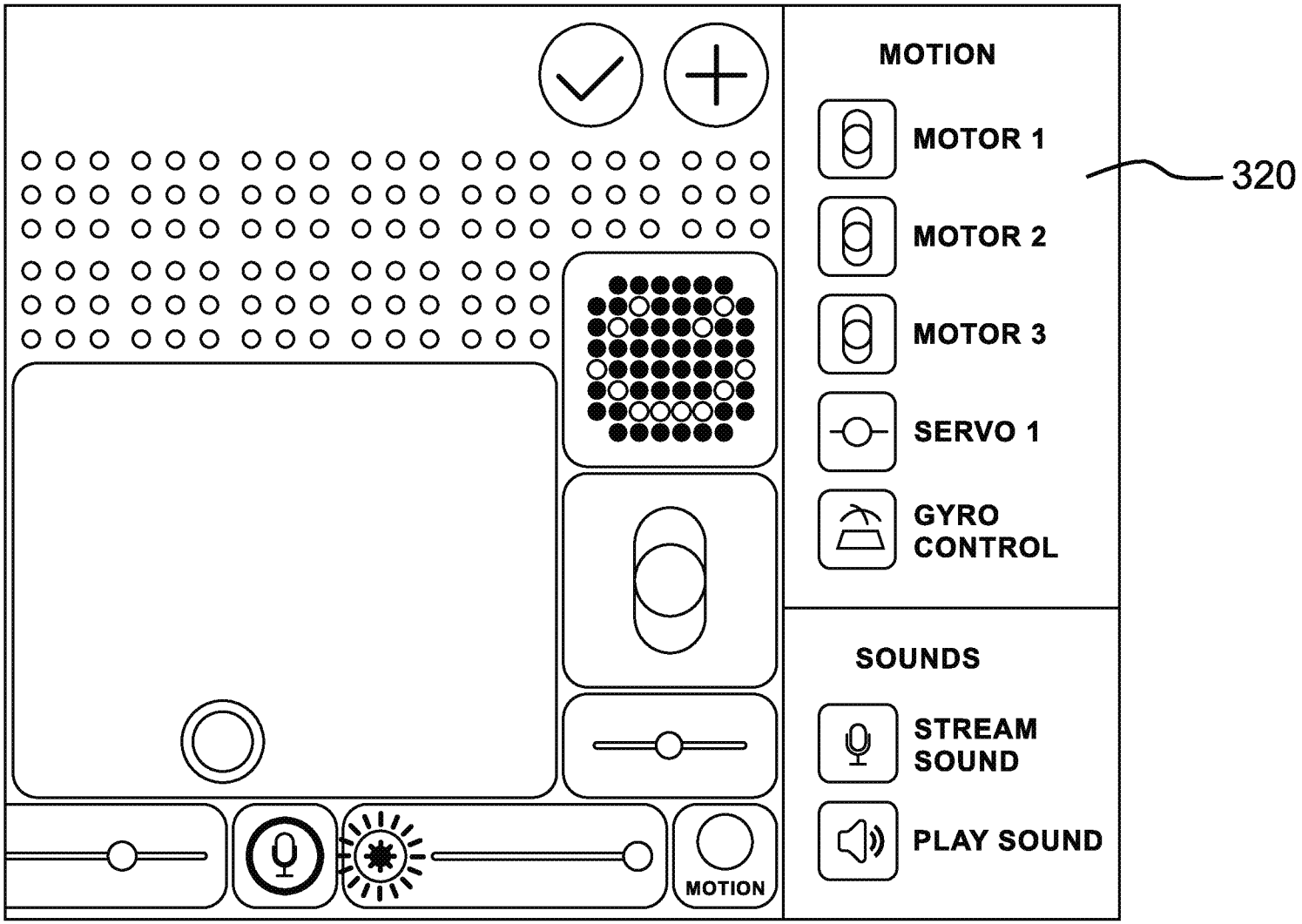

FIG. 45 illustrates an exemplary side menu 320 provided by the modular construction kit 100. The menu 320 may provide action commands that the user may select to fill into the windows 312. The actions illustrated include Motor 1 for representing a first motor action, Motor 2 for controlling a second motor cube, Servo 1 for controlling a first servomotor cube, Play Sound for playing a sound at a cube with sound function, and so on.

Figure 46:
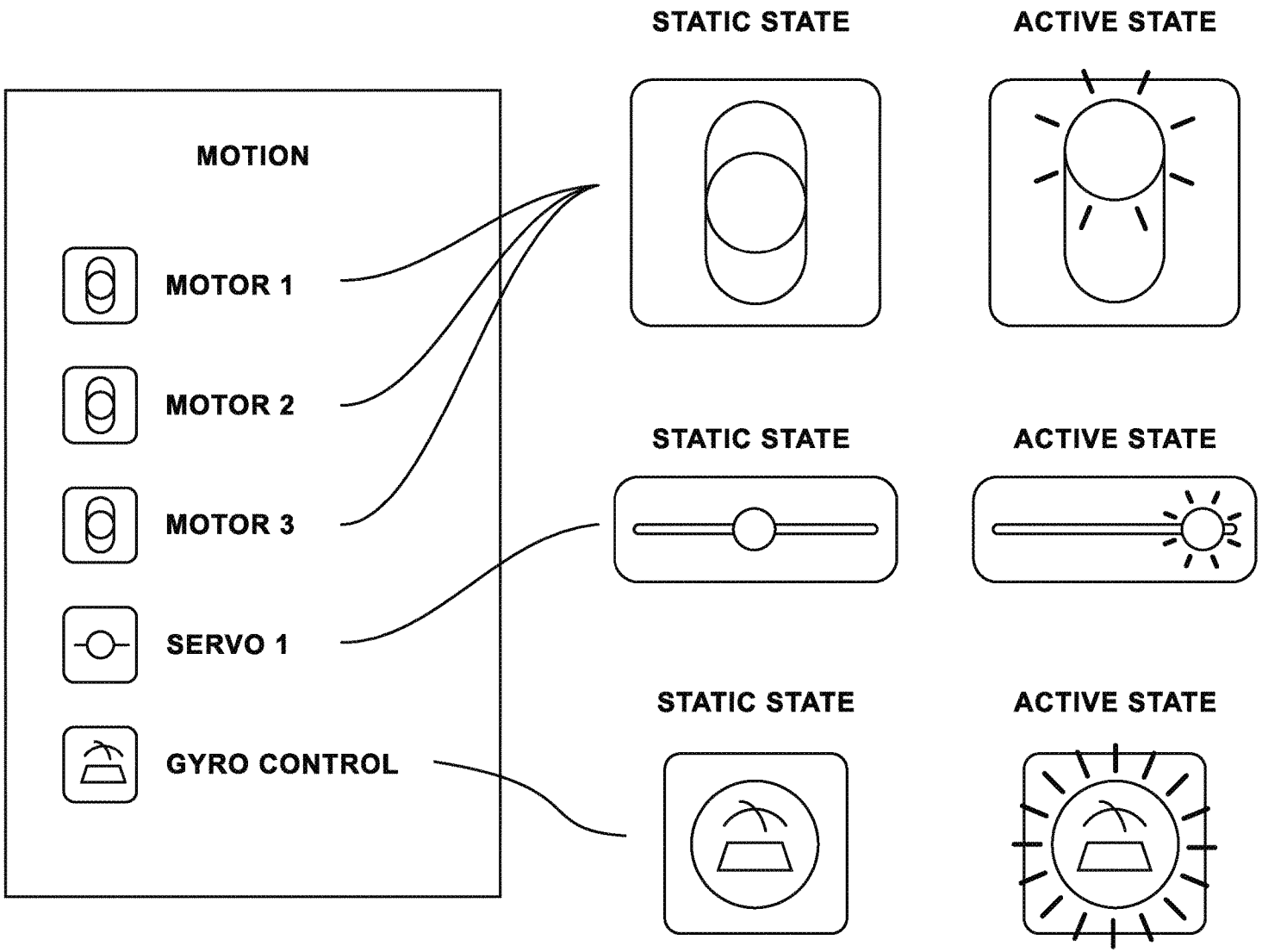
Figure 47:
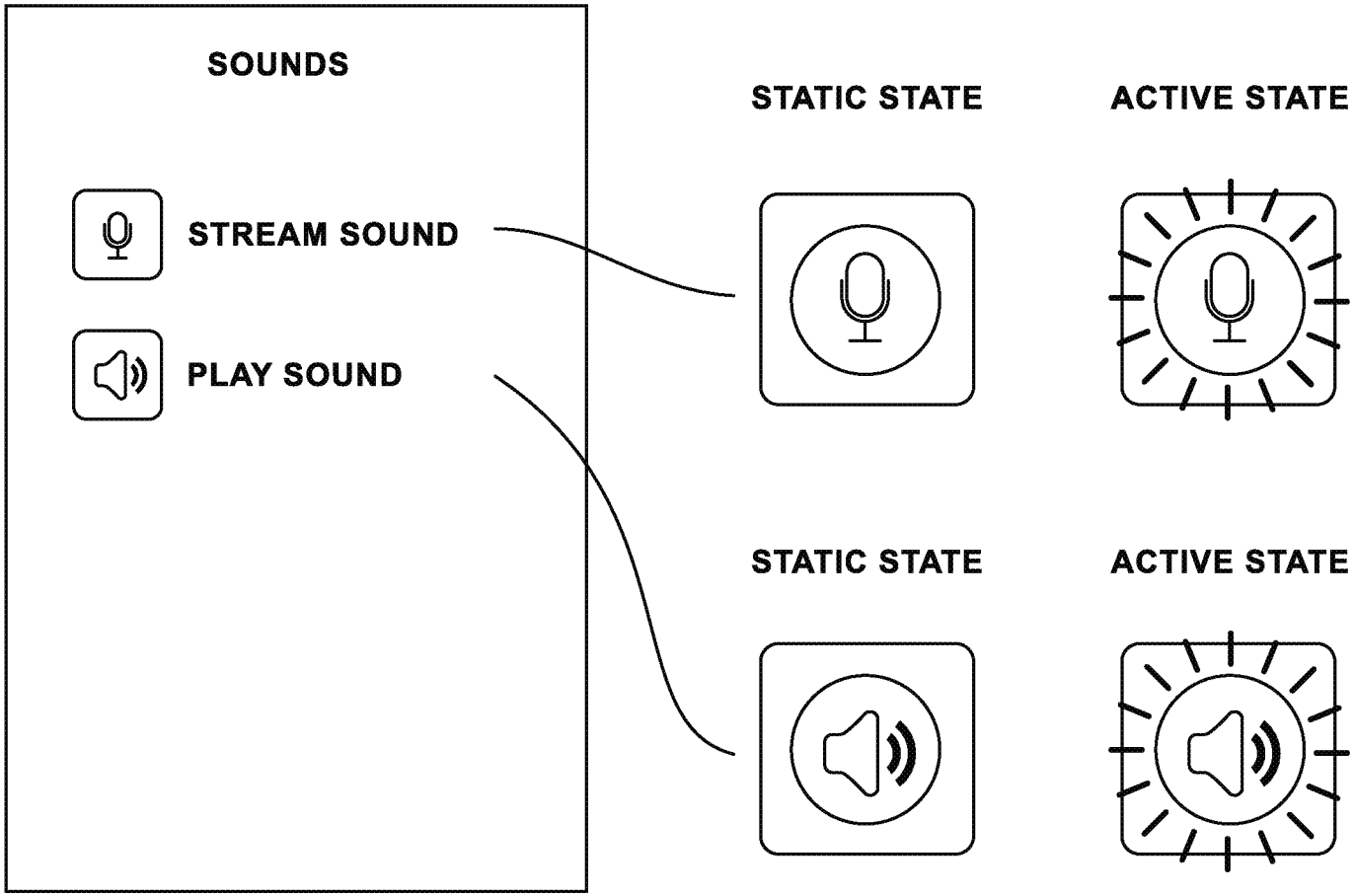
Figure 48:
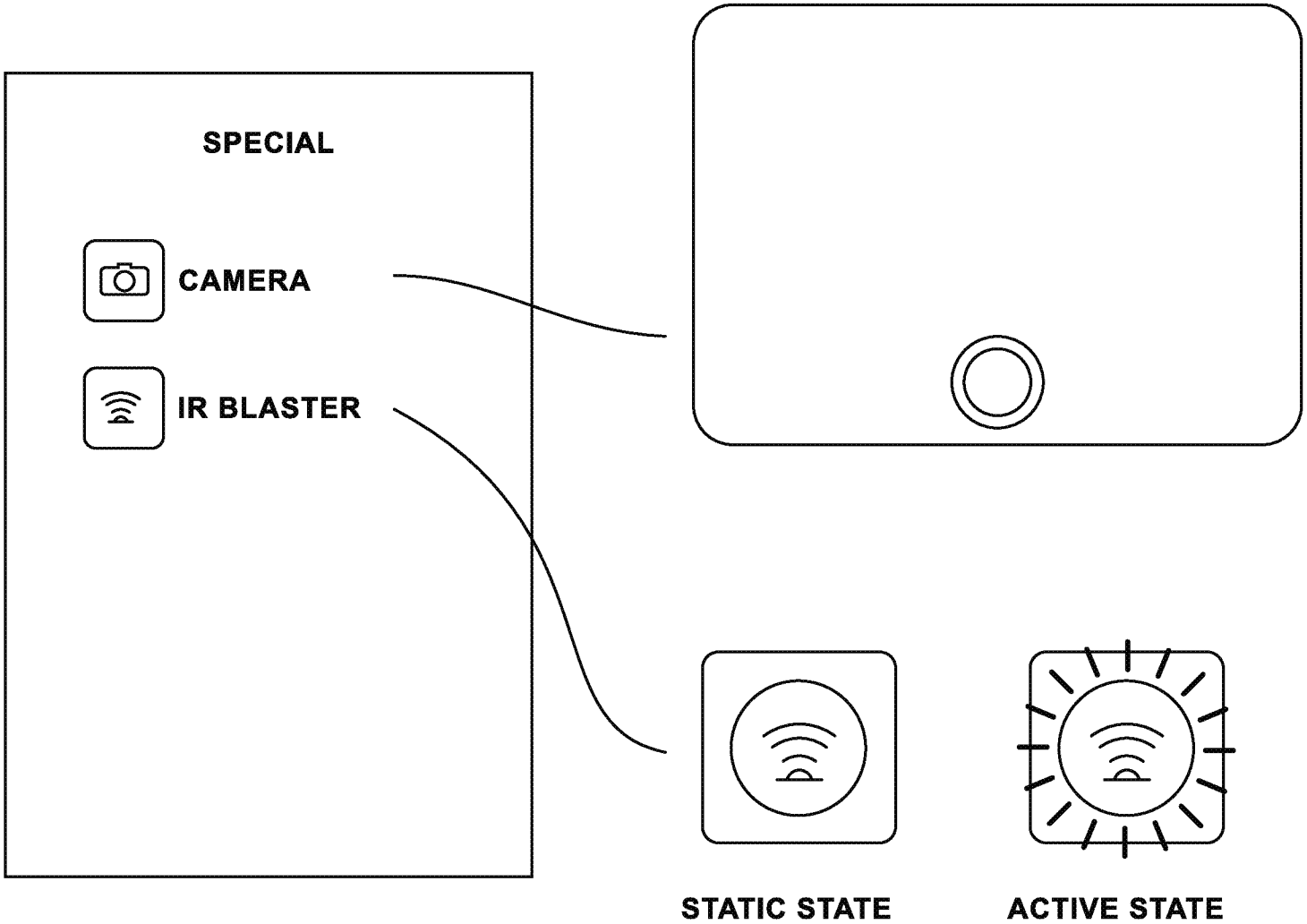

FIGS. 46-48 illustrate exemplary control features and indications of activity or received status for some example actions. For example, FIG. 46 illustrates exemplary control of, or status from some Motion category cubes. The cubes may be put in a Static or Active state. Or the modular construction kit 100 may report the status of the cubes as in Static or Active state. Similarly, FIG. 47 illustrates exemplary control of, or status from some Sound category cubes, and FIG. 48 illustrates exemplary control of, or status from some Special category cubes.

Figure 49:
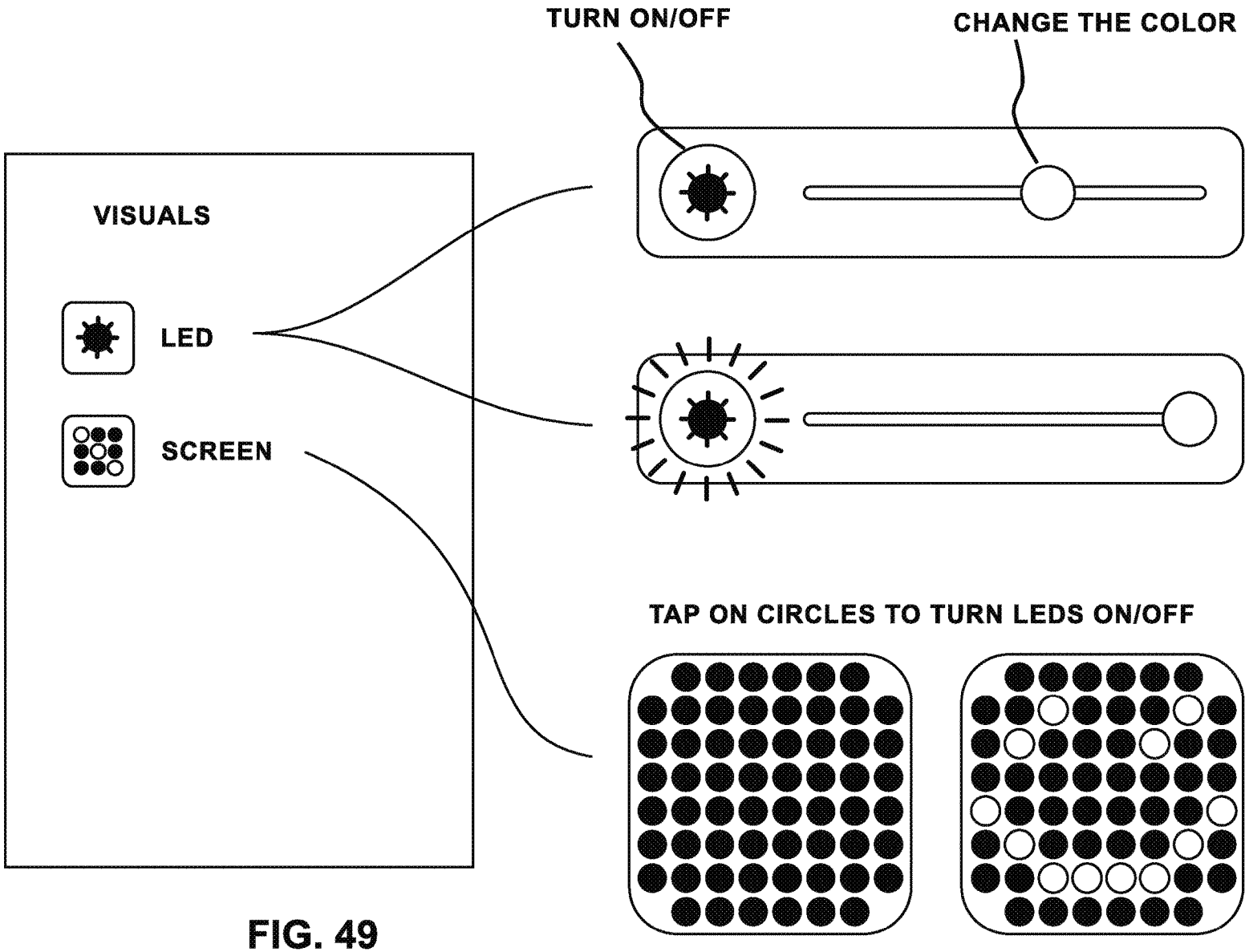

FIG. 49 illustrates exemplary control of, or status from some Visuals category cubes. For example, an LED cube may be turned ON or OFF, or change colors from a control window in the control UI. In another example, an LED screen cube may be set up from a control window in the control UI by tapping on the displayed circles to turn each corresponding LED of the LED screen ON or OFF.

Figure 50:
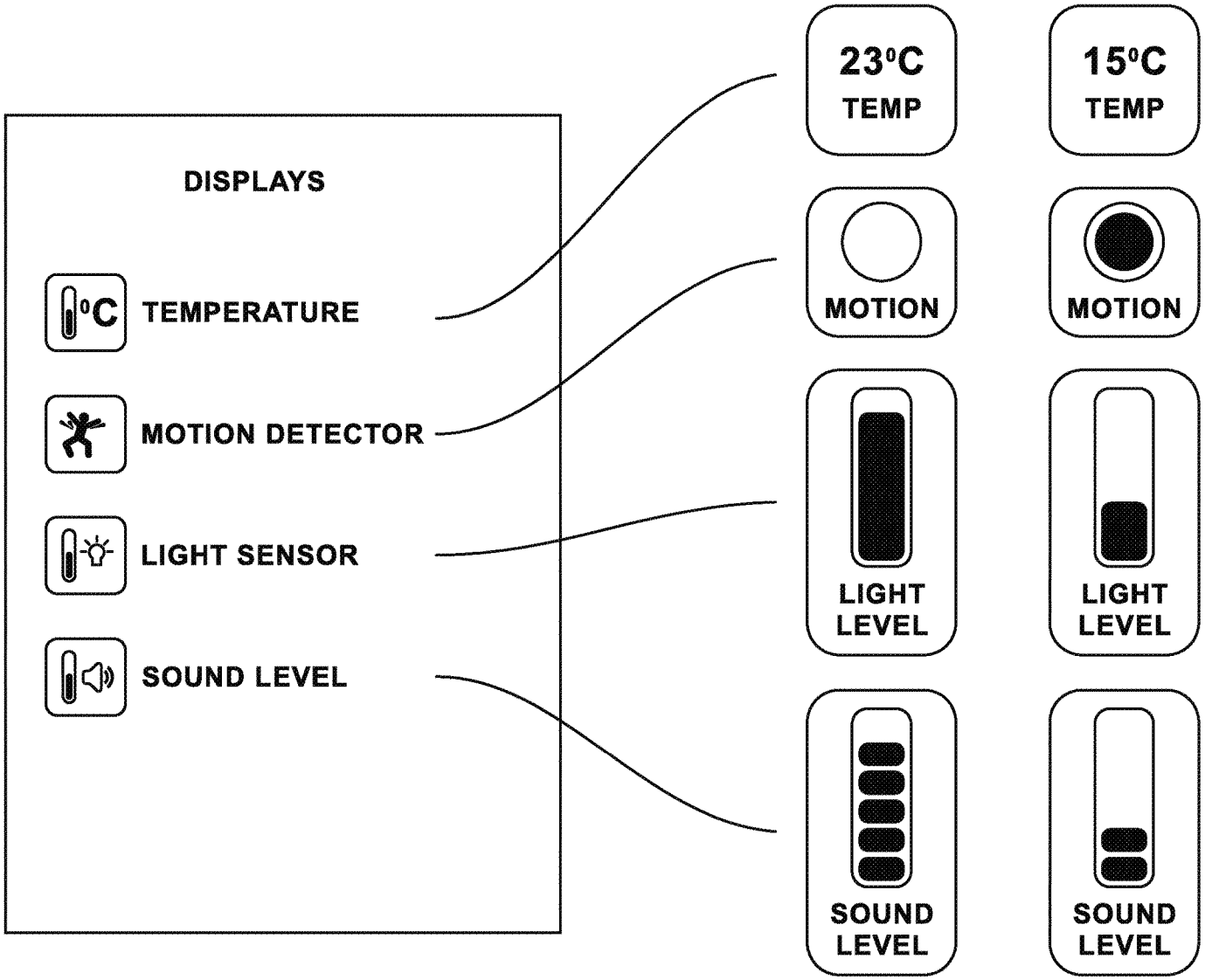
Figure 51:
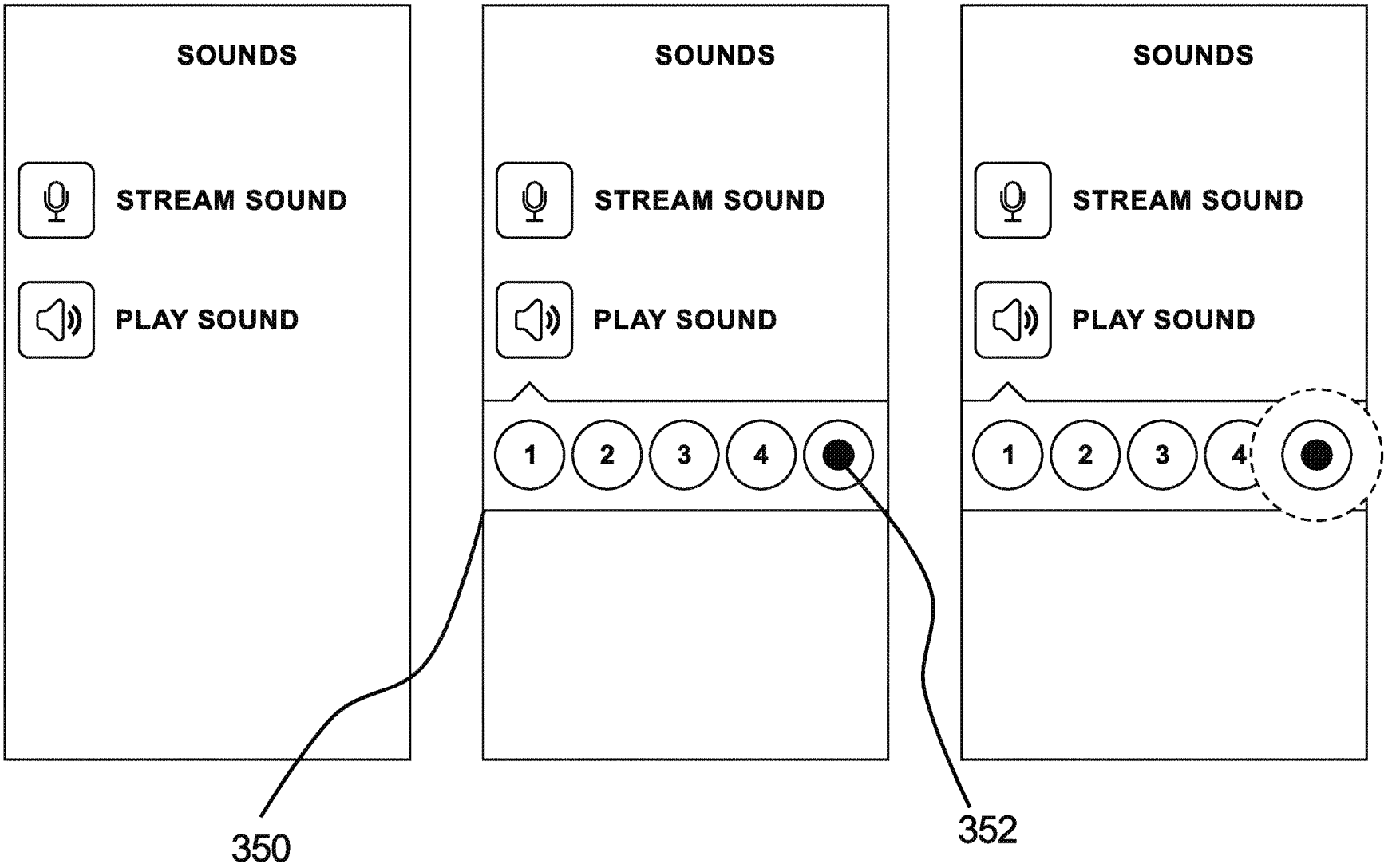

FIG. 50 illustrates exemplary control of, or status from some Display category cubes. For example, a Motion sensor cube may be turned ON or OFF, or may report whether a motion has been sensed by displaying different statuses, a meteorology cube may report the read temperature, a light sensor cube may report the amount or intensity of light sensed, a sound cube may report the level of sound detected, and so on.

Some cubes of the modular construction kit 100 may provide selectable outputs. For example, a sound cube may output different selectable sounds. As illustrated in the exemplary UI in FIG. 51, the control UI may provide a menu 350 for selecting a sound (e.g., Sound 1, Sound 2, Sound 3, Sound 4) to play. The menu 350 may also provide a Record button 352 when the cube has a microphone to record sound.

Figure 52:
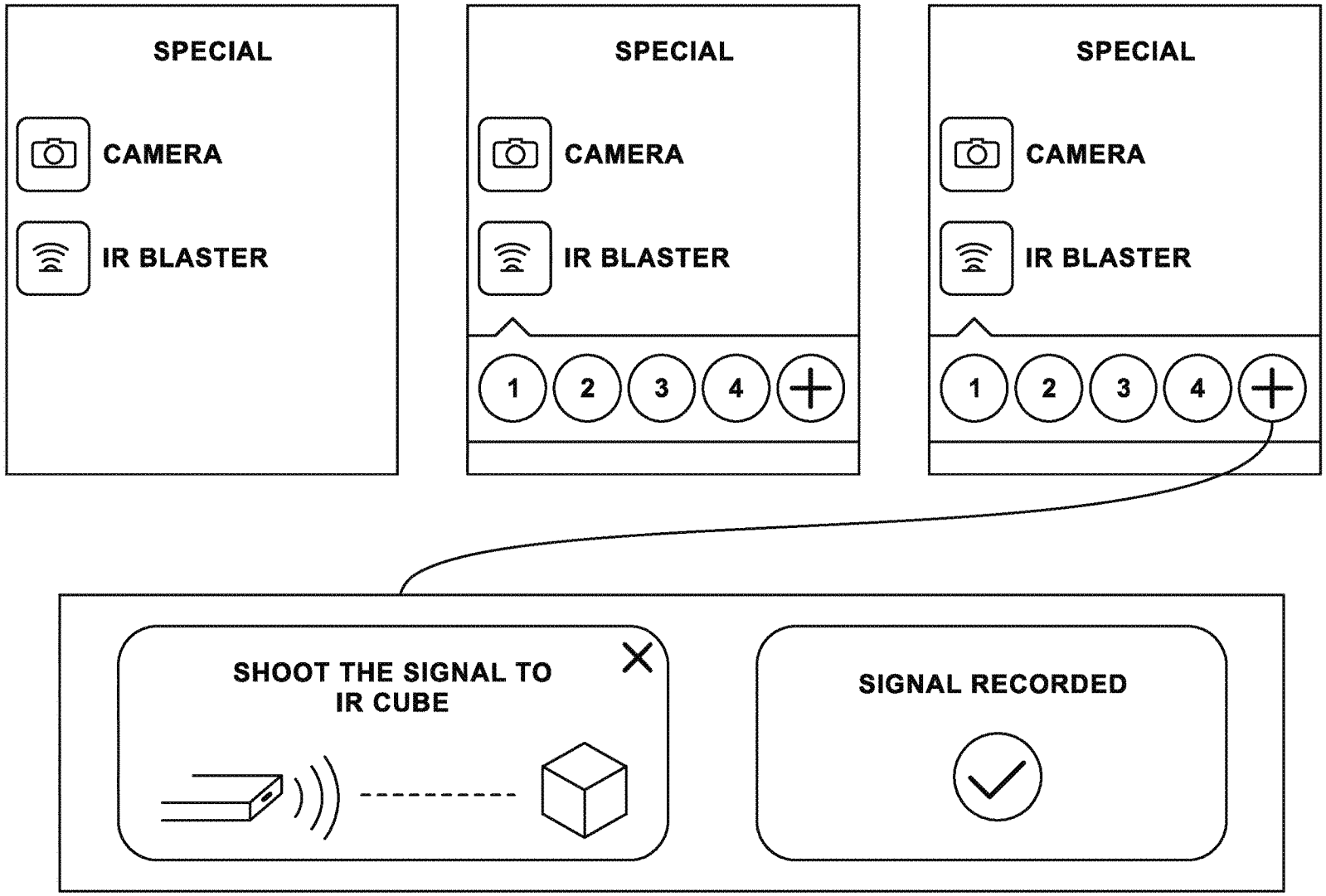

FIG. 52 illustrates exemplary control menus for Special category cubes. For example, a control menu may be provided to control an IR cube to receive IR signal from an external source.

Other control UI menus for other categories are also contemplated.

In some embodiments, the modular construction kit 100 may provide external control from an external device, e.g., a laptop or tablet, with gesture control sensors, such as those provided by Microsoft Kinect or Leap Motion, to have the user's movements control the motions or movements of a construction.

In some embodiments, the modular construction kit 100 may include virtual reality (VR) capability. In some exemplary operations, the modular construction kit 100 may stream images captured by a camera to a VR device, such as a headset. Movement of the VR device, for example, a user's head movement with a VR headset, may change the camera positions, so that the user may observe the area around the camera.

These and other embodiments of the modular construction kit 100 may be combined. For example, the VR capability may be combined with gesture control and other features of the modular construction kit 100 to provide the user with a fully immerse experience.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the described subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims, if any, and it is made clear, here, that each named inventor believes that the claimed subject matter is what is intended to be patented.

What is claimed is:

1. A modular construction kit comprising:

at least one modular construction block, the modular construction block comprising at least one outwardly facing interface face, wherein the interface face includes a recess, a plurality of connection apertures disposed proximate to each edge of the recess, and a circular electrical interface receptacle disposed in a center of the recess;

at least one removeable flat thin planar modular construction connector, the removeable modular construction connector including:

two opposite sides, each side comprising a flat body, a plurality of flexible connection studs positioned proximate to at least two opposite edges of the removeable modular construction connector and extending outwardly from each side of the flat body and sized to fit into the connection apertures, and a circular protrusion positioned in a center of each side of the flat body and extending outwardly from the flat body with one or more spring-loaded electrical interface pins disposed on the circular protrusion, wherein the circular protrusion is sized to fit into the circular electrical interface receptacle and wherein the one or more spring-loaded electrical interface pins enable an electrical connection between two modular construction blocks connected to the removeable modular construction connector on each of the two opposite sides;

at least one modular construction block having a predetermined function; and a modular system block comprising at least a processor, storage, and wireless communication.

2. The modular construction kit of claim 1 further comprises a programming user interface.

3. The modular construction kit of claim 1 further comprises a control user interface.

4. The modular construction kit of claim 1 further comprises at least one removeable modular construction wired connector that includes two opposite end connectors inwardly coupled together by a connection wire, wherein each end connector includes an outward facing side one or more connection studs and a circular protrusion extending outwardly, the circular protrusion includes one or more spring-loaded electrical interface pins disposed on the circular protrusion, wherein the circular protrusion is sized to fit into the circular electrical interface receptacle and wherein the one or more spring-loaded electrical interface pins enable an electrical connection between two modular construction blocks connected to the removeable modular construction wired connector on each of the two opposite ends of the removeable modular construction wired connector.

* * * * *